US006221435B1

(12) United States Patent
Nielsen

(10) Patent No.: US 6,221,435 B1
(45) Date of Patent: Apr. 24, 2001

(54) METHOD FOR THE SPRAY APPLICATION OF POLYMERIC-CONTAINING LIQUID COATING COMPOSITIONS USING SUBCRITICAL COMPRESSED FLUIDS UNDER CHOKED FLOW SPRAYING CONDITIONS

(75) Inventor: Kenneth Andrew Nielsen, Charleston, WV (US)

(73) Assignee: Union Carbide Chemicals & Plastics Technology Corporation, Danbury, CT (US)

( * ) Notice: Subject to any disclaimer, the term of this patent is extended or adjusted under 35 U.S.C. 154(b) by 0 days.

(21) Appl. No.: 09/195,112

(22) Filed: Nov. 18, 1998

(51) Int. Cl.[7] ..... B05D 1/02
(52) U.S. Cl. ..... 427/421; 239/398
(58) Field of Search ..... 427/421; 239/302, 239/337, 398

(56) References Cited

U.S. PATENT DOCUMENTS

| | | | |
|---|---|---|---|
| 3,469,788 | 9/1969 | Glaros | 239/307 |
| 4,124,528 | 11/1978 | Modell | 252/411 |
| 4,189,914 | 2/1980 | Marek et al. | 60/726 |
| 4,375,387 | 3/1983 | deFilippi et al. | 202/169 |
| 4,582,731 | 4/1986 | Smith | 427/421 |
| 4,619,735 | 10/1986 | Norton | 162/135 |

(List continued on next page.)

FOREIGN PATENT DOCUMENTS

| | | | |
|---|---|---|---|
| 2603664 | 8/1977 | (DE) | B65B/31/02 |
| 2853066 | 6/1980 | (DE) | B05D/1/22 |
| 0492535 | 7/1992 | (EP) . | |
| 0506067 | 9/1992 | (EP) . | |
| 55-84328 | 6/1980 | (JP) | C08J/2/02 |
| 58-168674 | 10/1983 | (JP) | C09J/3/14 |
| 59/16703 | 1/1984 | (JP) | B27K/3/52 |
| 62-152505 | 7/1987 | (JP) | B01D/9/02 |
| 868051 | 4/1988 | (ZA) . | |

OTHER PUBLICATIONS

Francis, A.W., "Ternary Systems of Liquid Carbon Dioxide", J. Phys. Chem. 58:1099, Dec., 1954.

Smith, R. D., et al., "Direct Fluid Injection Interface for Capillary Supercritical Fluid Chromatography–Mass Spectrometry", J. Chromatography 247 (1982) : 231–243.

Krukonis, V., Supercritical Fluid Nucleation of Difficult–to–Comminute Solids, paper presented at 1984 Annual Meeting: AIChE, San Francisco, California, Nov. 25–30/1984.

Dandage, D.K., et al., "Structure Solubility Correlations : Organic Compounds and Dense Carbon Dioxide Binary Systems", Ind. Eng. Chem. Prod. Res. Dev. 24 : 162–166 (1985). (No month).

Matson, D.W., et al., "Production of Powders by the Rapid Expansion of Supercritical Solutions", J. Materials Science 22 : 1919–1928 (No month) (1987).

McHugh, M.A. et al., "Supercritical Fluid Extraction, Principles and Practice", Butterworth Publishers (1986) Table of Contents and Appendices (no month).

(List continued on next page.)

*Primary Examiner*—Shrive Beck
*Assistant Examiner*—Jennifer Calcagni
(74) *Attorney, Agent, or Firm*—G. P. Rooney

(57) ABSTRACT

Processes are disclosed for the use of subcritical compressed fluids, such as carbon dioxide or ethane, to reduce viscosity and to enhance atomization when spray applying coating compositions containing low molecular weight polymers to substrates, by using spray conditions that produce choked flow in the liquid mixture being sprayed, wherein the subcritical compressed fluid is a gas at standard conditions of 0° C. temperature and one atmosphere pressure and is miscible with the coating composition.

21 Claims, 21 Drawing Sheets

U.S. PATENT DOCUMENTS

| | | | | |
|---|---|---|---|---|
| 4,734,227 | | 3/1988 | Smith | 264/13 |
| 4,734,451 | | 3/1988 | Smith | 524/493 |
| 4,737,384 | | 4/1988 | Murthy et al. | 427/369 |
| 4,902,757 | | 2/1990 | Kordomenos et al. | 525/440 |
| 4,923,720 | | 5/1990 | Lee et al. | 427/422 |
| 4,927,868 | | 5/1990 | Schimmel et al. | 523/439 |
| 5,178,325 | * | 1/1993 | Nielsen | 239/1 |
| 5,212,229 | * | 5/1993 | Taylor et al. | 524/556 |
| 5,362,519 | * | 11/1994 | Argyropoulos et al. | 427/385.5 |
| 5,419,487 | * | 5/1995 | Nielsen et al. | 239/10 |
| 5,464,154 | * | 11/1995 | Nielsen | 239/1 |
| 5,833,891 | * | 11/1998 | Subramaniam et al. | 264/7 |
| 5,874,029 | * | 2/1999 | Subramaniam et al. | 264/12 |

OTHER PUBLICATIONS

Cobbs, W. et al., "High Solids Coatings Above 80% by Volume", presented at the Water–Borne & High Solids Coatings Symposium, Mar. 10–12, 1980, New Orleans, LA.

Matson, D.W. et al., "Production of Fine Powders by the Rapid Expansion of Supercritical Fluid Solutions", Advances in Ceramic, vol. 21, pp. 109–121 (1987) (No month).

Kitamura, Y., et al., "Critical Superheat for Flashing of Superheated Liquid Jets," Ind. Eng. Chem. Fundamentals 25 :206–211 (1986) (No month).

Petersen, R.C. et al., "The Formation of Polymer Fibers From the Rapid Expansion of Supercritical Fluid Solutions" Polymer Engineering & Sciences (1987), vol. 27, No. 22, pp. 1693–1687 (No month).

Fraser, R.P., et al., "Liquid Atomisation in Chemical Engineering: Part 3. Pressure Nozzles", British Chemical Engineering, pp. 536–543, Oct. 1957.

Blevins, Robert D. "Applied Field Dynamics Handbook"; Chapter 1(p. 1): Definitions; Chapter 7 (pp. 124–127): Nozzles, Diffusers, and Venturis, Published by Van Nostrand Reinhold Company, 1984. (No month).

Ruiz, Francisco, et al., "Parametric Experiments on Liquid Jet Atomization Spray Angle", Published by Hemisphere Publishing Corporation, vol. 1, pp. 23–27, 1991. (No month).

Nordson, "Airless Nozzles and Accessories", Published by Nordson corporation, pp. 1–1, 1–2, 1–7, 1–9, 1–35, 1989. (No month).

Weast, R.C., et al., "Handbook of Chemistry and Physics: A Ready–Reference Book of Chemical and Physical Data", Published by The Chemical Rubber Co., p E–29. (No date).

* cited by examiner

METHOD FOR THE SPRAY APPLICATION OF POLYMERIC-CONTAINING LIQUID COATING COMPOSITIONS USING SUBCRITICAL COMPRESSED FLUIDS UNDER CHOKED FLOW SPRAYING CONDITIONS

This application is a continuation-in-part application of U.S. Ser. No. 08/234,573, filed Apr. 24, 1994, now abandoned; which in turn is a continuation of application Ser. No. 07/991,479, filed Dec. 16, 1992, now abandoned; which in turn is a continuation application of Ser. No. 07/631,680, filed Dec. 21, 1990, now abandoned.

FIELD OF THE INVENTION

This invention, in general, pertains to the field of spraying polymeric coating compositions with reduced emissions of volatile organic solvent. More specifically, the present invention relates to the use of subcritical compressed fluids, such as subcritical compressed carbon dioxide or ethane, to reduce viscosity and to enhance atomization when spray applying coating compositions to substrates.

BACKGROUND OF THE INVENTION

Prior to the use of supercritical fluids, such as supercritical carbon dioxide, to replace volatile solvents that cause air pollution, the liquid spray application of coatings, such as paints, lacquers, enamels, and varnishes, was effected through the use of organic solvents as viscosity reduction diluents. However, because of increased environmental concern, efforts have been directed to reducing the pollution resulting from coating operations.

While the utilization of supercritical fluids as viscosity reducing diluents in coating applications has met with much success and is effectively able to accomplish the primary objective of reducing the emission of volatile organic compounds into the atmosphere while simultaneously providing the stringent performance characteristics of the applied coating that is required by the coatings industry, a desire has nevertheless arisen to determine whether such viscosity reducing diluent effects can be obtained with suitable materials at conditions which are below the supercritical fluid state, i.e., with subcritical compressed fluids. In particular, this desire has been generated by the realization that there are coating materials which may contain components that are highly temperature sensitive, such as highly reactive cross-linking coating systems and two-package coating systems that are employed in high-solids coatings. As such, it may be undesirable to subject such components to the temperatures required to keep the viscosity reducing supercritical fluid in its supercritical state. By spraying at significantly lower temperature, it may be possible to spray a two-package coating using a conventional single-feed coating system instead of having to feed the two reactive components separately as required at elevated spray temperatures. In cross-linking coating systems, the undesirable increase in spray viscosity that results from premature reaction in the heated spray equipment can therefore be avoided or minimized.

Furthermore, it is common for sprays with supercritical fluids to be heated to relatively high temperatures, typically 50 to 60 C. or higher, to offset the cooling effect that occurs as the supercritical fluid expands from the spray as a free gas. This requires either the use of a circulating flow of the heated spray mixture, which is undesirable for spray operations that use color change or highly reactive coating systems, due to increased volume and residence time, or the use of a specially heated and thermostated spray gun and feed line in order to maintain the proper spray temperature at all times including at start-up. This increases the amount of equipment that must be operated and maintained in the spray operation, which increases equipment and labor costs and makes the operation more susceptible to interruptions due to equipment failure or loss of temperature control.

So too, generally depending on the particular coating composition to be sprayed, at the typically higher pressures needed to maintain the viscosity reducing supercritical fluid in its supercritical state, i.e., above its critical pressure, and at the typically still higher pressures required to obtain high solubility of the supercritical fluid at the elevated temperatures, more wear and tear may be experienced on the spray coating equipment, particularly the spray gun nozzle tips. Moreover, there is a general desire, particularly for safety reasons, to work with a process at a pressure which is as low as possible while still realizing the overall benefits of such a process.

Lower pressures also produce a lower velocity spray, which is advantageous for obtaining higher transfer efficiency in depositing the coating composition onto a substrate and in particular for making electrostatic deposition more effective. Lower spray velocity can also improve coating quality by reducing the amount of fine air bubbles that become entrapped in the liquid coating as the spray strikes the substrate, which may cause undesirable haze to occur in clear coatings and may promote solvent popping during baking. Lower pressures also make it possible to obtain lower spray application rates without having to use extremely small orifice sizes that are susceptible to becoming plugged and are difficult to manufacture. There is also a general desire to spray at the lower pressures at which air-assisted airless spraying is practiced, which are generally below supercritical fluid pressures.

SUMMARY OF THE INVENTION

By virtue of the present invention, the above needs have now been met. Processes have now been discovered which are able to provide a viscosity reducing effect and enhanced atomization of coating compositions by using a suitable environmentally acceptable material to replace volatile organic solvents while simultaneously reducing the pressure and/or temperature needed to achieve such a viscosity reducing diluent effect.

The present invention provides processes for spraying a liquid coating composition comprising polymeric compounds to form a coating on a substrate. In general, the processes comprise the steps of:

(1) forming a liquid mixture in a closed pressurized system, said liquid mixture containing a coating composition and a subcritical compressed fluid, wherein (a) the coating composition contains at least one polymeric compound having a number average molecular weight ($M_n$) of less than about 5,000 and (b) the subcritical compressed fluid is miscible with and forms a liquid mixture with said coating composition and is present in the liquid mixture in an amount which renders the viscosity of said liquid mixture suitable for spraying and being capable of forming a choked flow when sprayed, and wherein said subcritical compressed fluid is a gas at standard conditions of 0° C. temperature and one atmosphere pressure (STP);

(2) spraying said liquid mixture by passing the liquid mixture through an orifice in a spray tip at a temperature and pressure that produces choked flow of the liquid mixture being sprayed which forms the spray; and (3) applying said spray containing said coating composition to said substrate to form a coating thereon.

As used herein, it will be understood that a "supercritical fluid" is a material which is at a temperature and pressure such that the material is at, above, or slightly below its "critical point". As used herein, the "critical point" of a material is the transition point at which the liquid and gaseous states of that material merge into each other and represents the combination of the critical temperature and critical pressure for that material. The "critical temperature", as used herein, is defined as the temperature above which a gas cannot be liquified by an increase in pressure. The "critical pressure", as used herein, is defined as that pressure which is just sufficient to cause the appearance of two phases at the critical temperature.

Also as used herein, it will be understood that a "subcritical fluid" is a material which is at a temperature and/or pressure such that the material is below the temperature and pressure conditions at which the material achieves a supercritical fluid state. Such a subcritical fluid may be (i) at a temperature below at which the material achieves a supercritical fluid state while being at a pressure above at which the material achieves a supercritical fluid state, or (ii) at a pressure below at which the material achieves a supercritical fluid state while being at a temperature above at which the material achieves a supercritical fluid state, or (iii) at a temperature below at which the material achieves a supercritical fluid state and at a pressure below at which the material achieves a supercritical fluid state.

As used herein, a "subcritical compressed fluid" or "compressed fluid" is a subcritical fluid which may be in a gaseous state, a liquid state, or a combination thereof depending upon the particular temperature and pressure to which it is subjected when admixed with the composition which is to have its viscosity reduced, but which is in its gaseous state at standard conditions of 0° C. temperature and one atmosphere pressure (STP), and which is miscible with said composition at said temperature and pressure. As used herein, "miscible" is understood to mean that the subcritical compressed fluid has a solubility in a composition of at least about 10% by weight, preferably above about 15%, and more preferably above about 20%.

In particular, we have discovered that subcritical compressed fluids may be utilized as viscosity reducing diluents and as atomization enhancing agents for polymeric coating compositions provided that such compositions contain one or more polymeric compounds which have a number-average molecular weight of less than about 5,000. We have further discovered that the coating compositions may also contain one or more polymeric compounds having higher number-average molecular weights provided that at least 75 weight percent of the total weight of all polymeric compounds has a weight-average molecular weight of less than about 20,000. Our attempts to spray liquid mixtures using subcritical compressed fluids were generally unsuccessful until we discovered that the molecular weight of the polymers present in the compositions was a critical parameter, as will be discussed more fully below.

We have also surprisingly discovered that enhanced atomization of the viscous polymeric coating compositions can be obtained when they are sprayed with subcritical compressed fluid by using conditions of amount of subcritical compressed fluid and inlet spray temperature and pressure that produce choked flow within the spray tip of the liquid mixture being sprayed, as will be discussed more fully below. The choked flow state more effectively transmits atomization energy to the coating composition, which produces finer atomization of the viscous composition and applies a higher quality coating to the substrate.

Also as used herein, the phrases "coating composition" and "coating formulation" are understood to mean conventional coating formulations that have no subcritical compressed fluid admixed therewith. Also as used herein, the phrases "liquid mixture", "spray mixture", and "admixed coating composition" are meant to include an admixture of a coating composition or coating formulation with at least one subcritical compressed fluid.

It is understood, of course, that the term "coating composition" is not limited to coatings that are only used to protect and/or enhance the appearance of a substrate or which is decorative, such as paints, lacquers, enamels, and varnishes. Indeed, the coating composition may provide a coating which acts as an adhesive, or which is a release agent; a lubricant; a cleaning agent; or the like. Such coating compositions may also include those that are typically utilized in the agricultural field in which fertilizers, weed killing agents, and the like, are dispensed. Such coating compositions may also include those that are used to coat agricultural products such as fruits and vegetables or to coat pharmaceutical or medicinal products such as pills and tablets. The specific nature of the coating composition is not critical to the present invention provided that it can be admixed with the subcritical compressed fluid and then be sprayed.

In a more preferred embodiment, the above noted process also includes the presence of an active solvent in the coating composition so as to aid in the reduction of the viscosity and therefore does not require the use of liquid polymers. Polymers other than liquid polymers may also be utilized.

Although clearly applicable to the application of any coating composition, the present invention is particularly useful in the application of high-solids coatings. Coating formulators and applicators face the difficult task of further reducing organic solvent emissions from spray operations while maintaining the advantages of organic solvent-borne coatings, namely, superior appearance, performance, convenience, and economics. Over the years, solvent emissions have been reduced by formulating coatings with less organic solvent and consequently higher solids levels. This has been accomplished by (1) decreasing polymer molecular weights to maintain low viscosity for spraying and (2) increasing polymer reactive functionality to obtain a solid coating after application. However, this technique has generally approached the limit to which the solid levels can be increased without coating quality deteriorating further and becoming unacceptable. High-solids coatings generally have problems of running and sagging, cratering and pin holing, poor shelf and pot life, and cross-linking that is slow or requires high temperatures, all due to the use of very low molecular weight polymers.

By means of the present invention, the use of subcritical compressed fluids in the manner described herein can replace the fast solvents of the high-solids coatings while retaining the benefits of organic solvent-borne coatings. Thus, high quality coatings can be reformulated with even higher solids levels, attaining viscosities in the range of from about 500 to about 4,000 cps. (All viscosities referred to herein have been measured at a standard temperature and pressure of 25° C. and one atmosphere pressure, unless noted otherwise.) For high-solids coatings that already meet volatile organic compound regulatory requirements, replacing the fast solvents with the subcritical fluids allows the high-solids coatings to be reformulated with a correspondingly higher content of slow, coalescing solvents. Consequently, the molecular weights of the polymeric components may be increased to regain more of the advantages of organic solvent-borne coatings, i.e., better appearance, performance, and pot life, and shorter cure times at lower temperatures.

DETAILED DESCRIPTION OF THE INVENTION

Figure 1:
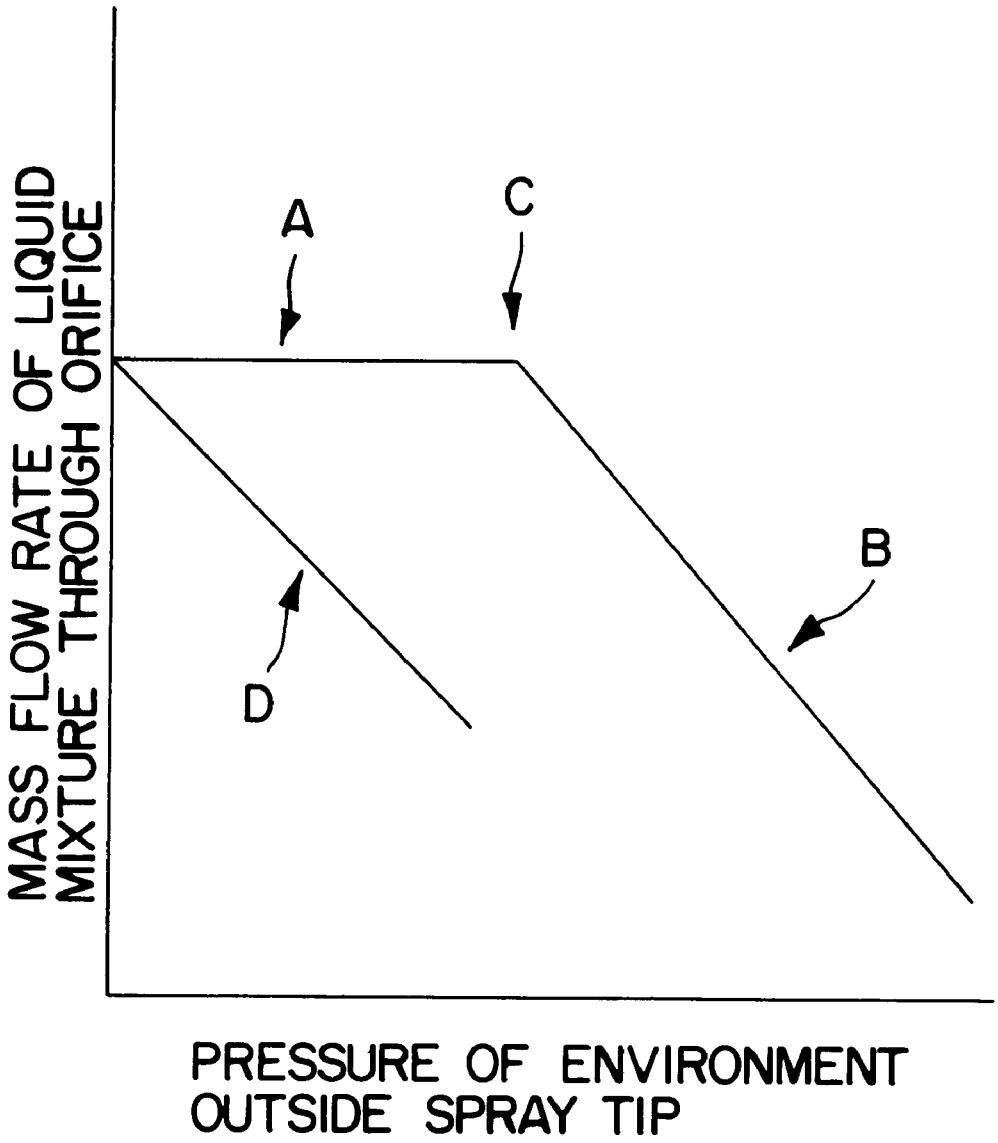
FIG. 1 is a diagram comparing how mass flow rate through a spray orifice varies with pressure of the spray environment outside of the spray tip for cases of choked flow and non-choked flow.

The present invention is not narrowly critical to the type of coating composition that can be sprayed provided that there is less than about 30% by weight, preferably less than about 20% by weight of water in the solvent fraction (as herein later defined) of the composition and also provided that the molecular weight of the polymeric constituents present in the coating composition be within a particular range, which was briefly discussed earlier. Thus, essentially any coating composition meeting the aforementioned water limit requirement and which also contains the molecular weight requirements of its polymeric components may also be sprayed by means of the preferred embodiments of the present invention.

Generally, such coating compositions typically include a solids fraction containing at least one component which is capable of forming a coating on a substrate, whether such component is an adhesive, a paint, lacquer, varnish, mold release agent, chemical agent, lubricant, protective oil, non-aqueous detergent, or the like. Typically, at least one component is a polymeric component which is well known to those skilled in the coatings art.

The materials used in the solids fraction of the present invention, such as the polymers, generally must be able to withstand the temperatures and/or pressures which are involved when they are ultimately admixed with the at least one subcritical compressed fluid. Such applicable polymers include thermoplastic or thermosetting materials or may be crosslinkable film forming systems.

In particular, the polymeric components include vinyl, acrylic, styrenic, and interpolymers of the base vinyl, acrylic, and styrenic monomers; polyesters, oil-free alkyds, alkyds, and the like; polyurethanes, two-package polyurethane, oil-modified polyurethanes and thermoplastic urethanes systems; epoxy systems; phenolic systems; cellulosic esters such as acetate butyrate, acetate propionate, and nitrocellulose; amino resins such as urea formaldehyde, melamine formaldehyde, and other aminoplast polymers and resins materials; natural gums and resins; rubber-based adhesives including nitrile rubbers which are copolymers of unsaturated nitrites with dienes, styrene-butadiene rubbers, thermoplastic rubbers, neoprene or polychloroprene rubbers, and the like.

In addition to the polymeric compounds that may be contained in the solids fraction, conventional additives which are typically utilized in coatings may also be used. For example, pigments, pigment extenders, metallic flakes, fillers, drying agents, anti-foaming agents, and anti-skinning agents, wetting agents, ultraviolet absorbers, cross-linking agents, and mixtures thereof, may all be utilized in the coating compositions to be sprayed by the methods of the present invention.

In addition to the solids fraction, a solvent fraction is also typically employed in the coating compositions whether they be an adhesive composition or a paint, lacquer, varnish, or the like, or an agricultural spray. As used herein, the solvent fraction is comprised of essentially any active organic solvent and/or non-aqueous diluent which is at least partially miscible with the solids fraction so as to form either a solution, dispersion, or suspension. As used herein, an "active solvent" is a solvent in which the solids fraction is at least partially soluble. The selection of a particular solvent fraction for a given solids fraction in order to form a specific coating formulation for application by spray techniques is conventional and well known to those skilled in the art. In general, up to about 30% by weight of water, preferably up to about 20% by weight, may also be present in the solvent fraction provided that a coupling solvent is also present in the formulation. All such solvent fractions are suitable in the present invention.

A coupling solvent is a solvent in which the polymeric compounds used in the solids fraction is at least partially soluble. Most importantly, however, such a coupling solvent is also at least partially miscible with water. Thus, the coupling solvent enables the miscibility of the solids fraction, the solvent fraction and the water to the extent that a single phase is desirably maintained such that the composition may optimally be sprayed and a good coating formed.

Coupling solvents are well known to those skilled in the art and any conventional coupling solvents which are able to meet the aforementioned characteristics, namely, those in which the polymeric components of the solid fraction is at least partially soluble and in which water is at least partially miscible are all suitable for being used in the present invention.

Applicable coupling solvents which may be used in the present invention include, but are not limited to, ethylene glycol ethers; propylene glycol ethers; chemical and physical combinations thereof; lactams; cyclic ureas; and the like. Specific coupling solvents (which are listed in order of most effectiveness to least effectiveness) include butoxy ethanol, propoxy ethanol, hexoxy ethanol, isopropoxy 2-propanol, butoxy 2-propanol, propoxy 2-propanol, tertiary butoxy 2-propanol, ethoxy ethanol, butoxy ethoxy ethanol, propoxy ethoxy ethanol, hexoxy ethoxy ethanol, methoxy ethanol, methoxy 2-propanol, and ethoxy ethoxy ethanol. Also included are lactams such as n-methyl-2-pyrrolidone, and cyclic ureas such as dimethyl ethylene urea.

When water is not present in the coating formulation, a coupling solvent is not necessary, but may still be employed. Other solvents, particularly active solvents, which may be present in typical coating formulations and which may be utilized in the present invention include ketones such as acetone, methyl ethyl ketone, methyl isobutyl ketone, mesityl oxide, methyl amyl ketone, cyclohexanone and other aliphatic ketones; esters such as methyl acetate, ethyl acetate, alkyl carboxylic esters; ethers, such as methyl t-butyl ether, dibutyl ether, methyl phenyl ether and other aliphatic or alkyl aromatic ethers; glycol ethers such as ethoxy ethanol, butoxy ethanol, ethoxy 2-propanol, propoxy ethanol, butoxy 2-propanol and other glycol ethers; glycol ether esters such as butoxy ethoxy acetate, ethyl 3-ethoxy propionate and other glycol ether esters; alcohols such as methanol, ethanol, propanol, iso-propanol, butanol, isobutanol, amyl alcohol and other aliphatic alcohols; aromatic hydrocarbons such as toluene, xylene, and other aromatics or mixtures of aromatic solvents; aliphatic hydrocarbons such as VM&P naphtha and mineral spirits, and other aliphatics or mixtures of aliphatics; nitro alkanes such as 2-nitropropane.

Of course, there are solvents which can function both as coupling solvents as well as active solvents and the one solvent may be used to accomplish both purposes. Such solvents include, for example, butoxy ethanol, propoxy ethanol and propoxy 2-propanol. Glycol ethers are particularly preferred.

Suitable additives that are conventionally present in coating formulations that are intended for spray application may also be present in this invention, such as, curing agents, plasticizers, surfactants, and the like.

Examples of compounds which may be used as the subcritical compressed fluids are given in Table 1.

TABLE 1

EXAMPLES OF SUBCRITICAL COMPRESSED FLUIDS

| Compound | Boiling Point C. | Critical Temperature C. | Critical Pressure (atm) | Critical Density (g/ml) |
|---|---|---|---|---|
| Carbon Dioxide | −78.5 | 31.3 | 72.9 | 0.448 |
| Nitrous Oxide | −88.56 | 36.5 | 71.7 | 0.45 |
| Ammonia | −33.35 | 132.4 | 112.5 | 0.235 |
| Xenon | −108.2 | 16.6 | 57.6 | 0.118 |
| Ethane | −88.63 | 32.28 | 48.1 | 0.203 |
| Propane | −42.1 | 96.67 | 41.9 | 0.217 |

TABLE 1-continued

EXAMPLES OF SUBCRITICAL COMPRESSED FLUIDS

| Compound | Boiling Point C. | Critical Temperature C. | Critical Pressure (atm) | Critical Density (g/ml) |
|---|---|---|---|---|
| Chlorotrifluoroethane | −31.2 | 28.0 | 38.7 | 0.579 |
| Monofluoromethane | −78.4 | 44.6 | 58.0 | 0.3 |

Preferably, the subcritical compressed fluid has a critical temperature above the ambient temperature of the spray environment and has appreciable solubility in the coating composition. Moreover, the subcritical compressed fluid is preferably environmentally compatible, can be made environmentally compatible by treatment, or can be readily recovered from the spray environment. The utility of any of the above-mentioned compounds as subcritical compressed fluids and viscosity reducing diluents in the practice of the present invention will depend upon the polymeric compound(s) and the specific solvent fraction used taking into account the temperature and pressure of application and the inertness of the subcritical compressed fluid with the remaining constituents of the coating composition.

Due to their environmental compatibility, low toxicity, favorable physical properties at ambient temperature, and high solubility in coating compositions, subcritical compressed carbon dioxide and ethane are preferably used in the practice of the present invention. Due to its low cost, non-flammability, and wide availability, subcritical compressed carbon dioxide is most preferred. However, use of any of the aforementioned compounds and mixtures thereof are to be considered within the scope of the present invention.

One of the more important discoveries made during the development of processes for the spray application of coatings using supercritical fluids was that supercritical fluids not only function as a viscosity reducer, but that they can also produce vigorous decompressive atomization by a new airless spray atomization mechanism. This greatly improves the airless spray process so that high quality coatings can be applied. We have discovered that subcritical compressed fluids also can produce such decompressive atomization as well. Furthermore, we have surprisingly discovered, as will be discussed more fully below, that conditions that produce choked flow within the spray tip of the liquid mixture being sprayed further enhance atomization of viscous coating compositions.

Airless spray techniques use a high pressure drop across the spray orifice to propel the coating formulation through the orifice at high velocity. The conventional atomization mechanism is well known. The coating exits the orifice as a liquid film that becomes unstable from shear induced by its high velocity relative to the surrounding air. Waves grow in the liquid film, become unstable, and break up into liquid filaments that likewise become unstable and break up into droplets. Atomization occurs because cohesion and surface tension forces, which hold the liquid together, are overcome by shear and fluid inertia forces, which break it apart. As used herein, "liquid-film atomization" and "liquid-film spray" refers to a spray, spray fan, or spray pattern in which atomization occurs by this conventional mechanism from a liquid film that extends wholly or partly from the spray orifice. In liquid-film atomization, however, the cohesion and surface tension forces are not entirely overcome and they profoundly affect the spray, particularly for viscous coating formulations. Conventional airless spray techniques are known to produce coarse droplets and defective spray fans that limit their usefulness to applying low-quality coating films. Higher viscosity increases the viscous losses that occur within the spray orifice, which lessens the energy available for atomization, and it decreases shear intensity, which hinders the development of natural instabilities in the expanding liquid film. This delays atomization so that large droplets are formed. The spray also characteristically forms a "tailing" or "fishtail" spray pattern (discussed later), which makes it difficult to apply a uniform coating.

In the spray application of coatings using supercritical fluids, the large concentration of dissolved supercritical fluid produces a liquid spray mixture with markedly different properties from conventional coating compositions. In particular, the mixture of coating composition and supercritical fluid produces a liquid spray mixture that is highly compressible, that is, the density changes markedly with changes in pressure, whereas conventional coating compositions are incompressible liquids when they are sprayed. Without wishing to be bound by theory, it is believed that vigorous decompressive atomization can be produced by the dissolved supercritical fluid such as supercritical carbon dioxide suddenly becoming exceedingly supersaturated as the spray mixture leaves the nozzle and experiences a sudden and large drop in pressure. This creates a very large driving force for gasification of the carbon dioxide, which overwhelms the cohesion, surface tension, and viscous forces that oppose atomization and normally bind the fluid flow together into a fishtail type of spray. A different atomization mechanism is evident because atomization occurs right at the spray orifice instead of away from it as is conventional. Atomization is believed to be due not to break-up of a liquid film from shear with the surrounding air but instead to the expansive forces of the compressible spray solution created by the large concentration of dissolved supercritical fluid. Therefore, no liquid film is visible coming out of the nozzle. Furthermore, because the spray is no longer bound by cohesion and surface tension forces, it leaves the nozzle at a much wider angle than normal airless sprays and produces a "feathered" spray (discussed later) with tapered edges like an air spray. This can produce a rounded parabolic-shaped spray fan instead of the sharp angular fans typical of conventional airless sprays. The spray also typically has a much wider fan width than conventional airless sprays produced by the same spray tip. As used herein, "decompressive atomization" and "decompressive spray" refers to a spray, spray fan, or spray pattern that has the preceding characteristics. Laser light scattering measurements and comparative spray tests show that this decompressive atomization can produce fine droplets that are in the same size range as air spray systems (20 to 50 microns) instead of the coarse droplets produced by normal airless sprays (70 to 150 microns). For a properly formulated coating composition, the droplet size range and distribution are ideal for minimizing orange peel and other surface defects commonly associated with spray application. This fine particle size provides ample surface area for the dissolved supercritical fluid to very rapidly diffuse from the droplets within a short distance from the spray nozzle. Therefore, the coating is essentially free of the supercritical fluid before it is deposited onto the substrate.

Experience with the spray application of coating compositions using supercritical fluids and known differences between supercritical fluids and subcritical compressed fluids provided many reasons for one skilled in the art to believe that using subcritical compressed fluids as viscosity reducers to spray apply coating compositions would not be possible and would not be an effective method of reducing organic solvent usage:

Firstly, it was believed that sufficient viscosity reduction to obtain the required low spray viscosity would not be possible for several reasons. Conventional coating compositions have a very low spray application viscosity. Even conventional high-solids coatings have a low spray application viscosity, typically 80 centipoise for clear coats and 35 centipoise for base coats. But coating compositions applied by using supercritical fluids have very high viscosities, typically ranging from 500 to 3000 centipoise, because much if not most of the organic solvent has been eliminated and replaced by the supercritical fluid to obtain viscosity reduction for spraying. To be effective at eliminating organic solvents, coating compositions sprayed with subcritical fluids would have the same high viscosities. But in the heated sprays typically used with supercritical fluids, some of the viscosity reduction is due to the increased temperature. For example, an acrylic coating composition that has a viscosity of 1000 centipoise at the ambient temperature of 25 C. has a viscosity of 300 centipoise when heated to a spray temperature of 50 C. Adding supercritical carbon dioxide to a concentration of 28% by weight, which is near the solubility limit, reduces the viscosity to 30 centipoise for spraying. Therefore, whereas the supercritical carbon dioxide need only reduce the viscosity from 300 to 30 centipoise, subcritical carbon dioxide at the ambient temperature would have to reduce the viscosity from 1000 to 30 centipoise for spraying, a three-fold larger reduction. The reduction in viscosity that occurs from heating the coating composition is lost at subcritical temperatures. Furthermore, because of the lower, subcritical pressure, subcritical carbon dioxide would be expected to have lower solubility by one skilled in the art; therefore the higher solubility that would be needed to obtain the much greater reduction in viscosity would not be possible. This would necessitate using much more organic solvent to obtain a low spray viscosity, which is contrary to the need to significantly reduce organic solvent usage.

Secondly, one of the main reasons that supercritical fluids are used in some applications instead of subcritical fluids is the well known fact that supercritical fluids are highly compressible. Therefore, it would be believed by those skilled in the art that using much less compressible subcritical fluids as a viscosity reducer would produce a spray mixture with much less compressibility. This would be compounded by the lower solubility at lower pressure. In addition, the lower subcritical spray temperature would significantly reduce the degree of supersaturation achieved when the spray mixture is sprayed, which reduces the driving force for gasification of the subcritical fluid. Hence, those skilled in the art would believe that the decompressive expansive force would be insufficient to obtain the vigorous atomization needed for fine droplet size and high quality coatings. Poor atomization with large droplets would significantly increase the time required for the subcritical fluid to diffuse and escape from solution in the droplets. This would be compounded by lower diffusivity at lower temperature. Therefore, a coating would be deposited that was foamy or full of bubbles formed from the subcritical fluid that remained dissolved in the coating composition.

Thirdly, when supercritical fluids are used, the spray mixture can be heated to a temperature that counteracts the large cooling effect caused by rapid expansion of the supercritical fluid as free gas from the spray. This is necessary to keep the spray from cooling significantly to below ambient temperature. Typically, this requires a temperature of from about 50 to 60 C. However, when spraying at ambient or near ambient temperatures, the large cooling effect is not counteracted and the spray would therefore cool quickly to a very low temperature. This is undesirable because it could cause moisture condensation and would deposit very cold and very viscous droplets on the substrate that would be unable to coalesce and flow to form a smooth coherent high quality coating.

The first spray experiments we made using subcritical fluids as viscosity reducing diluents appeared to confirm these expectations. Numerous attempts to spray apply several different coating compositions, which were successfully sprayed using supercritical carbon dioxide at high temperature (50–60 C.) and high pressure (1500–1700 psi), by using subcritical compressed carbon dioxide at ambient temperatures and low pressures (800–1000 psi) failed to produce useable sprays and useable coatings. In fact, the coatings were worse with subcritical carbon dioxide than if the viscous coating compositions were sprayed with no subcritical carbon dioxide added as a viscosity reducer. These attempts all resulted in fishtail liquid-film sprays being produced, and decompressive atomization or feathered sprays were not obtained. These sprays deposited a thick layer of foam on the substrate when a thin coherent bubble-free smooth coating was desired. The measured temperature profile of the spray produced using an acrylic coating composition with an ambient viscosity of 1000 centipoise (discussed earlier) is shown in FIG. 8. This showed that most of the subcritical carbon dioxide had already diffused from the liquid film before atomization occurred about one-half inch from the orifice. The liquid film was rapidly cooled by this loss of dissolved carbon dioxide to a temperature that was 36 degrees C. below ambient temperature. Therefore, atomization occurred under very unfavorable conditions. Not only was there little viscosity reduction by the subcritical carbon dioxide, which had already diffused from the liquid film, but the liquid film was at a very low temperature, which substantially increased the viscosity of the coating composition. Therefore, instead of reducing the viscosity to a very low level, the subcritical carbon dioxide increased the viscosity to a higher level when atomization occurred. This produced very poor atomization and large droplet sizes that were too large and too cold for the remaining carbon dioxide to diffuse from the droplets. This remaining carbon dioxide produced a layer of foam instead of a smooth coating on the substrate. Furthermore, the large droplets had too much thermal mass to be warmed appreciably by entrainment of surrounding ambient air into the spray. The layer of foam was deposited with a temperature that was twelve degrees C. below ambient temperature. Therefore, the deposited coating composition was much more viscous than if it had been deposited at ambient temperature, which hindered coalescence and flow out of the coating. Adding organic solvent to decrease the viscosity of the coating composition did not change the very poor liquid-film spray into an improved decompressive spray as was desired. Instead, the layer of foam more readily ran off of the substrate.

Figure 8:
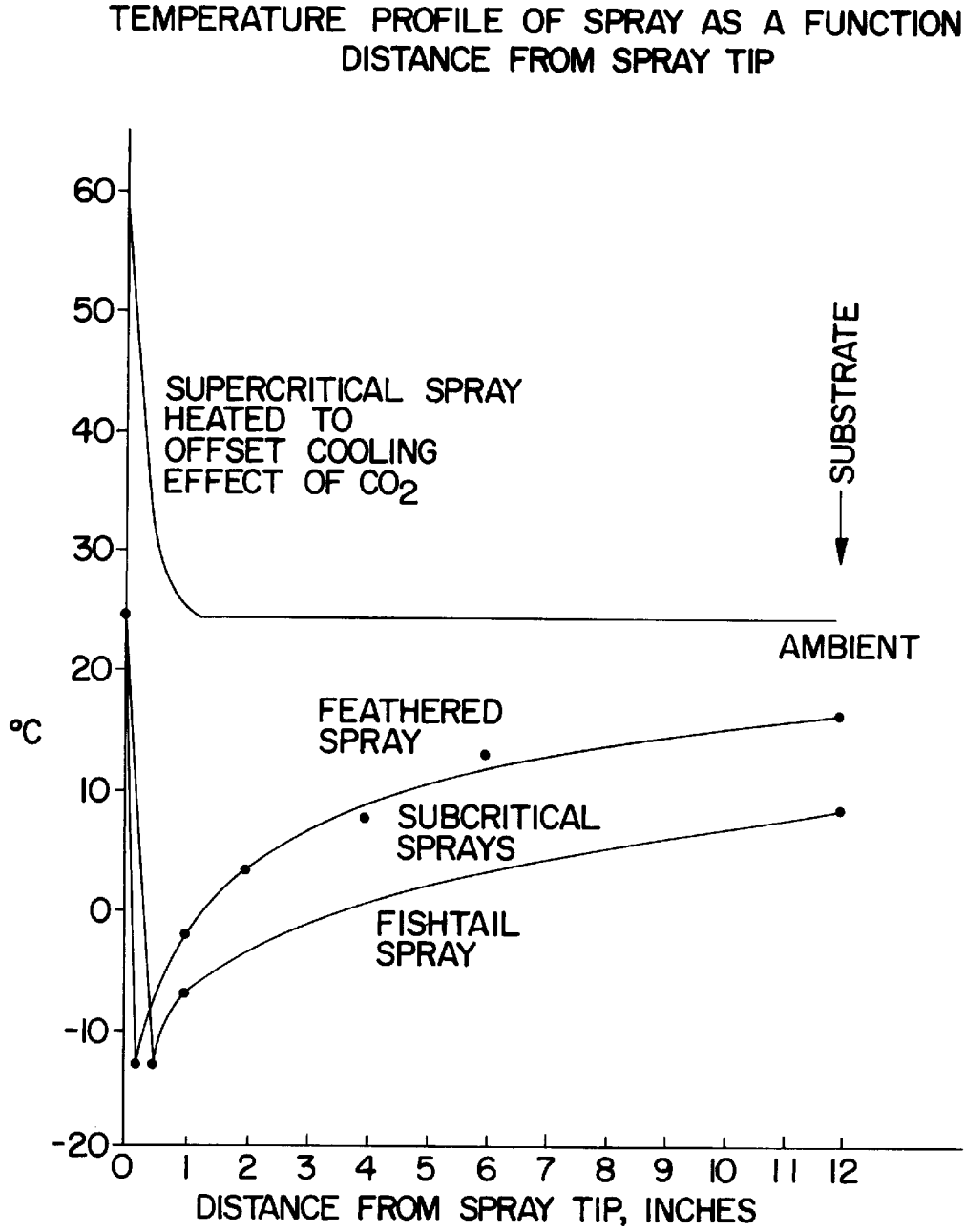
FIG. 8 is a diagram comparing temperature profiles of sprays produced using supercritical carbon dioxide with sprays produced using subcritical compressed carbon dioxide with a feathered spray or with a fishtail liquid-film spray.

In contrast, FIG. 8 shows the measured temperature profile for the same coating composition sprayed with the same concentration of supercritical carbon dioxide as the viscosity reducer, with the spray mixture heated to 60 C. to offset the cooling effect of the carbon dioxide escaping from the spray. This produced a spray that cooled to ambient temperature within one inch of the orifice, without subcooling below ambient temperature. The decompressive spray produced a thin coherent bubble-free high quality coating as desired.

It was not until after further spray attempts were made that we discovered that subcritical compressed fluids such as subcritical carbon dioxide can be successfully used as viscosity reducers and atomization enhancers to apply high quality coatings provided the coating composition has favorable properties. In particular, it was discovered that it is necessary that the coating composition (1) contains primarily polymer components that have a sufficiently low number-average molecular weight and (2) contains a relatively low amount of polymer components that have high weight-average molecular weight. Other properties were also discovered to be desirably present, as will be discussed later.

Without wishing to be bound by theory, it is believed that the primary requirement for spraying coating compositions with subcritical compressed fluids is that the spray mixture formed must have sufficiently low cohesiveness and related properties such as elasticity, viscosity, and surface tension, all of which serve to bind the liquid spray mixture together and which oppose atomization, to compensate for the reduced compressibility and reduced supersaturation driving force for gasification that results from using a subcritical compressed fluid instead of a supercritical fluid as the viscosity reducer. That is, the cohesion, elastic, surface tension, and viscosity forces in the composition should desirably be sufficiently low to be overcome by the reduced expansive force of the subcritical compressed fluid in order to produce vigorous atomization that produces high quality coatings.

Vigorous decompressive atomization is preferred, but we have also discovered that liquid-film atomization can occur and produce acceptable coatings with subcritical compressed fluids if the coating composition contains sufficiently low molecular weight polymers and has sufficiently low viscosity. Without wishing to be bound by theory, it is believed that acceptable liquid-film atomization can occur with subcritical compressed fluids in situations where the driving force for gasification of the subcritical compressed fluid produces great instability in the liquid film, so that atomization occurs within a relatively short distance from the spray orifice. Although this is believed to produce larger droplet size, a low viscosity coating composition is able to compensate for this by more readily venting the subcritical compressed fluid from the deposited coating.

High molecular weight polymers are undesirable for atomization because the higher the molecular weight of the polymer, the longer the polymer chains are. Therefore, each individual polymer chain is able to interact with a much greater number of other chains by such physical means as chain entanglement or such chemical means as hydrogen bonding or other associations between constituent groups on the polymer chain. Furthermore, long polymer chains are able to more readily interact with themselves and form configurations that make the chain more rigid and less able to yield under stress. These interactions lead to an extended network of associated chains that greatly increases the cohesiveness of the spray mixture. These interactions also greatly increase viscosity, so that stresses are readily dissipated and do not propagate far. Long polymer chains also create viscoelastic forces, that is, restorative forces that act like springs to return the polymer chain and thereby the extended network to its original conformation after stress is reduced. The high expansive force of supercritical fluids is able to overcome these opposing forces but the weaker expansive force of subcritical fluids is less able to do so.

In contrast, low molecular weight polymers are more desirable for atomization because they have short polymer chains. Hence, each chain interacts with just a small number of other chains. The network of associated chains is localized and easily disrupted. The chains interact less with themselves and are therefore more flexible. Viscosity is relatively low, so stresses do not dissipate and they propagate farther. Viscoelastic forces are weak or absent. Therefore, the weaker expansive force of subcritical fluids is better able to overcome these weaker opposing forces and produce vigorous atomization.

Polymers typically have a distribution of molecular weights, which are generally characterized by two measures: the number-average molecular weight and the weight-average molecular weight. Letting $W_i$ be the weight fraction "i" in the distribution with molecular weight $M_i$, the number-average molecular weight $M_n$ can be calculated from the formula:

$$M_n = [Sum_i\ W_i] / [Sum_i\ (W_i / M_i)] \quad \text{(I)}$$
$$= 1 / [Sum_i\ (W_i / M_i)]$$

and the weight-average molecular weight $M_w$ can be calculated from the formula:

$$M_w = [Sum_i\ W_i M_i] / [Sum_i\ W_i] \quad \text{(II)}$$
$$= Sum_i\ W_i M_i$$

where the summations are over all weight fractions "i" in the distribution. The number-average molecular weight $M_n$ is influenced more by the low-molecular-weight end of the distribution and the weight-average molecular weight $M_w$ is influenced more by the high-molecular-weight end of the distribution. Therefore, the ratio $M_w/M_n$ is a measure of the span of the distribution.

We have discovered that the number-average molecular weight correlates better with good sprayability than does the weight-average molecular weight for coating compositions that consist mainly of low molecular weight polymers. Low molecular weight polymers have short polymer chains, so end groups are much more important in forming associations between chains than in high molecular weight polymers and affect cohesiveness more. The small polymer chains in the distribution also separate the long chains and minimize their entanglement and interactions, that is, the small chains reduce network formation. This is better reflected by the number-average molecular weight than by the weight-average molecular weight of the polymer.

It has also been discovered that the molecular weight of the polymer affects the solubility of supercritical fluids such as supercritical carbon dioxide, and we believe that this effect is also applicable to subcritical compressed fluids as well. With all other factors remaining constant, measurements show that carbon dioxide solubility decreases relatively rapidly with increasing molecular weight up to a weight-average molecular weight of about 15,000, and then decreases much more slowly. This indicates that carbon dioxide interacts more with low molecular weight polymers than with high molecular weight polymers, that is, when there is a relatively high concentration of polymer end groups. This suggests that carbon dioxide interacts with and hence solvates end groups better than the internal chain segments of the polymer. Therefore, carbon dioxide is more effective at preventing interactions between end groups and hence for disrupting the cohesiveness of the polymer network when the polymer has low molecular weight. This effect is also reflected better by the number-average molecular weight.

In particular, we have discovered that subcritical compressed fluids can be utilized as viscosity reducing diluents when the coating composition contains one or more polymeric compounds that have a number-average molecular weight that is less than about 5,000. Preferably, the number-average molecular weight is less than about 3,500. Most preferably, the number-average molecular weight is less than about 2,500.

We have also discovered that subcritical compressed fluids can be utilized as viscosity reducing diluents when the coating composition contains an additional one or more polymeric compounds that have higher number-average molecular weights than those noted above provided that at least 75 weight percent of the total weight of all polymeric compounds in the composition has a weight-average molecular weight of less than about 20,000. Preferably, at least 80 percent of the total weight of all polymeric compounds has a weight-average molecular weight less than about 15,000. Most preferably, at least 85 percent of the total weight of all polymeric compounds has a weight-average molecular weight of less than about 10,000. If the high-molecular-weight polymer compounds are sufficiently diluted by the low-molecular-weight polymer compounds, then extended networks are not effectively formed and do not increase cohesiveness detrimentally to atomization.

In order to provide an effective coating composition, the weight-average molecular weight of all the polymeric compounds when taken as a whole should be greater than 500. Preferably the weight-average molecular weight of all the polymeric compounds when taken as a whole should be greater than 1,000. Most preferably, the weight-average molecular weight of all the polymeric compounds when taken as a whole should be greater than 2,000.

Due to the low molecular weights of the polymer compounds, polymer systems are preferred that can be cross-linked or otherwise reacted to increase the molecular weight of the polymers after deposition in order to provide a hard coating. This includes polymer systems that are cured by heating, by using catalysts, or air dry systems that react with oxygen or react after solvent loss. Polymer systems that are used in conventional high-solids coatings and polymer systems that utilize low molecular weight cross-linking agents are also preferred. Preferred polymers are acrylics, polyesters, melamines, alkyds, epoxies, urethanes, urea formaldehydes, and vinyls and mixtures thereof. Most preferred are polymer systems having high solubility for the subcritical fluid. For mold release applications, silicone polymers are preferred, such as polydimethylsiloxane and related silicone polymers.

The use of liquid polymers having the desired molecular weight, that is, polymers which are in the liquid state at ambient temperature and pressure conditions, are also within the scope of the present invention and indeed are preferred. By combining a subcritical compressed fluid with the liquid polymer(s), the viscosity of the resulting liquid mixture is reduced to the point where it is easily sprayed. In this manner, no other solvent, such as an active solvent, is required thereby totally eliminating volatile organic solvents from the system.

In addition to the molecular weight of the one or more polymeric components contained in the composition being an important parameter for obtaining the desired viscosity reducing diluent effect when utilizing a subcritical compressed fluid such that the composition may be sprayed, if so desired, it is also preferable that the solubility of the composition with the subcritical compressed fluid as well as its viscosity also be considered.

Accordingly, it is also desirable that the coating composition have solubility characteristics which maximize the viscosity reducing effect of the subcritical compressed fluid and which provide for a desirable coating. Thus, the solubility of the subcritical compressed fluid with the composition in its subcritical compressed state and at the conditions of the substrate should desirably be optimized.

The solubility requirements for these two sets of conditions are totally antithetical to one another. Thus, when admixing the subcritical compressed fluid with the coating composition, it is desirable to have a composition which has a high solubility for the subcritical compressed fluid. In contrast, once the admixed coating composition is sprayed it is desirable that the solubility for the fluid at the conditions present in the environment of the substrate be as low as possible.

Accordingly, it is preferable that the composition containing the one or more polymeric compounds have an overall solubility with the subcritical compressed fluid at the temperature and pressure of admixture with the composition (prior to spraying) of at least 10% by weight of the subcritical compressed fluid in the liquid mixture that is formed. Preferably, the solubility should be at least about 15% by weight of the subcritical compressed fluid in the mixture, and more preferably, about 20 to 70% or greater by weight on the same basis. Most preferably, it is in the range of from about 25% to about 50% by weight.

Figure 9:
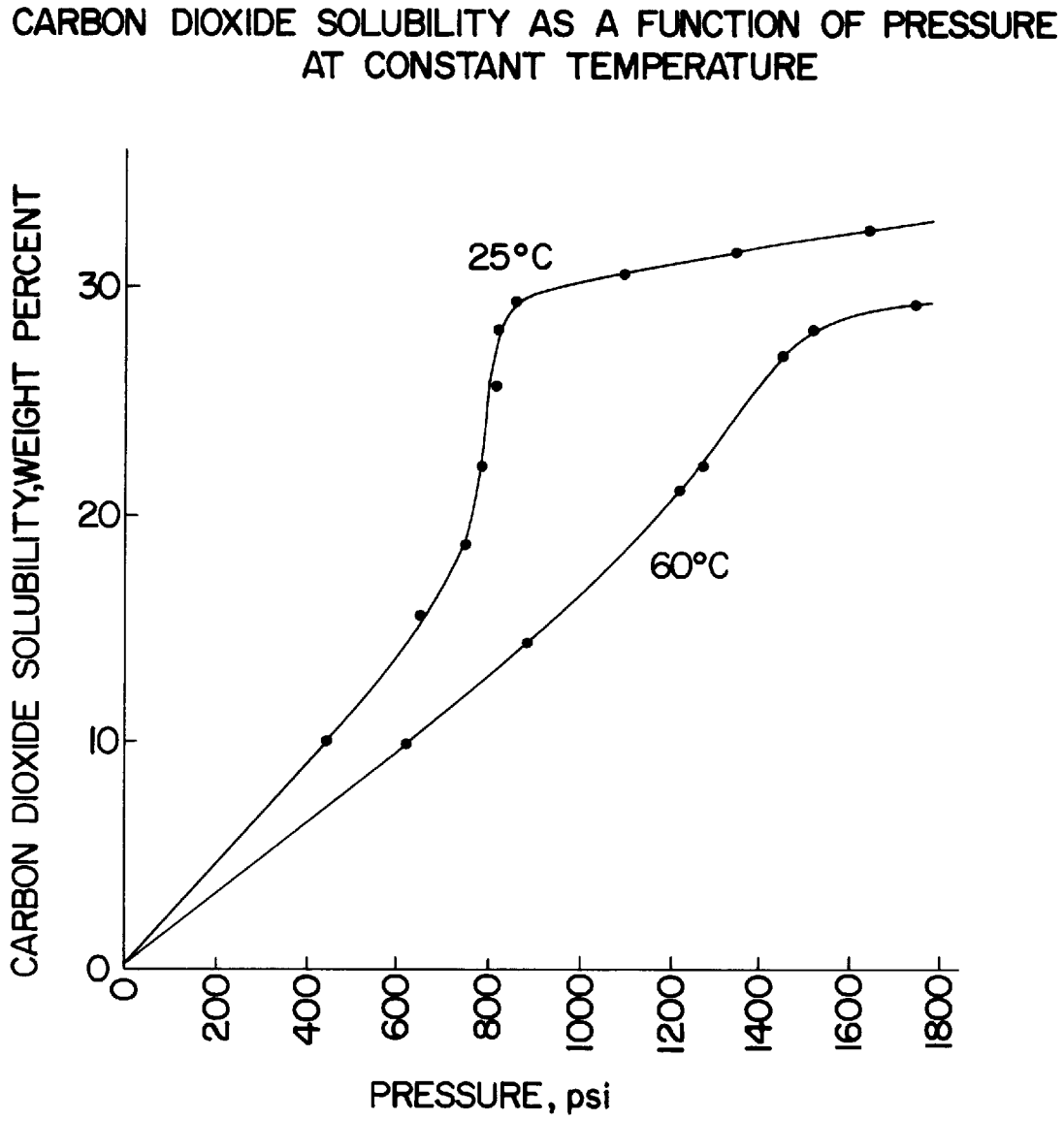
FIG. 9 is a diagram showing carbon dioxide solubility in a coating composition as a function of pressure at constant temperature.
Figure 10:
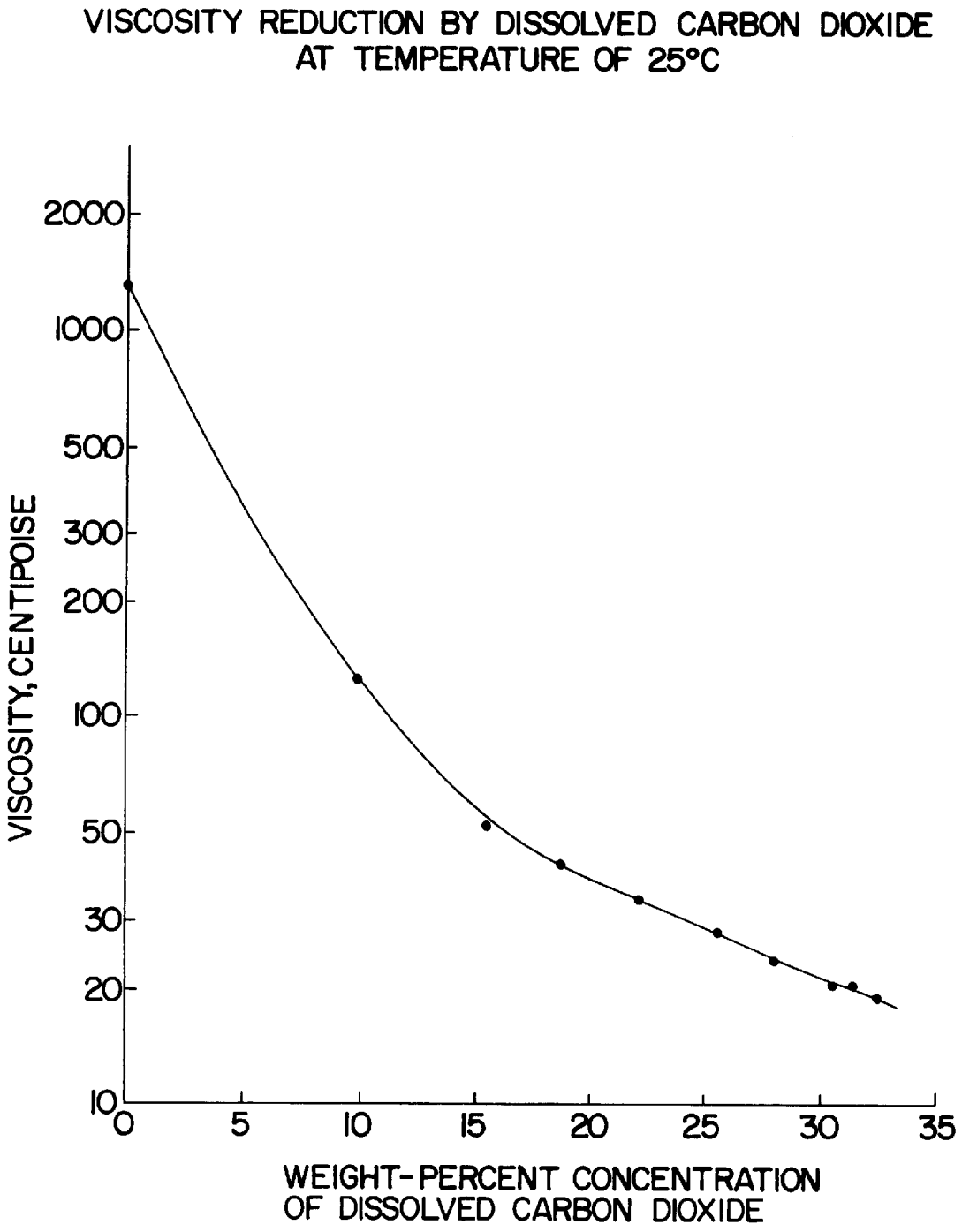
FIG. 10 is a diagram showing viscosity reduction of a coating composition with increasing concentration of dissolved subcritical compressed carbon dioxide.

FIG. 9 illustrates how carbon dioxide solubility increases with pressure at two temperatures that are representative of spraying with subcritical compressed carbon dioxide (25 C.) and with supercritical carbon dioxide (60 C.). The coating composition contains an acrylic polymer (Acryloid™ AT-954) and a melamine cross-linking agent (Cymel™ 323) that have low number-average molecular weights of 1,670 and 410, respectively. The coating composition has a high total polymer content of 75%. At the supercritical temperature of 60 C., the solubility increases relatively linearly with pressure, but at the subcritical temperature of 25 C., the solubility is higher and, surprisingly, markedly increases between pressures of 700 and 900 psi and then levels off at a higher level than at 60 C. This would appear to indicate that subcritical carbon dioxide interacts more strongly with the polymer than supercritical carbon dioxide does, which increases the solubility to a level at relatively low pressures that is favorable for viscosity reduction. The viscosity reduction that results is shown in FIG. 10 as a function of the concentration of dissolved subcritical compressed carbon dioxide.

When sprayed, it is desirable to have the subcritical compressed fluid diffuse through the sprayed composition as quickly as possible such that there is very little residual fluid left in the coating once it has come into contact with the substrate. Accordingly, the fluid, which of course is no longer compressed, should have a solubility with the coating composition of less than about 0.8% by weight of the fluid in the non-compressed state in the composition. Preferably, the solubility of the fluid is less than about 0.6% by weight in the composition. Most preferably, the fluid should be soluble in the coating composition in an amount of less than about 0.4%. As used herein, it is to be understood that the solubility of the fluid in the non-compressed state, i.e., at one atmosphere pressure, is measured at 25° C. and at one atmosphere absolute pressure of the fluid.

The starting viscosity of the coating composition should desirably also be considered. Although a viscosity greater than 4,000 centipoise may be used if desired, preferably the coating composition has a viscosity of less than about 4,000 centipoise, more preferably less than about 2,000 centipoise, and most preferably less than about 1,500 centipoise. Although a viscosity of less than 500 centipoise may be used if desired, preferably the coating composition has a viscosity of greater than about 500 centipoise, more preferably greater than about 700 centipoise.

Obviously, a major factor contributing to the viscosity of the liquid mixture is the amount of solvent fraction contained therein. Hence, it is apparent that the amount of solvent fraction present in the composition should be considered hand-in-hand with the desired viscosity that is to be obtained.

The viscosity of the coating composition should be low enough such that there is enough solvent present to provide proper coalescence upon the substrate once the composition is sprayed while still being high enough to allow for a reduction in solvent usage so as to maximize the utilization of the subcritical compressed fluid viscosity diluent and to concomitantly facilitate good atomization and coating formation.

The viscosity of the coating composition should also be such that when subcritical compressed fluid is added, it is possible to add enough of the subcritical compressed fluid such that the viscosity of the admixed liquid mixture is lowered to less than about 150 centipoise at the conditions of the subcritical compressed fluid so as to render the liquid mixture suitable for spray application. More preferably, the admixed composition has a viscosity which is less than about 100 centipoise and preferably has a viscosity of from about 1 to about 75 centipoise. Most preferably, the viscosity of the admixture of coating composition and subcritical compressed fluid is in the range of from about 5 to about 50 centipoise.

Where a solvent fraction is utilized, the polymeric component of the liquid mixture is generally present in amounts ranging from 10 to 75 weight percent based upon the total weight of the polymer(s), solvent fraction, and subcritical compressed fluid. Preferably, the polymer component is present in amounts ranging from about 20 to about 65 weight percent on the same basis.

If subcritical compressed carbon dioxide fluid is utilized as the viscosity reducing diluent, it preferably should be present in amounts ranging from about 10 to about 75 weight percent based upon the total weight of the coating composition and subcritical compressed fluid. Most preferably, it is present in amounts ranging from 20 to 60 weight percent on the same basis producing a liquid mixture having a viscosity in the range of from about 5 centipoise to about 50 centipoise.

In order to minimize the unnecessary release of any active solvent present in the liquid spray mixture, the amount of active solvent used should be less than that required to produce a mixture of polymeric compounds and active solvent having a viscosity which will permit its application by conventional liquid spray techniques. In other words, the inclusion of active solvent(s) should be minimized such that the viscosity diluent effect provided by the subcritical compressed fluid in accordance with the present invention is fully utilized. Generally, this requires that the coating composition have a viscosity of not less than about 150 centipoise. Preferably, the solvent(s) should be present in amounts ranging from about 0 to about 70 weight percent based upon the total weight of the coating composition and subcritical compressed fluid. Most preferably, the solvent(s) are present in amounts ranging from about 5 to about 50 weight percent on the same basis.

When the coating composition is sprayed, the spray temperature used is a function of the coating composition, the subcritical compressed fluid being used, and the concentration of subcritical compressed fluid in the liquid mixture. As the temperature is decreased, the viscosity of the admixed composition generally tends to increase. Accordingly, the minimum spray temperature is that temperature at which the admixed coating composition would have a maximum viscosity needed for obtaining desirable spray characteristics. The maximum temperature is the highest temperature at which the components of the liquid mixture are not significantly thermally degraded during the time that the liquid mixture is at that temperature. However, it is often preferred that the temperature be the same or nearly the same temperature at which the substrate is maintained, generally ambient or near ambient temperature. Cooling below ambient temperature is generally not beneficial for it typically tends to increase the viscosity of the admixed composition.

The spray pressure too is a function of the coating composition and the subcritical compressed fluid being used. The minimum spray pressure must be at least about 300 psi greater than the environment into which the coating composition is sprayed, which is typically into atmospheric or near atmospheric pressure. Preferably the spray pressure is at least about 300 psi, more preferably at least about 500 psi.

As used herein, the term "subcritical reference temperature" is understood to be the temperature at which the ratio of gas density to liquid density of the subcritical compressed fluid at equilibrium is 0.6. Also as used herein, term "subcritical reference pressure" is understood to be the pressure equal to 95 percent of the absolute critical pressure of the subcritical compressed fluid.

In general, it is desirable that the temperature and pressure at which the liquid mixture of coating composition and subcritical compressed fluid is sprayed, that is, the spray temperature and spray pressure, are such that: (1) the spray temperature is less than the subcritical reference temperature and the spray pressure is less than the subcritical reference pressure, or (2) if the spray temperature is greater than the subcritical reference temperature then the spray pressure is less than the subcritical reference pressure, or (3) if the spray pressure is greater than the subcritical reference pressure then the spray temperature is less than the subcritical reference temperature. More preferably, if the spray pressure is less than the subcritical reference pressure, then the spray temperature should desirably be less than about 20 degrees C. above the critical temperature of the subcritical compressed fluid, still more desirably less than about 10 degrees C. above the critical temperature. More preferably too, if the spray temperature is less than the subcritical reference temperature, then the spray pressure should desirably be less than about 600 psi above the absolute critical pressure of the subcritical compressed fluid, still more desirably less than about 300 psi above the absolute critical pressure. Preferably, the spray pressure is greater than about 50 percent of the absolute critical pressure of the subcritical compressed fluid. For coating compositions that have a suitable phase chemistry with the subcritical compressed fluid, which must be determined experimentally, a combination of spray temperature and spray pressure may be used such that the liquid mixture passes through the liquid-liquid phase region during depressurization, as disclosed in U.S. Pat. No. 5,290,603. If the subcritical compressed fluid is subcritical compressed carbon dioxide, the preferred spray pressure is between about 500 psia and about 1020 psia. The most preferred spray pressure is between about 700 psia and about 970 psia.

The subcritical compressed fluid maintained at a given temperature and pressure may be mixed with a coating composition which is at a different temperature and pressure. The resulting temperature and pressure of the mixture would then have to be adjusted, if necessary, to provide the desired conditions so as to obtain the viscosity reducing and atomization effects. Thus, if a subcritical compressed fluid maintained at a temperature of 20° C. and a pressure 1000 psi were introduced into a closed chamber containing a coating composition at a temperature of 0° C. and 100 psi, and the resulting admixture produced a liquid mixture at 10° C. and a pressure of 500 psi, it may be necessary to raise the pressure of the liquid mixture so as to obtain the desired effects from the subcritical compressed fluid.

Alternatively, the material used as the subcritical compressed fluid may be introduced into the coating composition while still a gas at one set of temperature and pressure conditions, and then be heated and/or pressurized to the desired extent by heating the admixture and thereby provide the gas as a subcritical compressed fluid and its concomitant viscosity reducing and atomization enhancement effects.

We have furthermore discovered that when spraying coating compositions with subcritical compressed fluids that atomization can be enhanced to produce sprays having still finer atomization and coatings having improved appearance and uniformity, particularly for thin coatings, when the liquid mixture of coating composition and subcritical compressed fluid is passed through an orifice in a spray tip under conditions of temperature, pressure, and amount of subcritical compressed fluid that produce choked flow of the liquid mixture being sprayed. Without wishing to be bound by theory, choked flow is believed to cause the liquid mixture to exit the orifice under significant elevated pressure, which is called the choke pressure, instead of the liquid mixture exiting the orifice at a substantially reduced pressure that is relatively close to or at atmospheric pressure, which occurs in all sprays that do not have choked flow whether or not they contain subcritical compressed fluid. Therefore the energy released by depressurization of the subcritical compressed fluid is believed to be more energetically and effectively transmitted to the coating composition, which produces still finer atomization.

Choked flow of the liquid mixture of coating composition and subcritical compressed fluid when passed through an orifice in a spray tip is the flow state that occurs when the mass flow rate of the liquid mixture is insensitive to change in the pressure of the environment outside of the spray tip, for constant inlet conditions of the liquid mixture flowing into the spray tip. The choke pressure is the pressure of the environment outside of the spray tip at which the mass flow rate first becomes insensitive to change in the pressure of the environment. Without wishing to be bound by theory, choked flow is believed to occur when the speed of sound in the liquid mixture is decreased during depressurization to a point where it equals the flow velocity of the depressurizing liquid mixture. The pressure of the liquid mixture at this point is the choke pressure. The choked flow state causes the liquid mixture to flow from the orifice at or near the choke pressure instead of continuing to depressurize to being close to or at the pressure of the outside environment before the liquid mixture flows from the orifice into the environment.

That choked flow of the liquid mixture of coating composition and subcritical compressed fluid is occurring, as the liquid mixture is passed through an orifice in a spray tip for constant inlet conditions, can be determined, and the choke pressure can be measured, by measuring how the mass flow rate of the liquid mixture through the orifice changes as the outside pressure of the spray environment is increased. If the mass flow rate is insensitive to increasing the outside pressure, then choked flow is occurring, whereas if the mass flow rate continually decreases as the outside pressure is increased, then choked flow is not occurring. When choked flow occurs, the mass flow rate remains essentially constant until the outside pressure reaches the choke pressure, after which the mass flow rate continually decreases as the outside pressure increases further.

How the mass flow rate of the liquid mixture through the orifice responds to increasing the pressure of the spray environment outside of the spray tip is illustrated in FIG. 1 for the cases of choked flow and non-choked flow. For choked flow, the mass flow rate remains essentially constant as the outside pressure is increased, as represented by line segment "A", which indicates the range of outside pressure over which the flow is choked. When the outside pressure reaches the choke pressure, as indicated by breakpoint "C" in the line, the mass flow rate then begins to continually decrease as the outside pressure increases further, as represented by line segment "B", which indicates the range of outside pressure over which the flow is not choked. For the case when the flow of liquid mixture is not choked, the mass flow rate continually decreases as the outside pressure is increased, as indicated by line "D". For simplicity, lines "B" and "D" are shown as straight lines whereas the mass flow rate generally does not necessarily decrease linearly with increasing outside pressure. Furthermore, temporal fluctuations that typically occur during the course of experimental measurements might cause fluctuations in the measured trends.

The mass flow rate trend illustrated in FIG. 1 can likewise be measured by decreasing the outside pressure incrementally from a high initial pressure, that is, as the pressure drop across the orifice is increased incrementally. With a high outlet pressure and low pressure drop, the flow through the orifice is not choked, so the flow rate increases as the outlet pressure decreases and the pressure drop increases. When the flow becomes choked, the flow rate remains essentially constant as the outlet pressure is decreased and the pressure drop is increased further. The choke pressure is likewise detected by the break that occurs in a plot of flow rate versus outlet pressure or pressure drop.

The method or apparatus used to determine if choked flow is occurring or to measure the choke pressure is not critical to the present invention. Any suitably reliable method or apparatus may utilized. For example, the pressure of the environment outside of the spray tip, that is, the spray environment, may be increased above atmospheric pressure by spraying into a suitable closed pressure vessel, tank, container, tube, or the like. The pressure inside the vessel can be increased by using compressed air or preferably compressed nitrogen or another inert gas, which can be supplied from a compressed gas cylinder or a compressor. The vessel pressure can be controlled or regulated at a desired pressure, or varied, by using a suitable pressure regulator. The vessel pressure can be measured by using a suitable pressure gauge. The vessel should be protected from overpressurization by some suitable means, such as a pressure relief device or a rupture disk. For example, the spray gun may be placed inside a tank that is pressurized with nitrogen. The mass flow rate may be measured by any suitable means, such as by a mass flow meter, weighing, and the like, provided that the method is suitable for measuring the mass flow rate of a liquid mixture that contains subcritical compressed fluid. For example, a coriolis mass flow meter that is appropriately sized, such as produced by Micro Motion, Inc., may be used to measure the mass flow rate of the liquid mixture flowing into the spray gun. During the mass flow rate measurements care must be taken to maintain the inlet conditions of temperature, pressure, and amount of subcritical compressed fluid flowing to the spray tip at the desired levels.

Figure 2:
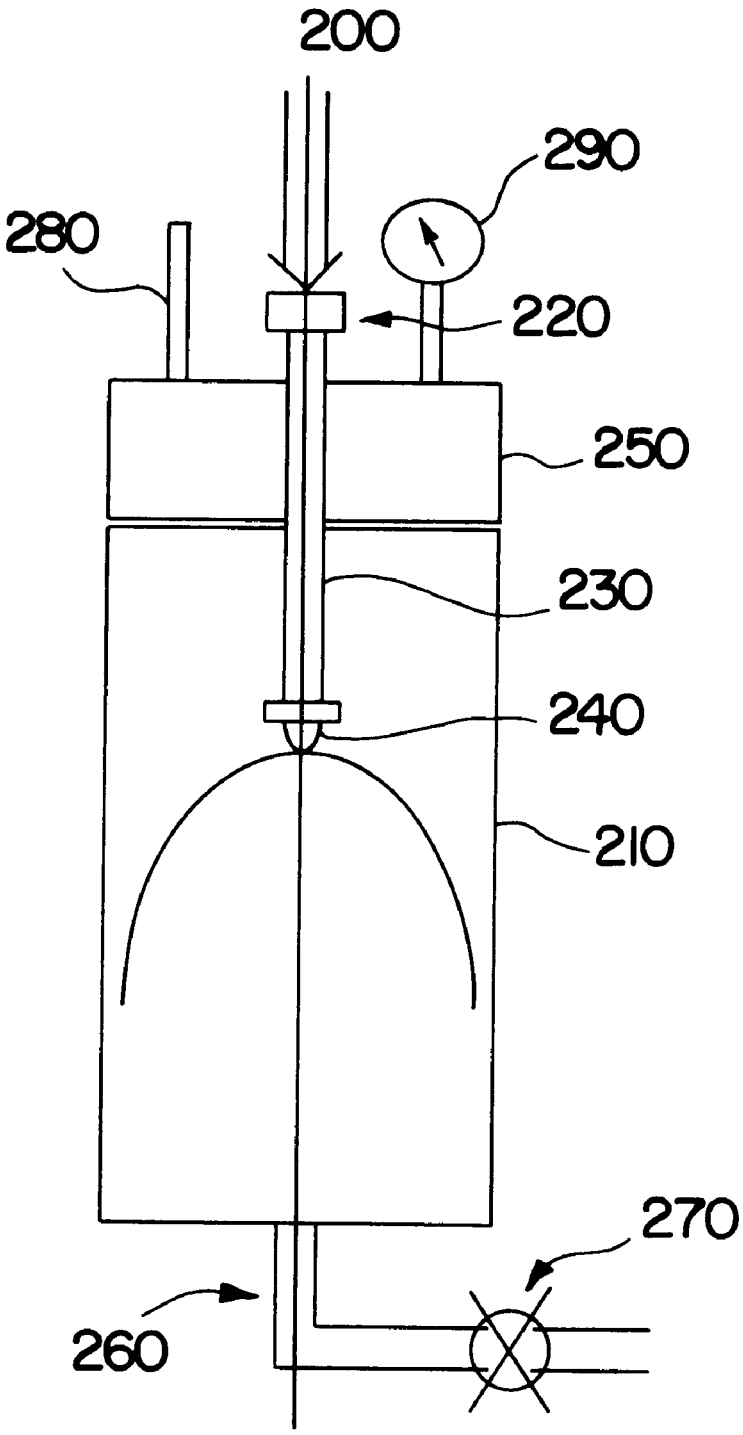
FIG. 2 is a schematic diagram of an apparatus that may be used to increase the pressure of the spray environment to measure choked flow and choke pressure.

One method of increasing the pressure of the spray environment is illustrated in FIG. 2. The mass flow rate of liquid mixture 200 is measured by a mass flow meter (not shown) and fed to spray gun 220 which is outside of pressurized stainless steel high-pressure tank 210. Extension tube adapter 230 conveys the liquid mixture from spray gun 220 outside the tank through tank cap 250 to spray tip 240 inside the tank. The pressure inside the tank is adjusted by using compressed nitrogen from a cylinder and regulator (not shown). Sprayed coating accumulates at the bottom of the tank, where it can be removed through drain 260 and control valve 270 as required. Tank pressure is measured by pressure gauge 290 and the tank is protected from overpressurization by pressure release valve 280. The subcritical compressed fluid accumulated in the tank during spraying is released through regulated pressure release valve 280 to maintain the desired tank pressure.

The choke flow and choke pressure measurements can be made by two modes of operation: transient and steady state. In the transient mode, the tank is pressurized by the spray discharge, so the flow rate can change in response to the increase in tank pressure. In the steady state mode, the tank is pressurized initially by compressed nitrogen and then the pressure is regulated at the desired level during spraying. Spraying is continued until steady state flow is maintained at a given pressure, and than another steady state measurement is made at another pressure.

The conditions of temperature, pressure, and amount of subcritical compressed fluid that produce choked flow of the liquid mixture being sprayed generally have to be determined experimentally for a given coating composition. Generally choked flow occurs more readily close to or at the solubility limit of the subcritical compressed fluid in the coating composition for a given temperature and pressure. However, being close to the solubility limit does not necessarily ensure that choked flow will be formed for a given combination of temperature and pressure for a given coating composition. Generally the temperature must be sufficiently high, and higher temperature is generally preferred than lower temperature. However, generally a lower temperature can be used with a higher amount of subcritical compressed fluid in the liquid mixture, and conversely a higher temperature might be required with a lower amount of subcritical compressed fluid, but generally the relationship must be determined by experiment. Generally lower pressure is favorable for forming choked flow for a given combination of temperature and amount of subcritical compressed fluid, and excessively high pressure can be detrimental. Again, a suitable pressure must be determined by experiment. The pressure can be used to vary the solubility of the subcritical compressed fluid in the coating composition.

How obtaining choked flow depends upon the makeup of the coating composition is not understood and the ability to form choked flow for a given spray tip and given subcritical compressed fluid must be determined experimentally for a given coating composition over a range of temperature, pressure, and amount of subcritical compressed fluid.

In general, the choked pressure produced by the choked flow is necessarily lower than the spray pressure, because the liquid mixture becomes supersaturated during depressurization before choked flow occurs in the liquid mixture as it flows through the spray tip. Higher choke pressure is desirable for finer atomization. Preferably the choke pressure of the choked flow of the liquid mixture is greater than about 100 psi, more preferably greater than about 200 psi, still more preferably greater than about 300 psi, and most preferably greater than about 400 psi. The choke pressure produced will in general depend upon the particular coating composition, subcritical compressed fluid, spray conditions, and spray tip used.

The liquid mixture of coating composition and subcritical compressed fluid may be sprayed onto a substrate to form a liquid coating thereon by passing the liquid mixture under pressure through an orifice into the environment of the substrate to form a liquid spray.

An orifice is a hole or an opening in a wall or housing, such as in a spray tip of a spray nozzle on a spray gun through which the liquid mixture flows in going from a region of higher pressure, such as inside the spray tip, into a region of lower pressure, such as a typical air environment outside of the spray tip and around the substrate. An orifice may also be the open end of a tube or pipe or conduit through which the liquid mixture is discharged. The open end of the tube or pipe or conduit may be constricted or partially blocked to reduce the open area.

In general, spray orifices, spray tips, spray nozzles, and spray guns used for conventional and electrostatic airless and air-assisted airless spraying of coatings such as paints, lacquers, enamels, and varnishes, are suitable for spraying the coating compositions when admixed with subcritical compressed fluids and the specific designs are not critical provided that they are capable of forming the choked flow state and give desirable spray performance. Generally the spray orifice and spray tip to be used must be experimentally tested with a given coating composition and subcritical compressed fluid over a range of spray conditions of amount of subcritical compressed fluid, spray temperature, and spray pressure to determine if choked flow can be obtained for a given spray application and to determine the optimal spray conditions. Spray guns, nozzles, and tips are preferred that do not have excessive flow volume between the orifice and the valve that turns the spray on and off. The spray tip outlet preferably does not have protuberances that would interfere with expanding flow of the developing spray. Generally dome style airless spray tips are preferred. The spray guns, nozzles, and tips must be built to contain the spray pressure used. The choice of spray device is dependent upon the kind of application that is contemplated. If desired, spray tips having elongated orifices such as disclosed in U.S. Pat. Nos. 5,178,325 and 5,464,154 may be utilized.

The material of construction of the orifice through which the liquid mixture is sprayed must possess the necessary mechanical strength for the high spray pressure used, have sufficient abrasion resistance to resist wear from fluid flow, and be inert to chemicals with which it comes into contact. Any of the materials used in the construction of airless spray-tips, such as boron carbide, titanium carbide, ceramic, stainless steel, or brass, is suitable, with tungsten carbide generally being preferred.

The orifice sizes suitable for spraying the liquid mixture should generally range from about 0.004-inch to about 0.050-inch diameter. Because the orifices are generally not circular, the diameters referred to are equivalent to a circular diameter. The proper selection is determined by the orifice size that will supply the desired amount of liquid coating and accomplish proper atomization for the coating. Generally, smaller orifices are desired at lower viscosity and larger orifices are desired at higher viscosity. Smaller orifices give finer atomization but lower output. Larger orifices give higher output but poorer atomization. Finer atomization is preferred. Therefore, small orifice sizes from about 0.004-inch to about 0.025-inch diameter are preferred, with orifice sizes from about 0.005-inch to about 0.020-inch being more preferred, and orifice sizes from about 0.007-inch to about 0.015-inch being most preferred.

The shape of the spray is also not critical to being able to spray the liquid mixture provided desirable spray performance is obtained. The spray may be in the shape of a cone that is circular or elliptical in cross section or the spray may be a flat fan, but the spray is not limited to these shapes. Sprays that are flat fans or cones that are elliptical in cross section are preferred. The distance from the orifice to the substrate is generally at a distance of from about 4 inches to about 24 inches.

Pre-orifices may also be utilized for a variety of purposes, such as to modify the atomization, to modify the spray pattern, and/or to modify the flow rate of the liquid mixture or application rate of the coating. Generally a range of pre-orifice sizes must be tested experimentally to determine the optimal pre-orifice size or if a pre-orifice is beneficial. The pre-orifices generally have a circular hole and the size is specified by the hole diameter. Suitable pre-orifice sizes generally range from 0.007-inch to about 0.020 inches. Generally the pre-orifice size is larger than the orifice size of the spray tip. Pre-orifice inserts that minimize void space in the spray tip are preferred, such as by incorporating the pre-orifice piece into the gasket piece that provides a pressure seal between the spray tip and the spray gun.

Electrostatic forces may be used to increase the proportion of coating composition that is deposited onto a substrate from the spray by using the techniques disclosed is U.S. Pat. No. 5,106,650.

Typically, the spray undergoes rapid cooling while it is close to the orifice, so the temperature drops rapidly to below ambient temperature. Entrainment of ambient air into the spray warms the spray to near ambient temperature before the spray reaches the substrate provided that the spray has fine droplet size as shown in FIG. 8. The droplets are further warmed by absorbing heat from the substrate when they are deposited. This rapid cooling of the spray may be beneficial because less active solvent evaporates in the spray in comparison to the amount of solvent lost in conventional heated airless sprays. Therefore, a greater proportion of the active solvent is retained in the coating formulation to aid leveling of the coating on the substrate.

Spray temperatures above ambient may be obtained by mildly heating the liquid mixture before it enters the spray gun, by heating the spray gun itself, by circulating the heated liquid mixture to or through the spray gun to maintain the spray temperature, or by a combination of such methods. Circulating the heated liquid mixture through the spray gun is preferred to avoid heat loss and to maintain the desired spray temperature, provided the application does not use color change.

The environment into which the admixed coating composition is sprayed is not critical provided that the pressure therein is below the choke pressure so that the choked flow state is obtained. Preferably the pressure of the spray environment is substantially below the choke pressure. Most preferably, the admixed liquid coating composition is sprayed in air under conditions at or near atmospheric pressure. Other gas environments can also be used, such as air with reduced oxygen content or inert gases such as nitrogen, carbon dioxide, helium, argon, xenon, or a mixture.

Generally, liquid spray droplets are produced which generally have an average diameter of one micron or greater. Preferably, these droplets have average diameters of from about 10 to about 100 microns. More preferably, these droplets have average diameters of from about 15 to about 80 microns. Most preferably, these droplets have average diameters of from about 20 to about 50 microns. Small spray droplets are desirable to vent the subcritical compressed fluid from the spray droplet before impacting the substrate. Small spray droplets also give higher quality finishes.

The processes of the present invention may be used to apply coatings by the application of liquid spray to a variety of substrates. Examples of suitable substrates include, but are not limited to, metals, wood, glass, plastic, mold surfaces, paper, cloth, ceramic, masonry, stone, cement, asphalt, rubber, and composite materials, medicinal pills and tablets, and agriculturally related substrates.

Through the practice of the present invention, films may be applied to substrates such that the cured films have thicknesses of from about 0.2 to about 10.0 mils. Preferably, the films have thicknesses of from about 0.5 to about 8.0 mils, and most preferably, the thickness range is from about 0.8 to about 4.0 mils.

If curing of the coating composition present upon the coated substrate is required, it may be performed by conventional means, such as allowing for evaporation of the active and/or coupling solvent, application of heat or ultraviolet light, etc.

Compressed gas may be utilized to assist formation of the liquid spray and/or to modify the shape of the liquid spray that comes from the orifice.

We have also found that there are additives that may be added to the coating composition which will improve the atomization enhancement effect provided by the subcritical compressed fluid. For example, pigments and other solid particulate additives such as fillers have been found to expand the range of conditions in which fine atomization can be obtained. For example, a coating composition that gives a clear coating that is difficult to atomize can often give improved atomization by incorporating pigment into the coating formulation. In particular, titanium dioxide pigments have been found to give better atomization at lower temperatures and also to allow more subcritical compressed carbon dioxide to be used in the spray mixture than would otherwise be expected based on the coating formulation with no pigment. Therefore, titanium dioxide is a preferred pigment material.

As noted above, conventional airless spray techniques are known to produce defective spray fans that limit their usefulness to applying low-quality coating films. Characteristically, the liquid-film spray forms a "tailing" or "fishtail" spray pattern, which makes it difficult to apply a uniform coating. By using subcritical compressed fluids, such as subcritical compressed carbon dioxide, we have discovered that an improved "feathered" airless spray pattern can be formed which enables high-quality uniform coatings to be applied, which is the preferred embodiment of the present invention. Such proper atomization can easily be observed by the shape and pattern of the spray that is produced signifying that the proper spraying conditions are being maintained as the coating mixture is sprayed.

The effect of spray conditions on a sprayed coating mixture is vividly demonstrated in the photoreproductions shown in FIGS. 5 to 8. In FIGS. 6*a*–6*g*, coating mixtures are sprayed either with no subcritical compressed fluids or with subcritical compressed fluids in too low a concentration, for a given spray temperature and pressure, such that various types of fishtail spray patterns are formed. Surface tension and cohesive forces in the liquid film tend to gather more liquid at the edges of the spray fan than in the center, which produces coarsely atomized jets of coating. Sometimes the jets separate from the spray and deposit separate bands of coating. At other times, they thicken the edges so that more coating is deposited at the top and bottom than in the center of the spray. These deficiencies make it difficult to apply a uniform coating. The fishtail spray pattern characteristically forms when a liquid-film is visible extending from the spray orifice before atomization occurs. The fishtail sprays are also generally angular in shape and have a relatively narrow fan width, that is, a fan width that is not much greater than the fan width rating of the spray tip being used.

Figure 6A:
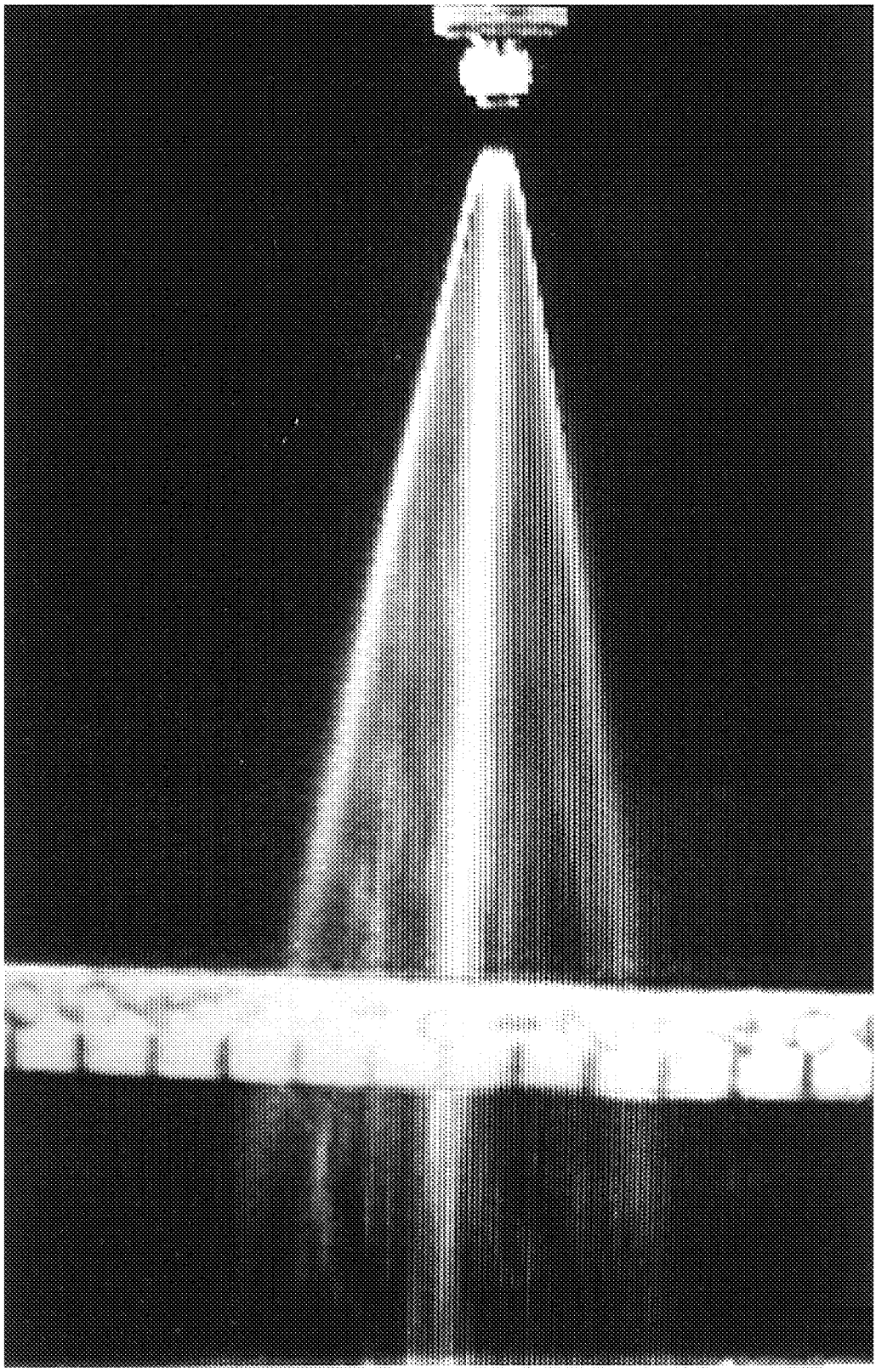
FIGS. 6*a*–6*g* are photoreproductions of actual atomized liquid sprays containing a fishtail liquid-film spray pattern for coating compositions sprayed either without or with too little subcritical compressed fluid.
Figure 6B:
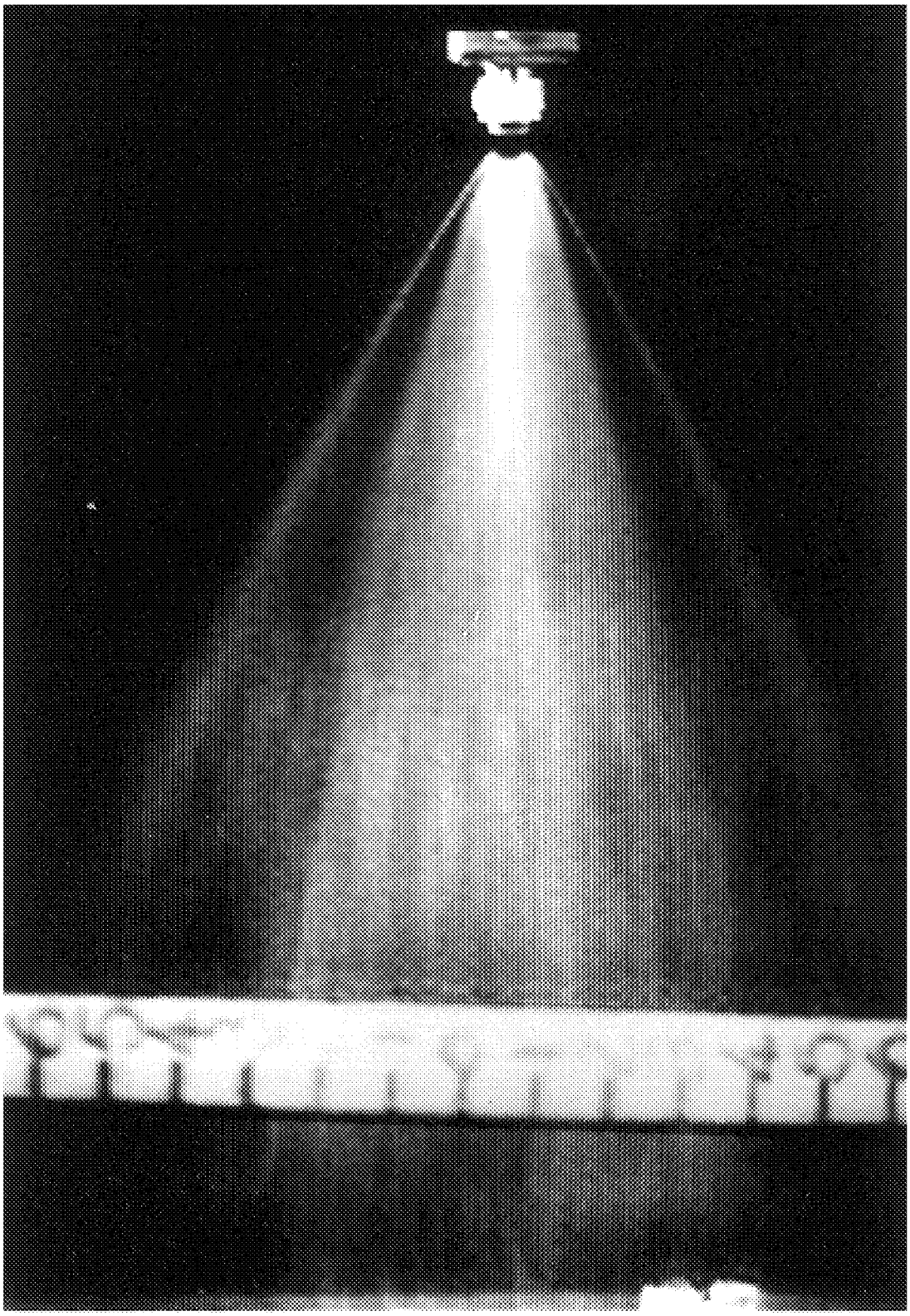

FIGS. 6*a* and 6*b* show fishtail spray patterns produced by coating compositions containing two high molecular weight polymers when sprayed with no subcritical compressed fluid. FIG. 6*a* was produced by spraying an acrylic polymer having a high number-average molecular weight of 24,750. The coating composition had a polymer content of 44 percent and a viscosity of 1060 centipoise. The spray temperature was 27 C. and the pressure was 1,000 psi. The liquid-film is visible extending a relatively long distance from the spray orifice and the spray pattern consists primarily of three jets of liquid at the edges and in the center of the spray with little coating in between the jets. Due to the high molecular weight, a feathered spray pattern was not formed when subcritical compressed carbon dioxide was utilized as the viscosity reducing diluent, although a feathered spray pattern was obtained using supercritical carbon dioxide.

FIG. 6*b* was produced by spraying cellulose acetate butyrate polymer having a high number-average molecular weight of 19,630. The coating composition had a polymer content of 30 percent and a viscosity of 1,290 centipoise. The spray temperature was 60 C. and the pressure was 400 psi. The liquid-film is visible extending from the spray orifice and the spray pattern has a central portion and two detached side jets with little coating in between. Due to the high molecular weight, a feathered spray pattern was not formed when subcritical compressed carbon dioxide was utilized as the viscosity reducing diluent, even though this polymer has very high carbon dioxide solubility, although a feathered spray pattern was obtained using supercritical carbon dioxide.

Figure 6C:
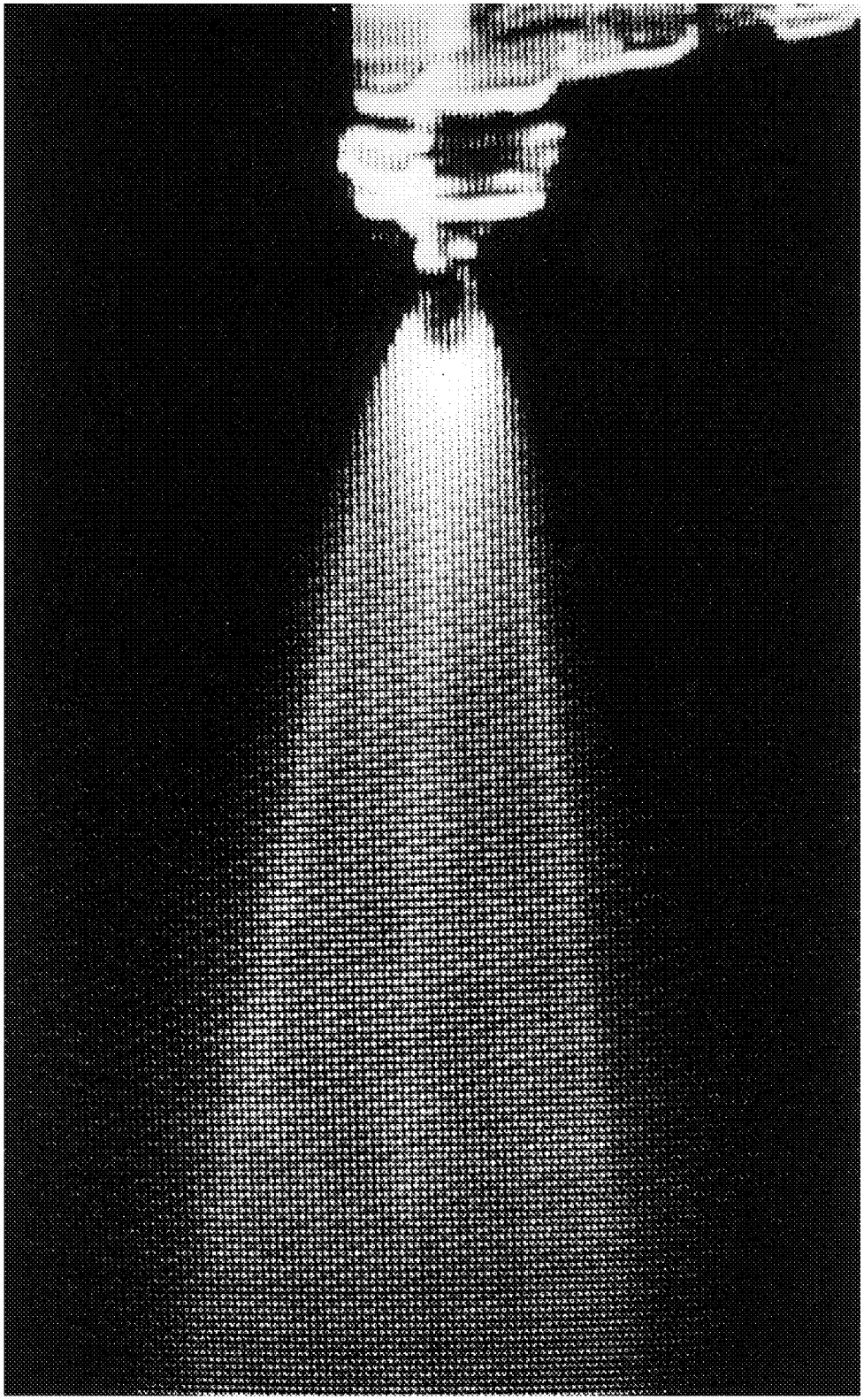

FIG. 6*c* shows a fishtail spray pattern produced by a coating composition containing nitrocellulose polymer with a high number-average molecular weight of 9,760 when sprayed with a subcritical compressed carbon dioxide concentration of about 30%. The coating composition had a nitrocellulose content of 25.5% and a lower molecular weight alkyd polymer content of 29.5%. The viscosity was 500 centipoise. The spray temperature was 30.5 C. and the pressure was 1,000 psi. The liquid-film is visible extending from the spray orifice and the spray pattern has a higher concentration of coating at the edges than in the center. The spray has a narrow fan width and an angular shape. Due to the high molecular weight, a feathered spray pattern was not formed when subcritical compressed carbon dioxide was utilized as the viscosity reducing diluent even at much higher concentration, although a feathered spray pattern was obtained using supercritical carbon dioxide.

Figure 6D:
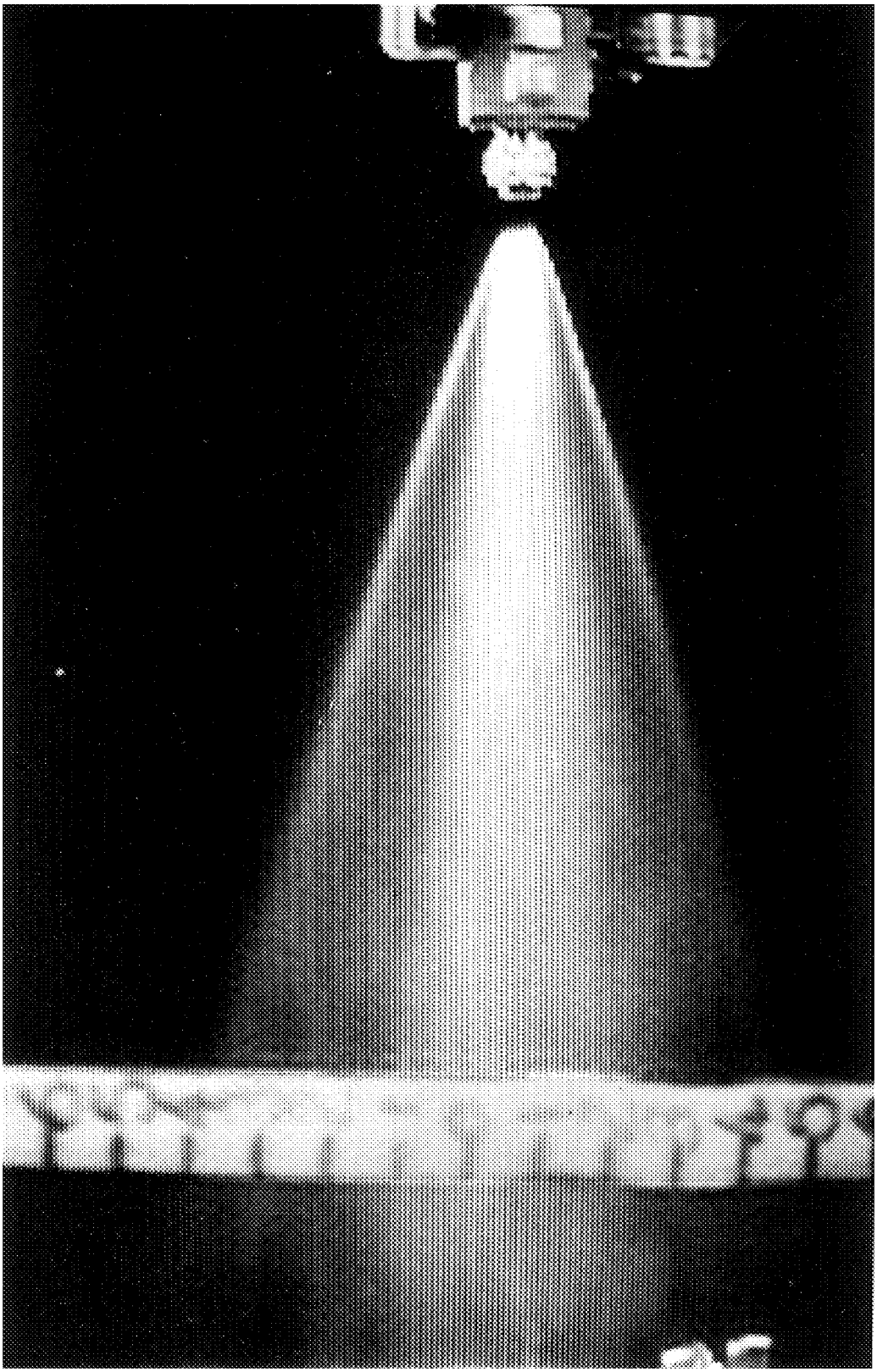
Figure 6E:
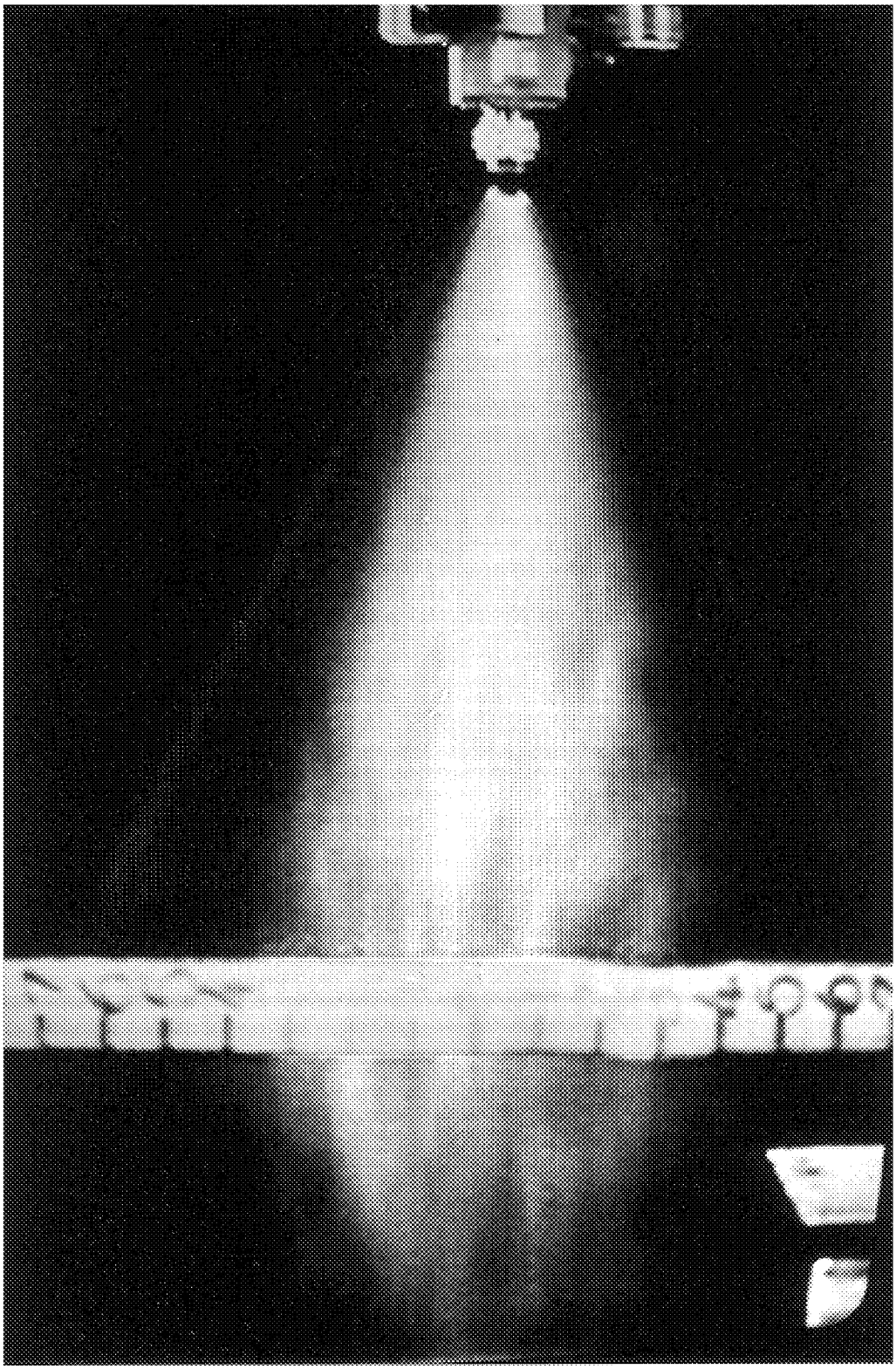
Figure 6F:
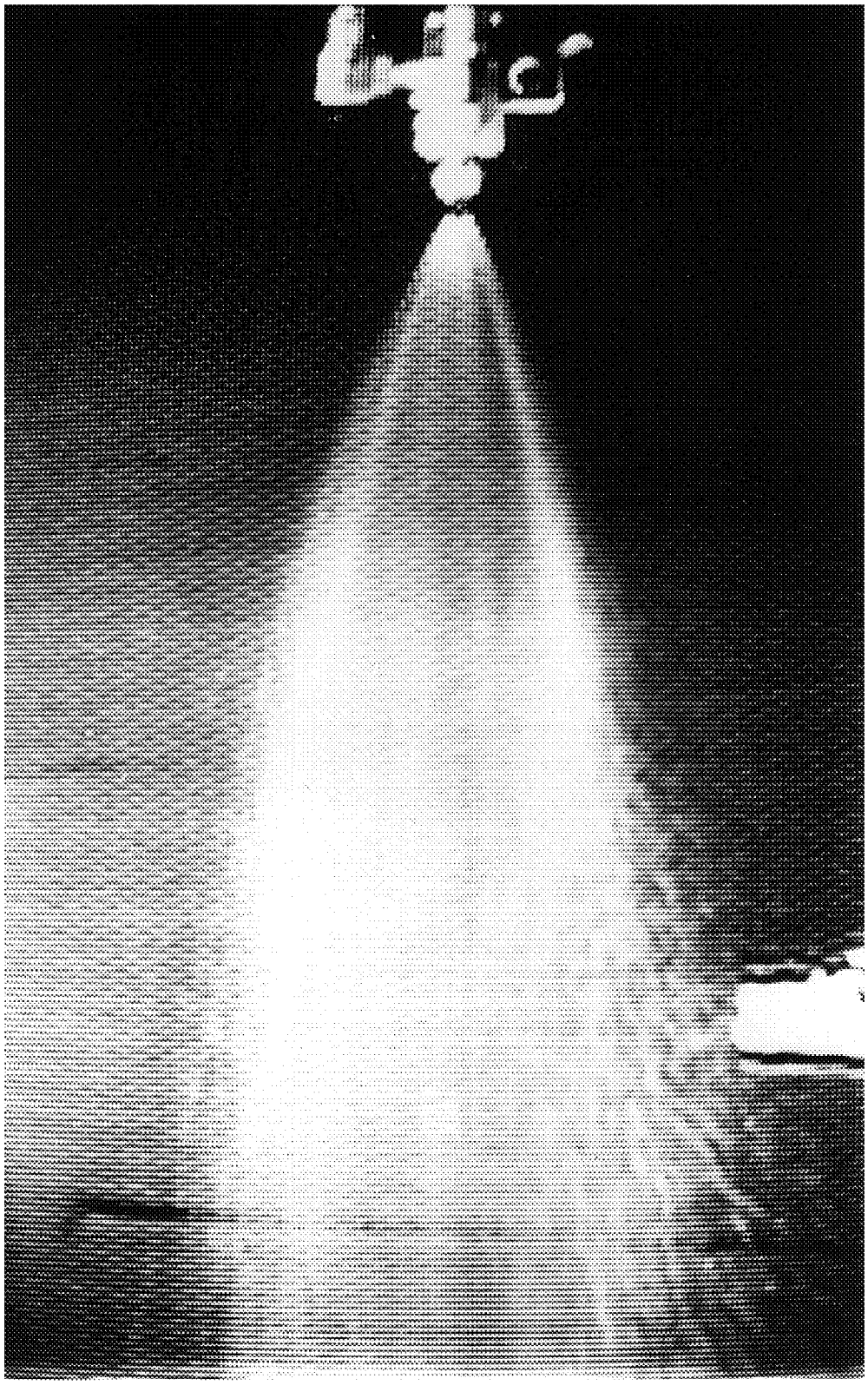

FIGS. 6*d*–6*f* show fishtail spray patterns produced by coating compositions containing a mixture of two acrylic polymers and a cross-linking agent having low number-average molecular weights of 3,270, 1,670, and 410, respectively. In FIG. 6*d*, a coating composition having a combined polymer content of 67% and a viscosity of 670 centipoise was sprayed without subcritical compressed fluid at a temperature of 28 C. and a pressure of 1600 psi. The liquid film is visible and the spray pattern consists of a central portion with jets on each side. The spray has a narrow fan width and an angular shape.

FIG. 6*e* shows the same coating composition diluted with 28% methyl ethyl ketone solvent to give a low viscosity to simulate addition of subcritical compressed carbon dioxide. The diluted polymer content was 48%. The spray temperature was 23 C. and the pressure was 300 psi. Despite the much lower viscosity, the spray still has a fishtail pattern and a visible liquid film. The two side jets have detached farther from the central portion of the spray than in FIG. 6*d* at high polymer concentration and higher viscosity.

In FIG. 6*f*, the same coating composition as in FIG. 6*d* is diluted with 28% subcritical compressed carbon dioxide to give a low viscosity. The spray temperature was 22 C. and the spray pressure was 1,000 psi. The spray has a fishtail fan pattern with a visible liquid film and a greater concentration of coating at the edges of the spray than in the center. The spray has a narrow fan width and an angular shape. Increasing the subcritical compressed carbon dioxide concentration to 31% and decreasing the spray pressure to 850 psi desirably produced a feathered spray fan, as shown in FIG. 5*a*.

Figure 6G:
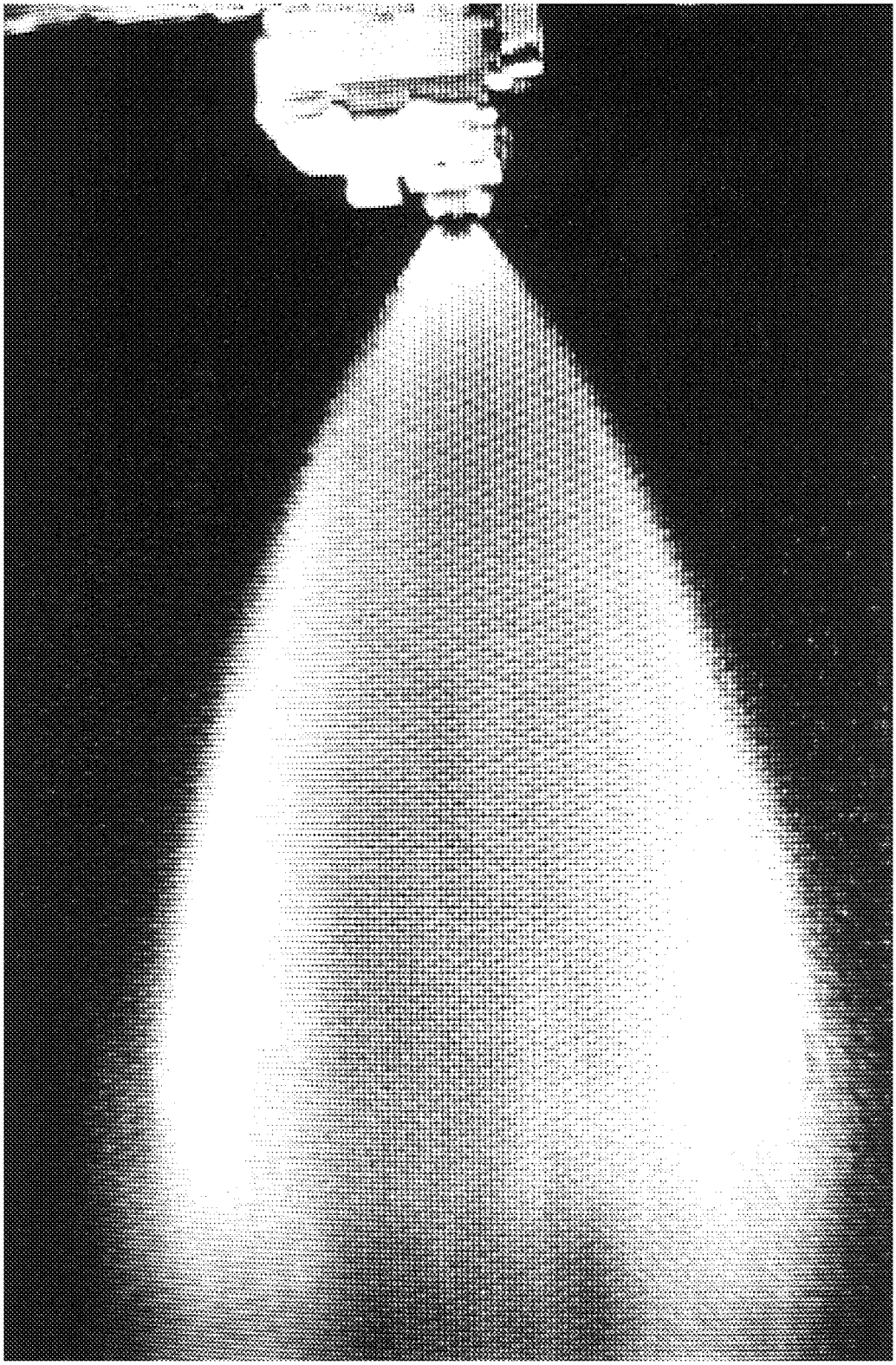

FIG. 6*g* shows a fishtail spray pattern produced by a coating composition containing just a single acrylic polymer having a low number-average molecular weight of 1,670 and the same cross-linking agent as in FIGS. 6*d*–6*f*. The coating composition has a polymer content of 76% and a viscosity of 1,100 centipoise. The spray mixture had a subcritical compressed carbon dioxide concentration of about 29%, a spray temperature of 24 C. and a pressure of 1600 psi. The spray has a visible liquid film and a greater concentration of coating at the edges of the spray than in the center. The spray has a narrow fan width and an angular shape. Increasing the temperature to 27 C. and decreasing the pressure to 900 psi with the same carbon dioxide concentration produced a wider feathered spray fan with a uniform center and tapered edges. The fan had a parabolic shape and no liquid film was visible.

Figure 5A:
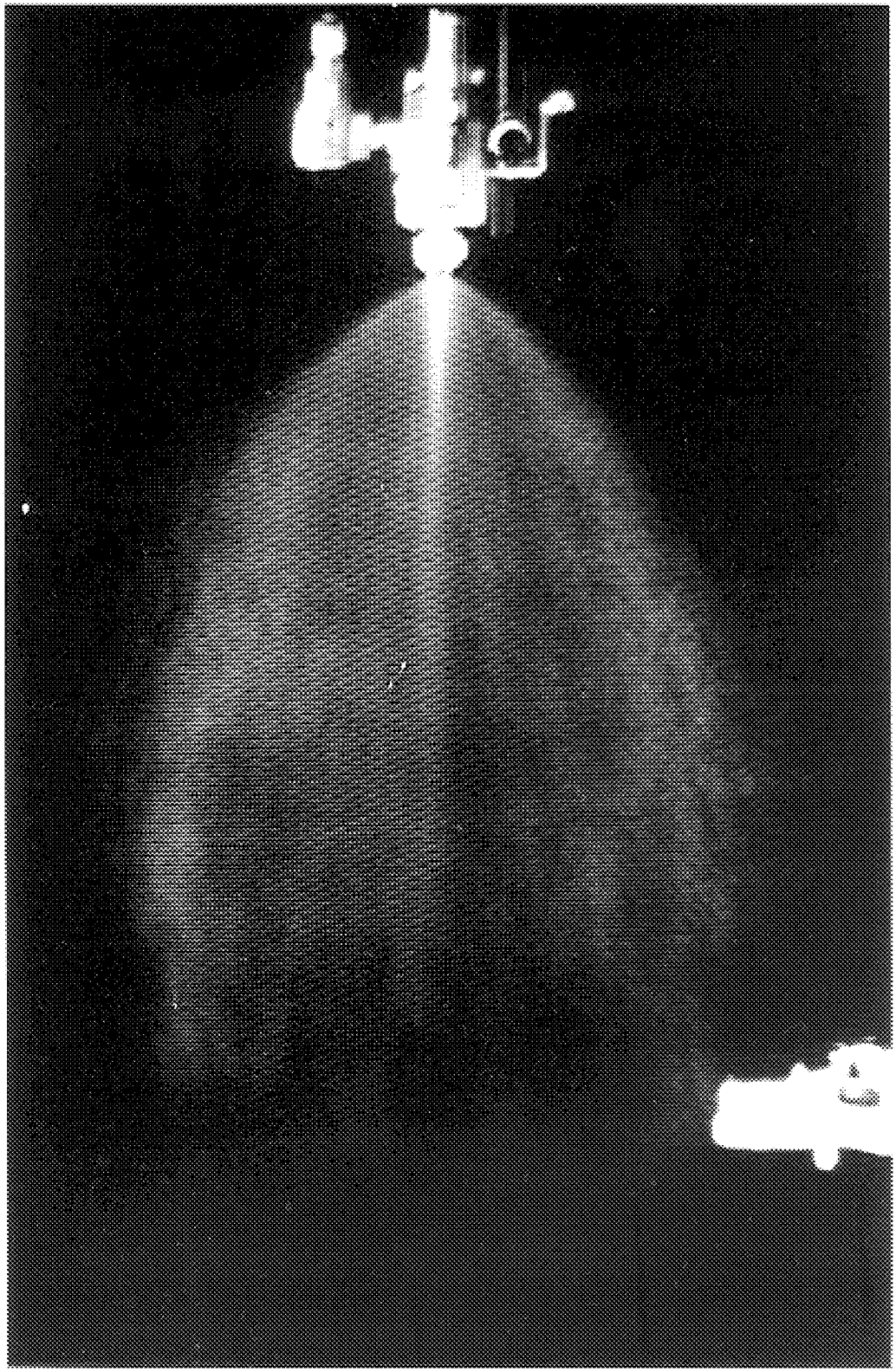
FIGS. 5*a*–5*f* are photoreproductions of actual atomized liquid sprays containing a feathered spray pattern in accordance with the preferred spraying mode of the present invention.
Figure 5B:
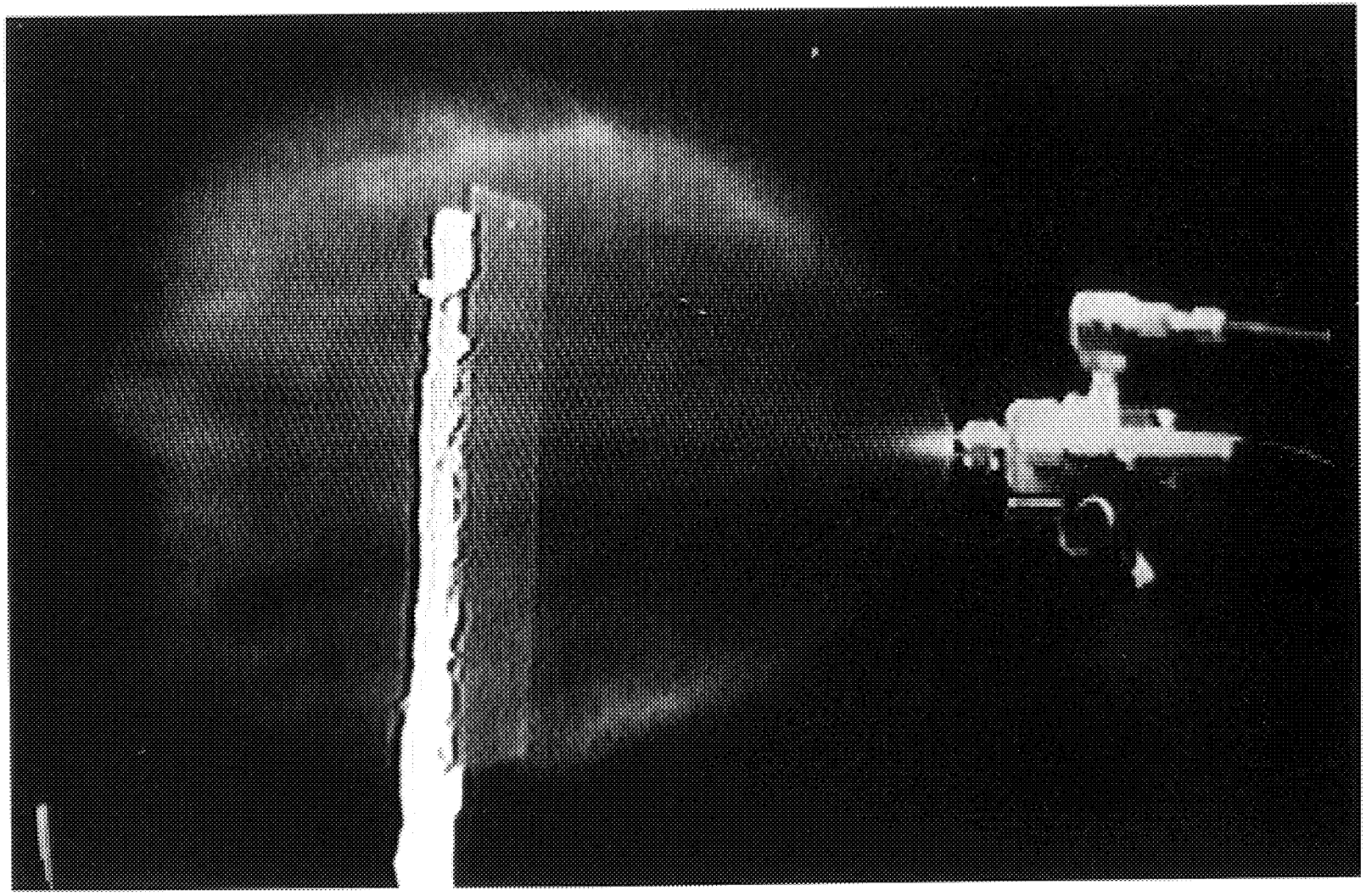

In complete contrast to FIGS. 6*a*–6*g*, which are not in accordance with the preferred embodiments of the present invention but still within its scope, FIGS. 5*a*–5*f* illustrate the preferred feathered spray patterns and decompressive sprays of the present invention obtained using a sufficient concentration of subcritical compressed carbon dioxide and proper spray temperature and pressure. The sprays generally have a parabolic shape, no visible liquid film, a relatively uniform fan with tapered edges, and a significantly greater fan width than the fan width rating of the spray tip used. FIGS. 5*a* and 5*b* show feathered sprays produced using the same coating composition noted above in FIGS. 6*d* and 6*f*. In FIG. 5*a*, the subcritical compressed carbon dioxide concentration is 31%, the spray temperature is 21 C., and the pressure is 850 psi. In FIG. 5*b*, the subcritical compressed carbon dioxide concentration is 30%, the spray temperature is 28 C., and the pressure is 950 psi.

Figure 5C:
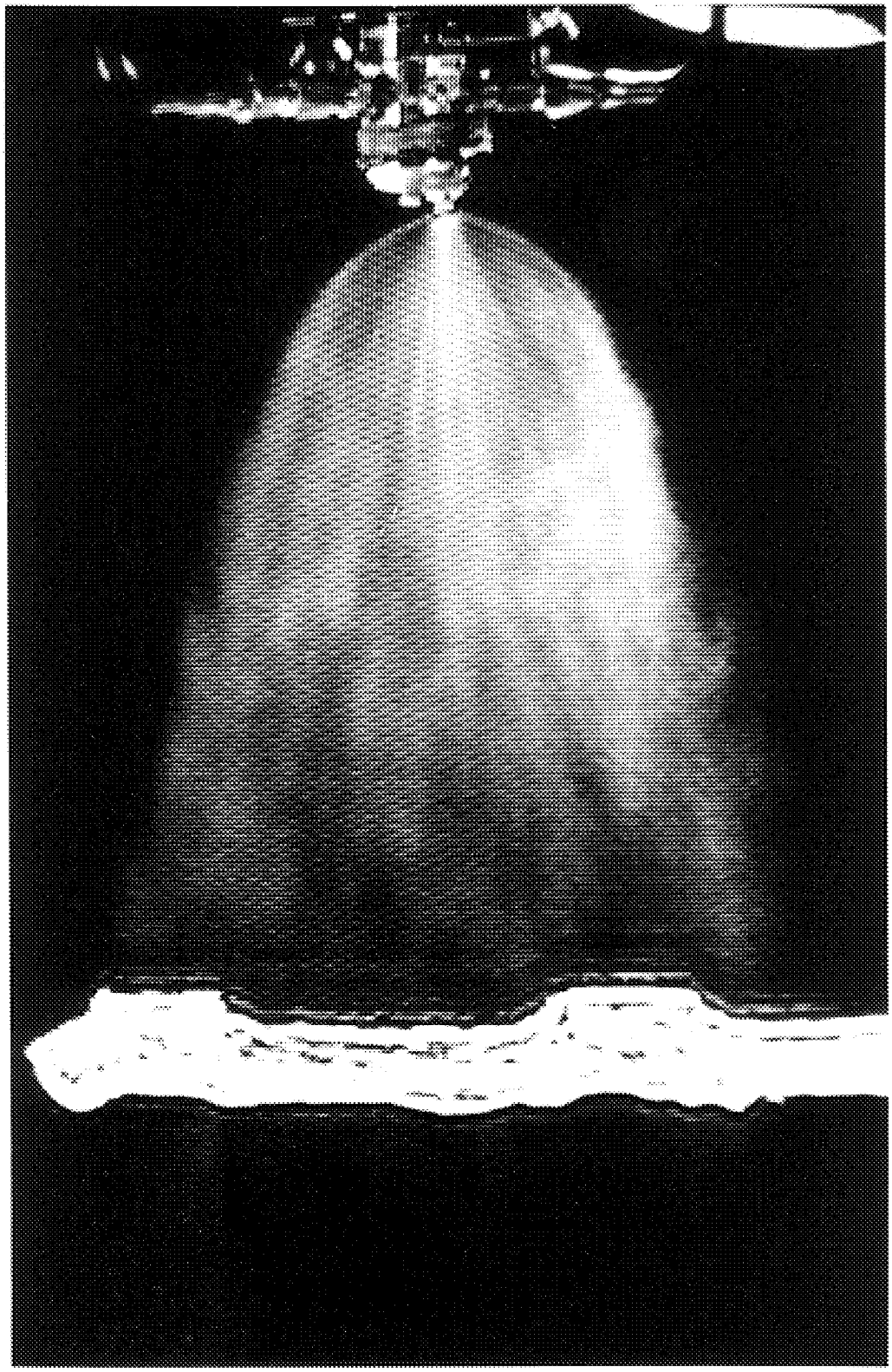
Figure 5D:
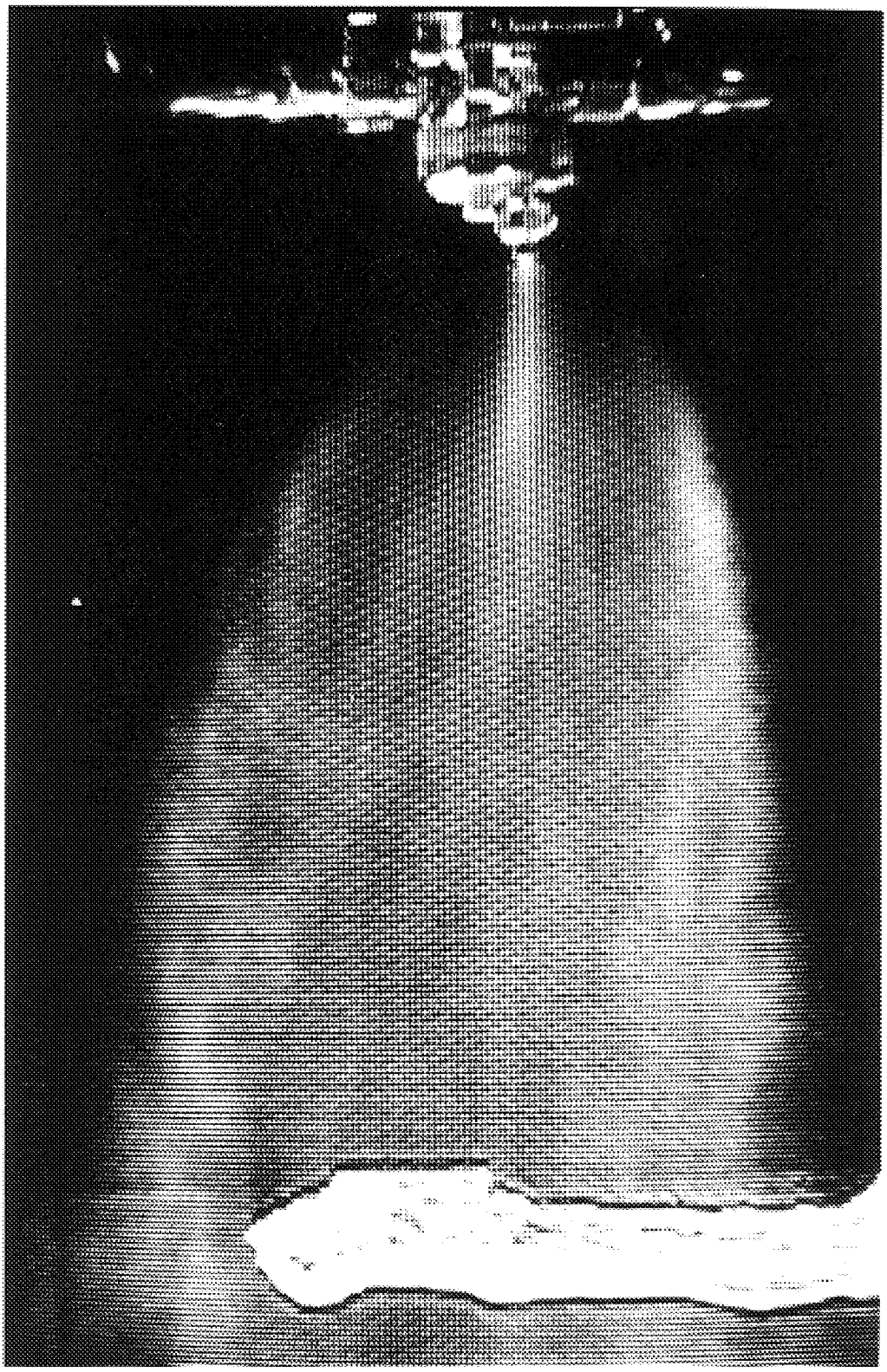

FIGS. 5*c* and 5*d* show feathered sprays obtained using coating compositions containing an acrylic polymer with a number-average molecular weight of 3,270 and the cross-linking agent noted above. FIG. 5*c* shows a clear coating composition with a polymer content of 60% and a viscosity of 470 centipoise. The subcritical compressed carbon dioxide content is 28%, the spray temperature is 36 C., and the spray pressure is 950 psi. FIG. 5*d* shows a white-pigmented coating composition with a total solids content of 71% and a viscosity of 1200 centipoise. The subcritical compressed carbon dioxide content is 32%, the spray temperature is 23 C., and the spray pressure is 900 psi.

Figure 5E:
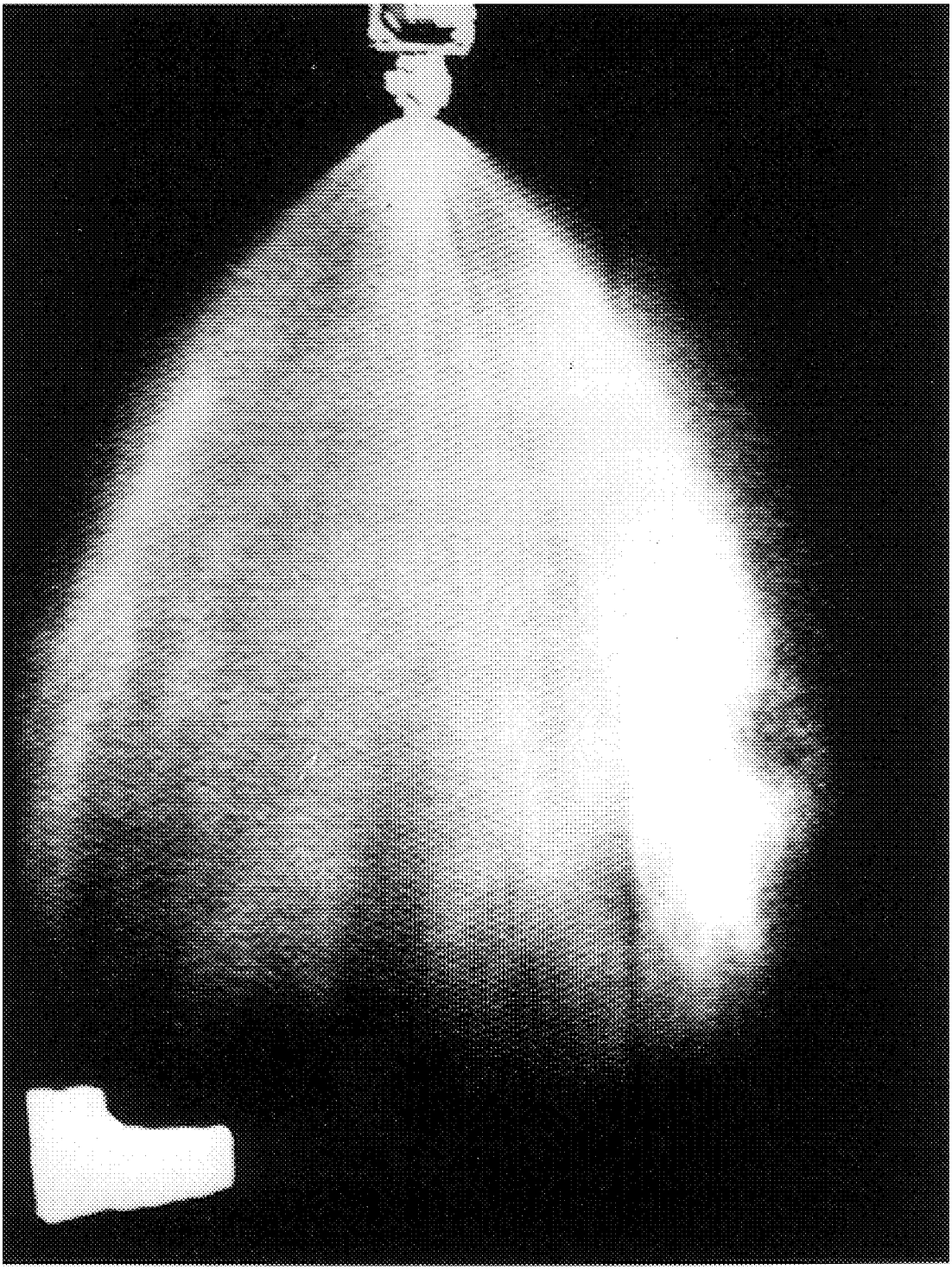
Figure 5F:
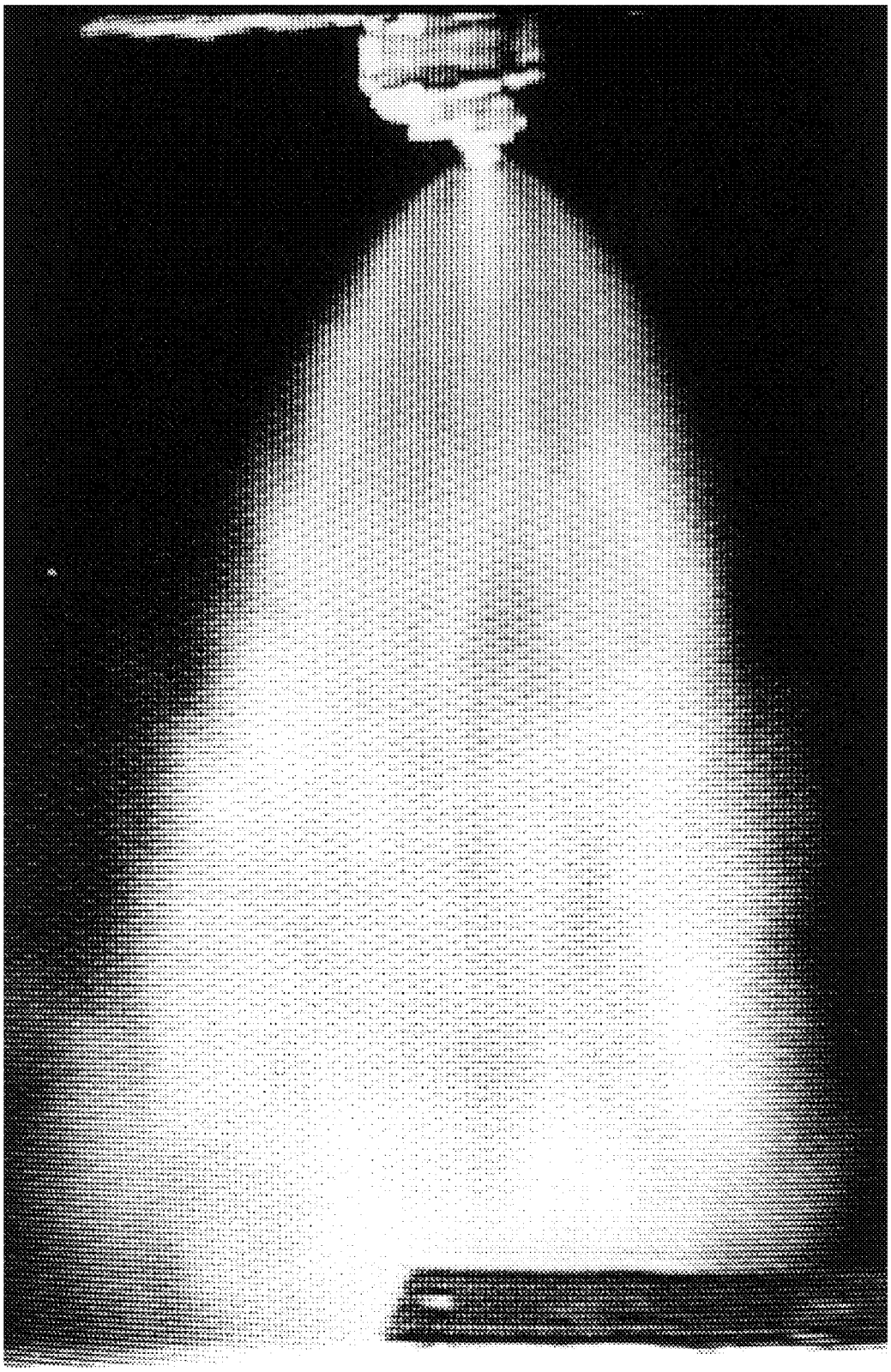

FIGS. 5*e* and 5*f* show feathered sprays obtained using coating compositions containing an acrylic polymer (Acryloid™ AT-954) with a low number-average molecular weight of 1,670 and the cross-linking agent noted above. FIG. 5*e* shows a clear coating composition with a high polymer content of 79% and a high viscosity of 3,000 centipoise. The subcritical compressed carbon dioxide content is 28%, the spray temperature is 28 C., and the spray pressure is 900 psi. FIG. 5*f* shows a white-pigmented coating composition with a high total solids content of 81% and a viscosity of 540 centipoise. The subcritical compressed carbon dioxide content is 39%, the spray temperature is 24 C., and the spray pressure is 900 psi.

Figure 4:
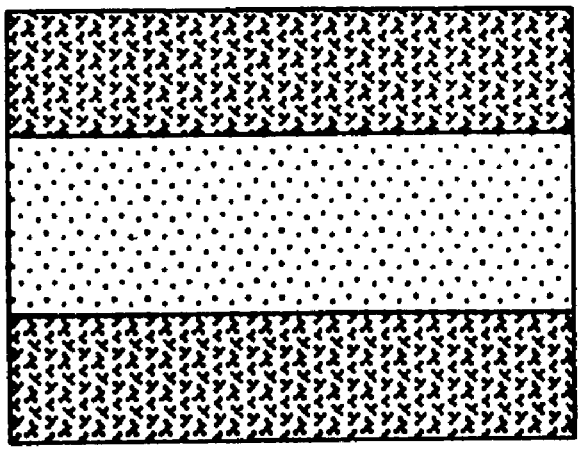
FIG. 4 is a diagrammatic illustration of a fishtail spray pattern coating layer which occurs when spray conditions are such that a feathered spray pattern is not obtained, such as the concentration of subcritical compressed fluid being too low in the spray mixture.

The characteristics of the coating deposition profile which is obtained by spraying a fishtail pattern of the type illustrated in FIGS. 6*c* and 6*f* onto a substrate is demonstrated in FIG. 4. In FIG. 4, a diagrammatic representation of the coating particles is shown in which the edges of the spray pattern contain a higher concentration of the particles than in the center. The other types of fishtail sprays deposit different profiles depending upon the occurrence and location of jets in the spray pattern, but they share a common defect in that the spray deposition is highly non-uniform, typically with heavy deposition zones being separated by light deposition zones. This, plus a lack of sufficiently tapered edges, make it difficult to apply a uniform coating. The fishtail sprays also characteristically have poor atomization and relatively large droplet sizes, which make it difficult to apply a high quality coating.

Figure 3:
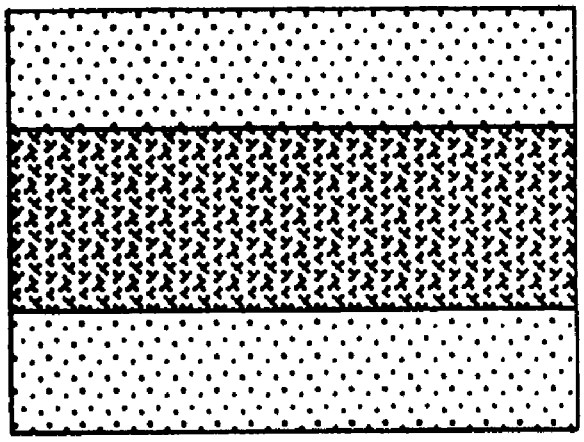
FIG. 3 is a diagrammatic illustration of a feathered spray pattern coating layer obtained on a substrate when the coating mixture is sprayed so as to obtain good atomization in accordance with the objectives of the present invention.

In complete contrast thereto, when the coating mixture is sprayed with the proper concentration of subcritical compressed fluid and pressure and temperature conditions such that vigorous atomization is obtained, a feathered spray deposition pattern is observed on a substrate coated with such a spray, which is diagrammatically illustrated in FIG. 3. FIG. 3 shows the margins of the spray pattern desirably containing less solid particles than in the center thereof. An actual feathered spray pattern typically deposits coating relatively uniformly in a wide central portion and deposits progressively less coating at the tapered edges. This feathering is particularly desirable for overlapping adjacent layers of sprayed coating to produce a coating film of uniform thickness. This is one of the principle reasons why air sprays are used instead of airless sprays to apply high-quality coatings.

Accordingly, as a way to determine whether a coating composition is being sprayed at the proper spraying conditions of temperature, pressure, amount of subcritical compressed fluid, and the like, such that good atomization is being obtained which results in a high-quality coating, it is generally sufficient to simply examine the visual appearance of the spray. If a feathered spray is observed, such as those shown in FIG. 5, then it can be reasonably assumed that proper atomization is being obtained. The presence of a fishtail pattern, however, is generally indicative of poor atomization.

For a given coating composition and constant spray temperature and pressure, the feathered spray pattern is characteristically obtained when the subcritical compressed carbon dioxide concentration in the spray mixture exceeds a transition concentration. With no carbon dioxide, the binding forces of cohesion, surface tension, and viscosity in the incompressible spray solution produce a typical fishtail spray pattern with very poor liquid-film atomization. At carbon dioxide concentrations below the transition region, the binding force exceeds the expansive force of the subcritical compressed carbon dioxide, so a fishtail spray pattern persists, but it becomes more uniform, the spray fan becomes wider, the visible liquid film recedes towards the orifice, and the spray mixture becomes compressible as the concentration increases from zero. At the mid-transition concentration, the expansive force equals the binding force, so neither controls the spray pattern. The visible liquid film has disappeared and atomization is occurring at the spray orifice. Surprisingly, as the concentration increases through the transition region, the angular flat fishtail spray fan typically first contracts into a narrow transitional oval or flared non-planar spray and then greatly expands into a much wider parabolic flat feathered spray fan. The transition can be seen not only in the shape of the spray but also in the greatly improved atomization and deposition of the coating. The droplet size becomes much smaller, which shows that the cohesive binding force is completely overcome by the expansive force of the subcritical compressed carbon dioxide, and coating quality is greatly improved. At carbon dioxide concentrations above the transition region, the spray fan is fully feathered, typically much wider and thicker, and exits the spray orifice at a much greater angle. Higher concentration further decreases the particle size, increases the fan width, and makes the spray solution more highly compressible, which affects the spray rate. One manifestation of the expansive force of the subcritical compressed carbon dioxide is that the feathered spray typically has a much greater fan width than normal airless sprays produced by the same spray tip. Although the spray leaves the spray tip at a much wider angle than normal airless sprays, the fan width can be indexed to give any fan width from narrow to very wide by changing the fan width rating of the airless spray tip, as is normally done.

For a given coating composition, at a constant concentration of subcritical compressed fluid, a transition from a fishtail liquid-film spray to a feathered decompressive spray can frequently be obtained by increasing the spray temperature and/or decreasing the spray pressure. Increasing the temperature increases the driving force for gasification of the subcritical compressed fluid as the spray exits the spray orifice, but it also decreases the solubility. Therefore, an optimum temperature exists. Decreasing the pressure lowers the density of the compressible spray mixture, which lowers the cohesiveness, but it also decreases the solubility. Therefore, an optimum pressure exists. In general, the concentration of subcritical compressed fluid, temperature, and pressure needed to obtain a feathered spray or a decompressive spray depends upon the properties of the coating composition being sprayed and is determined experimentally.

Figure 7A:
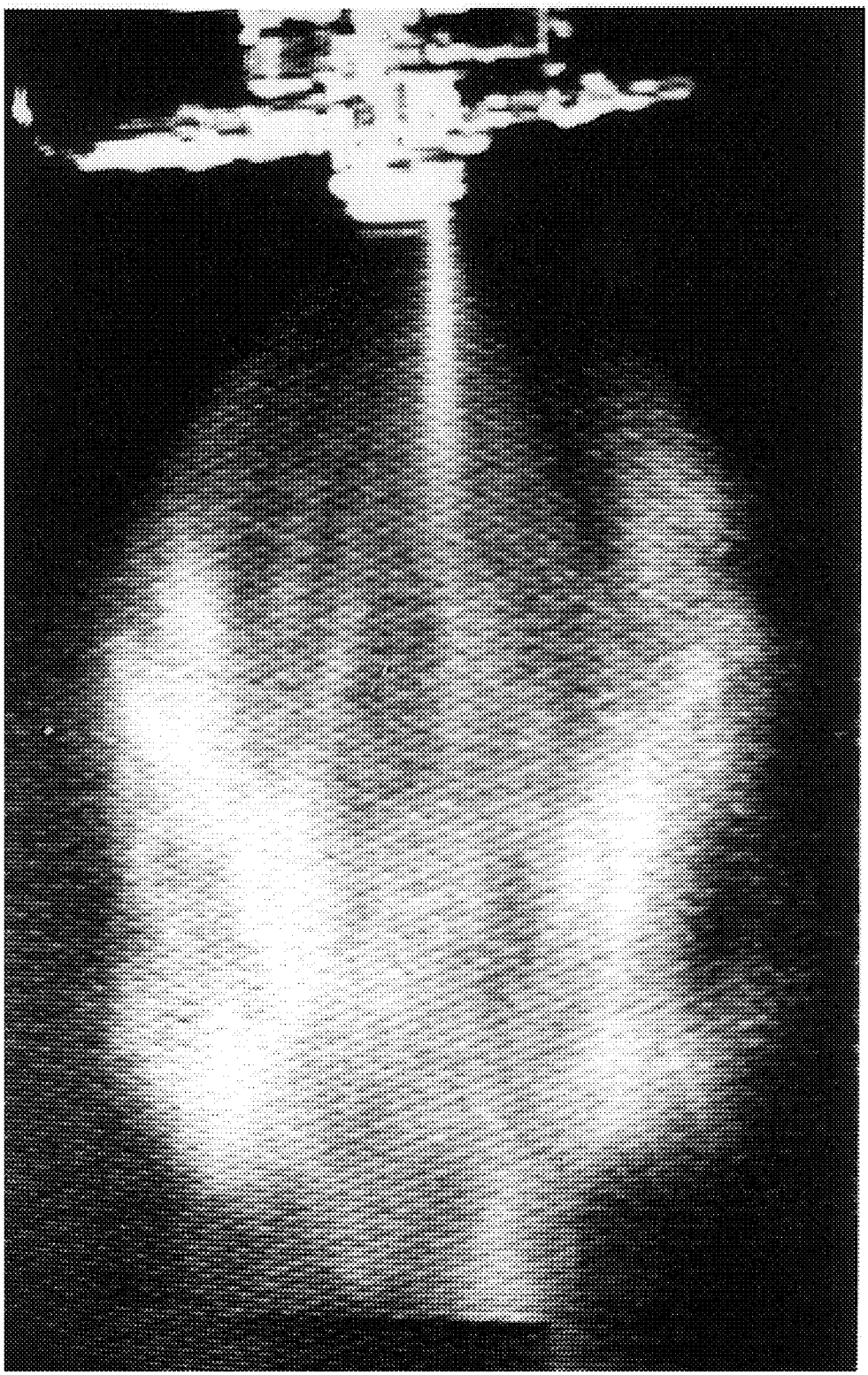
FIGS. 7*a*–7*b* are photoreproductions of actual atomized liquid sprays showing the transition from a feathered spray pattern to a fishtail liquid-film spray pattern upon increase in polymer molecular weight due to catalyzed reaction over time.
Figure 7B:
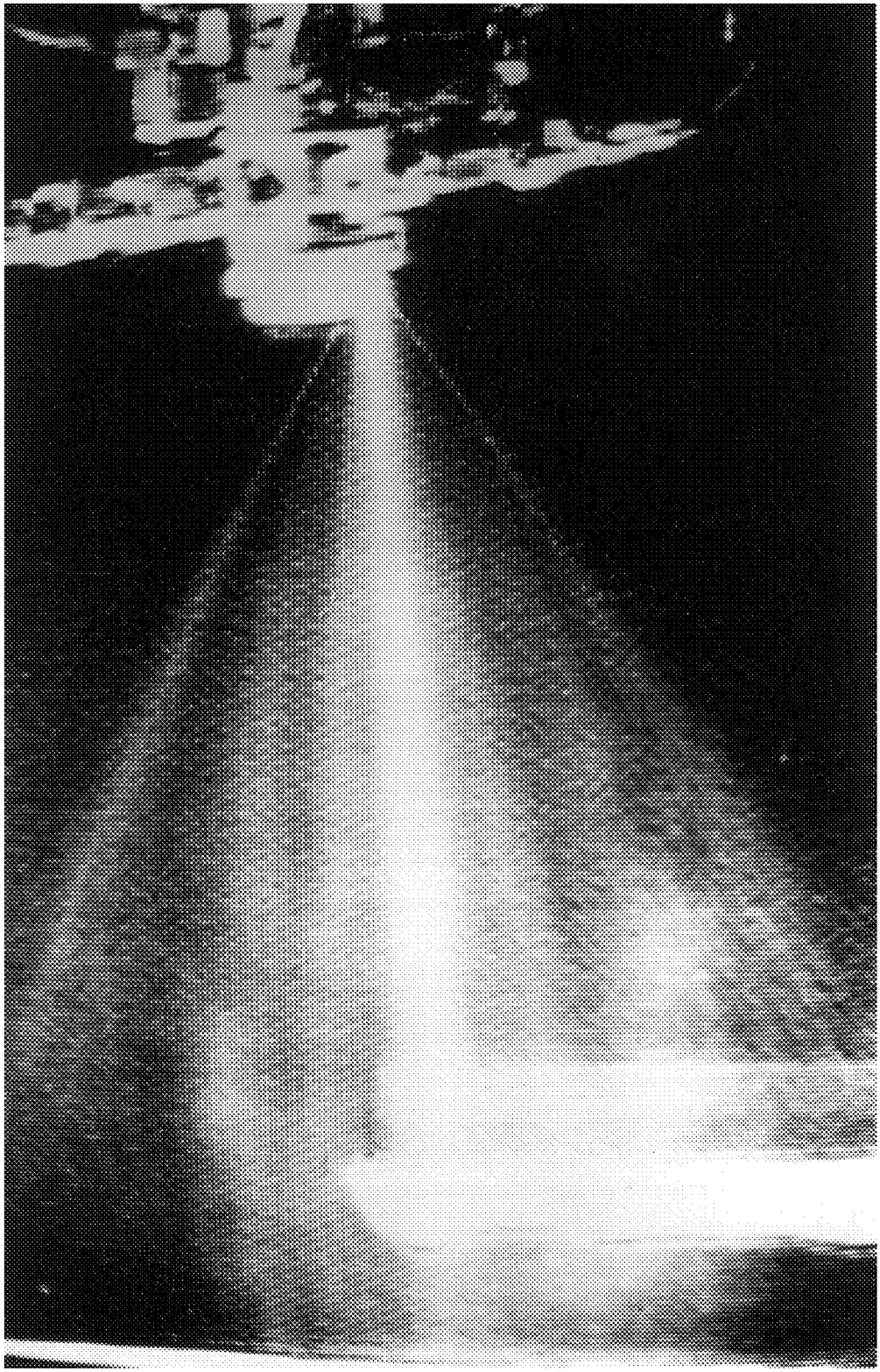

The ability to obtain a feathered spray pattern and a decompressive spray also depends upon the molecular weight profile of the coating composition, as noted above. FIGS. 7*a* and 7*b* illustrate the transition that may occur from a feathered spray to a fishtail liquid-film spray as the molecular weight of the polymer system increases such as due to catalyzed cross-linking reaction occurring in the coating composition, with other factors remaining the same. The coating composition is a clear air-dry alkyd-urea catalyzed conversion coating that had a polymer content of 69%, an initial alkyd number-average molecular weight of 1,980, and an initial viscosity of 1080 centipoise before catalyst was added. FIG. 7*a* shows the feathered spray produced by a subcritical compressed carbon dioxide concentration of about 30%, a spray temperature of 26 C., and a spray pressure of 900 psi, after reaction had proceeded for some time. FIG. 7*b* shows the fishtail liquid-film spray that was produced after reaction had proceeded further and the molecular weight had substantially increased, as evident from the large increase in the viscosity of the coating composition. However, the fishtail spray remained even after adding diluent solvent to reduce the viscosity to below its original level. This shows that the transition was due to the increase in molecular weight through reaction and not to the increase in viscosity that this caused.

The liquid mixture of coating composition and subcritical compressed fluid may be prepared for spraying in any of the spray apparatus utilized for spraying coating compositions with supercritical fluids such as are disclosed in U.S. Pat. Nos. 5,190,373; 5,318,225; 5,403,089; and 5,505,539, provided that the apparatus adequately maintains the desired temperature and pressure when using subcritical compressed fluids. The spray apparatus may also be a UNICARB® System Supply Unit manufactured by Nordson Corporation to proportion, mix, heat, and pressurize coating compositions with compressed fluids, such as carbon dioxide for the spray application of coatings.

While preferred forms of the present invention have been described, it should be apparent to those skilled in the art that methods may be employed that are different from those shown without departing from the spirit and scope thereof.

EXAMPLE 1

A coating formulation that has a solids content of 75.87% and a viscosity of 1100 centipoise (23 C.) and that gives a clear acrylic coating was prepared from Rohm & Haas Acryloid™ AT-954 resin, which contains 85% nonvolatile acrylic polymer dissolved in 15% methyl amyl ketone solvent, and American Cyanamid Cymel™ 323 resin, which is a cross-linking agent that contains 80% nonvolatile melamine polymer dissolved in 20% isobutanol solvent, by mixing the resins with solvents ethyl 3-ethoxypropionate (EEP) and acetone and with 50% Union Carbide silicone surfactant L7605 dissolved in xylene, in the following proportions:

| | | |
|---|---|---|
| Acryloid AT-954 | 10,500.0 g | 67.48% |
| Cymel 323 | 3,600.0 g | 23.14% |
| EEP | 840.0 g | 5.40% |
| acetone | 560.0 g | 3.60% |
| 50% L7605 in xylene | 60.0 g | 0.38% |
| Total | 15,560.0 g | 100.00% |

The acrylic and melamine polymers had the following molecular weights:

| | |
|---|---|
| Acryloid AT-954 | |
| Molecular weight | 6,070 weight average (Mw) |
| Molecular weight | 1,670 number average (Mn) |
| Mw/Mn | 3.63 |
| Cymel 323 | |
| Molecular weight | 490 weight average (Mw) |
| Molecular weight | 410 number average (Mn) |
| Mw/Mn | 1.20 |

The coating formulation contained 75.87% solids fraction and 24.13% solvent and surfactant fraction, with the following component composition:

| | | |
|---|---|---|
| AT-954 polymer | 8,925.0 g | 57.36% |
| Cymel 323 polymer | 2,880.0 g | 18.51% |
| methyl amyl ketone | 1,575.0 g | 10.12% |
| EEP | 840.0 g | 5.40% |
| isobutanol | 720.0 g | 4.63% |
| acetone | 560.0 g | 3.60% |
| xylene | 30.0 g | 0.19% |
| L5310 | 30.0 g | 0.19% |
| Total | 15,560.0 g | 100.00% |

The solids fraction had the following composition:

| | | |
|---|---|---|
| AT-954 polymer | 8,925.0 g | 75.60% |
| Cymel 323 polymer | 2,880.0 g | 24.40% |
| Total | 11,805.0 g | 100.00% |

The solvent fraction had the following composition and relative evaporation rates (butyl acetate=100):

| Solvent | Grams | Wt. % | RER |
|---|---|---|---|
| acetone | 560.0 g | 15.03% | 1440 |
| isobutanol | 720.0 g | 19.33% | 74 |
| xylene | 30.0 g | 0.81% | 70 |
| methyl amyl ketone | 1,575.0 g | 42.28% | 40 |
| EEP | 840.0 g | 22.55% | 11 |
| Total | 3,725.0 g | 100.00% | |

The solvent fraction had the following distribution of solvent by relative evaporation rate:

| | |
|---|---|
| <50 | 65% |
| 50 to 100 | 20% |
| 101 to 250 | 0% |
| >250 | 15% |

The coating formulation had the following properties:

| | |
|---|---|
| Solvent content | 247 grams/liter |
| Relative evap. rate | 29 (butyl acetate = 100) |
| Viscosity | 1100 centipoise (23 C) |
| Weight solids | 75.87 percent |
| Liquid density | 1023 grams/liter |

Spray experiments were done using Bonderite™ 37 polished 24-gauge steel test panels, 6-inch by 12-inch size. The test panels were sprayed, flashed, and baked in a vertical orientation. Coating thickness was measured using a Microtest™ III Magnetic Coating Thickness Meter (Paul N. Gardner Company, Pompano Beach, Fla.). Coating gloss was measured using a Macbeth™ Novo-Gloss™ 20-degree Glossmeter (Paul N. Gardner Company, Pompano Beach, Fla.). Coating distinctness of image (DOI) was measured using a Model #300 Distinctness of Image Meter (Mechanical Design and Engineering Company, Burton, Mich.) and a Model #1792 Distinctness of Reflected Image Meter (ATI Systems, Madison Heights, Mich.).

A spray mixture was prepared and sprayed in the continuous mode by admixing the coating formulation with the desired proportion of compressed carbon dioxide, both pressurized to the desired spray pressure. The spray mixture had a compressed carbon dioxide content of 29.2% by weight.

The spray mixture was sprayed using a Nordson™ A7A airless automatic spray gun with Spraying Systems tip #400011, which has a 9-mil orifice size, a 40-degree spray angle rating, and a 7-inch fan width rating, and with Spraying Systems minimum cavity tip insert #15153-NY. The distance from the spray tip to the panel was twelve inches. Panels were sprayed using a Model #310540 Automatic Test Panel Spray Unit (Spraymation, Fort Lauderdale, Fla.).

At a spray temperature equal to the ambient temperature of 24.0 C. and at a spray pressure of 1600 psi, a fishtail spray pattern was produced with atomization occurring from a visible liquid-film that extended from the spray orifice. The spray fan was angular in shape and had a fan width of about nine inches. Decreasing the spray pressure to 900 psi produced a spray pattern in transition between a fishtail spray and a feathered spray. The liquid film was no longer visible. Increasing the spray temperature to 27.4 C. at a spray pressure of 900 psi produced a much wider fully feathered flat spray fan that was parabolic in shape and that left the orifice at a very large angle. The fan width was about 14 inches.

At the spray temperature of 27.4 C., compressed carbon dioxide has a vapor pressure of 984 psi and has equilibrium gas and liquid densities of 0.27 and 0.66 g/cc, respectively. Therefore, at the spray pressure of 900 psi, the spray mixture contained coating formulation admixed with compressed carbon dioxide gas. The spray mixture was a clear single-phase liquid solution. Therefore, all of the compressed carbon dioxide gas was dissolved in the coating formulation.

Panels were sprayed at the above conditions using a spray index distance of three inches and various spray traverse rates to produce coatings of various thickness. The panels were flashed for several minutes and then baked in an oven at a temperature of 125 C. for at least thirty minutes. The baked coatings had the following properties:

| Coating Thickness | 20-Degree Gloss | MDEC DOI | ATI DOI |
|---|---|---|---|
| 1.0 mil | 90% | 80% | 48% |
| 1.0 mil | 91% | 80% | 52% |
| 1.4 mil | 91% | 85% | 56% |
| 1.5 mil | 92% | 85% | 60% |
| 1.8 mil | 92% | 90% | 68% |
| 2.0 mil | 93% | 90% | 72% |
| 2.5 mil | 95% | 90% | 73% |
| 2.5 mil | 95% | 90% | 75% |
| 3.0 mil | 94% | 90% | 76% |
| 3.0 mil | 94% | 92% | 78% |

Panels were also sprayed at a spray temperature of 28.0 C. and a spray pressure of 900 psi. These coatings had the following properties:

| Coating Thickness | 20-Degree Gloss | MDEC DOI | ATI DOI |
|---|---|---|---|
| 1.1 mil | 90% | 80% | 53% |
| 1.4 mil | 90% | 85% | 58% |

-continued

| Coating Thickness | 20-Degree Gloss | MDEC DOI | ATI DOI |
|---|---|---|---|
| 1.7 mil | 94% | 90% | 67% |
| 2.4 mil | 94% | 90% | 77% |
| 3.5 mil | 94% | 92% | 79% |

The polymeric coatings were clear and had very good appearance. They were very smooth with high gloss and high distinctness of image. They were free of haze and bubbles and even the very thick coatings did not run or sag or have solvent popping.

EXAMPLE 2

A coating formulation that has a solids content of 74.77% and a viscosity of 1340 centipoise (23 C.) and that gives a clear acrylic coating was prepared from Acryloid™ AT-954 resin and Cymel™ 323 resin by mixing the resins with solvents ethyl 3-ethoxypropionate (EEP) and methyl amyl ketone and with 50% surfactant L7605 in xylene, in the following proportions:

| | | |
|---|---|---|
| Acryloid AT-954 | 10,500.0 g | 66.50% |
| Cymel 323 | 3,600.0 g | 22.80% |
| EEP | 840.0 g | 5.32% |
| methyl amyl ketone | 789.5 g | 5.00% |
| 50% L7605 in xylene | 60.0 g | 0.38% |
| Total | 15,789.5 g | 100.00% |

The acrylic polymer had the following molecular weight:

| | |
|---|---|
| Molecular weight | 6,070 weight average (Mw) |
| Molecular weight | 1,670 number average (Mn) |
| Mw/Mn | 3.63 |

The coating formulation contained 74.77% solids fraction and 25.23% solvent and surfactant fraction, with the following component composition:

| | | |
|---|---|---|
| AT-954 polymer | 8,925.0 g | 56.53% |
| Cymel 323 polymer | 2,880.0 g | 18.24% |
| methyl amyl ketone | 2,364.5 g | 14.97% |
| EEP | 840.0 g | 5.32% |
| isobutanol | 720.0 g | 4.56% |
| xylene | 30.0 g | 0.19% |
| L5310 | 30.0 g | 0.19% |
| Total | 15,789.5 g | 100.00% |

The solids fraction had the following composition:

| | | |
|---|---|---|
| AT-954 polymer | 8,925.0 g | 75.60% |
| Cymel 323 polymer | 2,880.0 g | 24.40% |
| Total | 11,805.0 g | 100.00% |

The solvent fraction had the following composition and relative evaporation rates (butyl acetate=100):

| Solvent | Grams | Wt. % | RER |
|---|---|---|---|
| isobutanol | 720.0 g | 18.21% | 74 |
| xylene | 30.0 g | 0.76% | 70 |
| methyl amyl ketone | 2,364.5 g | 59.79% | 40 |
| EEP | 840.0 g | 21.24% | 11 |
| Total | 3,954.5 g | 100.00% | |

The solvent fraction had the following distribution of solvent by relative evaporation rate:

| | |
|---|---|
| <50 | 81% |
| 50 to 100 | 19% |
| 101 to 250 | 0% |
| >250 | 0% |

The coating formulation had the following properties:

| | |
|---|---|
| Solvent content | 258 grams/liter |
| Relative evap. rate | 27 (butyl acetate = 100) |
| Viscosity | 1340 centipoise (23 C) |
| Weight solids | 74.77 percent |
| Liquid density | 1021 grams/liter |

Spray mixtures were prepared and sprayed in the continuous mode by admixing the coating formulation with the desired proportion of compressed carbon dioxide, both pressurized to the desired spray pressure. The spray mixtures had compressed carbon dioxide contents of 28–30% by weight.

The spray mixtures were sprayed at or near ambient temperature (24–26 C.) with spray pressures of 900–950 psi using a Nordson™ A7A airless automatic spray gun with a variety of airless spray tips from several manufacturers and having a range of orifice sizes and fan width ratings. The distance from the spray tip to the panel was twelve inches. Panels were sprayed using a Spraymation automatic sprayer. The sprays were all feathered flat spray fans that were parabolic in shape and that left the orifice at a very large angle. The panels were flashed for several minutes and then baked in an oven at a temperature of 125 C. for at least thirty minutes.

At the spray temperatures used, compressed carbon dioxide has the following vapor pressures and equilibrium gas and liquid densities:

| Temperature | Vapor Pressure | Gas Density | Liquid Density |
|---|---|---|---|
| 24 C. | 908 psi | 0.23 g/cc | 0.72 g/cc |
| 25 C. | 930 psi | 0.24 g/cc | 0.70 g/cc |
| 26 C. | 951 psi | 0.25 g/cc | 0.69 g/cc |

Therefore, at all the combinations of spray temperatures and pressures used, the spray mixtures contained coating formulation admixed with compressed carbon dioxide that was at or very near the equilibrium conditions where gas and liquid exist together. The spray mixtures were clear single-phase liquid solutions. Therefore, all of the compressed carbon dioxide mixture of gas and liquid was dissolved in the coating formulation.

At a spray temperature of 25 C. and a spray pressure of 950 psi, coatings with different thicknesses were sprayed using the following Spraying Systems tips: 1) tip #250004, which has a 5-mil orifice size, a 25-degree fan angle rating, and a 5-inch fan width rating, and 2) tip #400006, which has a 6-mil orifice size, a 40-degree fan angle rating, and a 6.5-inch fan width rating. Minimum cavity insert #15153-NY was used in each tip. The coatings had the following properties:

| Tip | Coating Thickness | 20-Degree Gloss | MDEC DOI | ATI DOI |
|---|---|---|---|---|
| 1 | 0.3 mil | 70% | 70% | 33% |
| 1 | 0.7 mil | 86% | 80% | 46% |
| 1 | 1.2 mil | 91% | 90% | 70% |
| 1 | 2.6 mil | 92% | 90% | 73% |
| 2 | 0.3 mil | 40% | 50% | 12% |
| 2 | 0.7 mil | 85% | 75% | 43% |
| 2 | 1.1 mil | 91% | 85% | 58% |
| 2 | 1.2 mil | 91% | 85% | 56% |
| 2 | 2.0 mil | 94% | 90% | 73% |

At a spray temperature of 25 C. and a spray pressure of 950 psi, coatings were sprayed using the following spray tips, each of which has a 7-mil orifice size: 1) Binks tip #9-0730, which has a 25-degree fan angle rating and a 5.5-inch fan width rating, 2) Nordson™ tip #0003-06 with turbulence plate #027-003, which has a 30-degree fan angle rating and a 6-inch fan width rating, and 3) Binks tip #9-0740, which has a 40-degree fan angle rating and a 6.5-inch fan width rating. The coatings had the following properties:

| Tip | Coating Thickness | 20-Degree Gloss | MDEC DOI | ATI DOI |
|---|---|---|---|---|
| 1 | 0.4 mil | 47% | 55% | 18% |
| 1 | 0.7 mil | 84% | 70% | 40% |
| 1 | 1.0 mil | 91% | 85% | 57% |
| 1 | 1.4 mil | 91% | 85% | 54% |
| 1 | 1.6 mil | 93% | 90% | 75% |
| 2 | 1.0 mil | 90% | 80% | 48% |
| 2 | 1.3 mil | 92% | 80% | 53% |
| 2 | 1.6 mil | 92% | 90% | 66% |
| 3 | 0.4 mil | 64% | 55% | 18% |
| 3 | 0.8 mil | 87% | 80% | 46% |
| 3 | 1.4 mil | 92% | 85% | 60% |
| 3 | 1.5 mil | 91% | 85% | 58% |
| 3 | 1.8 mil | 93% | 90% | 76% |

At a spray temperature of 24 C and a spray pressure of 900 psi, coatings were sprayed using the following spray tips, each of h has a 9-mil orifice size: 1) Spraying Systems tip #400011 with insert #15153-NY, which has a 40-degree fan angle rating and a 7-inch fan width rating and 2) Graco™ tip #163–409, which has a 50-degree fan angle rating and a 9-inch fan width rating. The coatings had the following properties:

| Tip | Coating Thickness | 20-Degree Gloss | MDEC DOI | ATI DOI |
|---|---|---|---|---|
| 1 | 1.0 mil | 88% | 80% | 49% |
| 1 | 1.6 mil | 93% | 90% | 74% |

-continued

| Tip | Coating Thickness | 20-Degree Gloss | MDEC DOI | ATI DOI |
|---|---|---|---|---|
| 1 | 1.6 mil | 94% | 90% | 74% |
| 2 | 1.1 mil | 88% | 75% | 45% |
| 2 | 1.6 mil | 93% | 90% | 66% |
| 2 | 2.5 mil | 94% | 90% | 73% |

At a spray temperature of 26 C and a spray pressure of 950 psi, coatings were sprayed using Spraying Systems tip #400011 with insert #15153-NY, which has a 40-degree fan angle rating and a 7-inch fan width rating. The coatings had the following properties:

| Coating Thickness | 20-Degree Gloss | MDEC DOI | ATI DOI |
|---|---|---|---|
| 0.6 mil | 78% | 65% | 31% |
| 1.3 mil | 91% | 80% | 51% |
| 1.5 mil | 91% | 85% | 55% |
| 1.8 mil | 94% | 90% | 72% |
| 2.5 mil | 94% | 85% | 65% |
| 3.0 mil | 95% | 85% | 62% |

The polymeric coatings were clear and had very good appearance. They were smooth with high gloss and high distinctness of image. They were free of haze and bubbles and even the very thick coatings did not run or sag or have solvent popping.

EXAMPLE 3

The coating formulation and spray mixture used in Example 2 was sprayed at a temperature of 26 C and a pressure of 950 psi using a Graco™ AA3000 air-assist airless automatic spray gun with tip #309, which has a 9-mil orifice size and a 7-inch fan width rating. Coatings were sprayed to different thicknesses using no air assist and using air-assist at different air pressures. The coatings had the following properties:

| Coating Thickness | 20-Degree Gloss | MDEC DOI | ATI DOI | Air Pressure |
|---|---|---|---|---|
| 0.9 mil | 83% | 80% | 47% | 0 psi |
| 1.7 mil | 93% | 85% | 62% | 0 psi |
| 2.3 mil | 88% | 85% | 55% | 0 psi |
| 2.8 mil | 90% | 80% | 52% | 0 psi |
| 3.4 mil | 95% | 90% | 76% | 0 psi |
| 1.2 mil | 91% | 80% | 53% | 10 psi |
| 2.0 mil | 93% | 90% | 72% | 10 psi |
| 2.5 mil | 92% | 90% | 74% | 10 psi |
| 3.0 mil | 94% | 90% | 70% | 10 psi |
| 3.5 mil | 93% | 90% | 73% | 10 psi |
| 1.5 mil | 92% | 85% | 55% | 20 psi |
| 2.3 mil | 93% | 90% | 72% | 20 psi |
| 3.3 mil | 94% | 90% | 75% | 20 psi |
| 3.6 mil | 93% | 90% | 77% | 20 psi |
| 2.4 mil | 94% | 85% | 65% | 30 psi |
| 3.5 mil | 94% | 85% | 64% | 30 psi |
| 3.8 mil | 92% | 90% | 69% | 30 psi |
| 4.0 mil | 94% | 90% | 76% | 30 psi |

The polymeric coatings were clear and had good appearance. They were smooth with high gloss and good distinctness of image. They were free of haze and bubbles and did not run or sag or have solvent popping.

EXAMPLE 4

A coating formulation that has a solids content of 68.75% and a viscosity of 940 centipoise (23 C) and that gives a clear acrylic coating was prepared from Acryloid™ AT-954 resin and Cymel™ 323 resin by mixing the resins with solvents methyl isobutyl ketone (MIBK), ethyl 3-ethoxypropionate (EEP), and methyl amyl ketone and with 50% surfactant L7605 dissolved in xylene, in the following proportions:

| | | |
|---|---|---|
| Acryloid AT-954 | 10,500.0 g | 61.16% |
| Cymel 323 | 3,600.0 g | 20.97% |
| MIBK | 1,545.0 g | 9.00% |
| EEP | 840.0 g | 4.89% |
| methyl amyl ketone | 625.0 g | 3.64% |
| 50% L7605 in xylene | 60.0 g | 0.35% |
| Total | 17,170.0 g | 100.00% |

The acrylic polymer had the following molecular weight:

| Acryloid AT-954 | |
|---|---|
| Molecular weight | 6,070 weight average (Mw) |
| Molecular weight | 1,670 number average (Mn) |
| Mw/Mn | 3.63 |

The coating formulation contained 68.75% solids fraction and 31.25% solvent and surfactant fraction, with the following component composition:

| | | |
|---|---|---|
| AT-954 polymer | 8,925.0 g | 51.98% |
| Cymel 323 polymer | 2,880.0 g | 16.77% |
| methyl amyl ketone | 2,200.0 g | 12.81% |
| MIBK | 1,545.0 g | 9.00% |
| EEP | 840.0 g | 4.89% |
| isobutanol | 720.0 g | 4.19% |
| xylene | 30.0 g | 0.18% |
| L5310 | 30.0 g | 0.18% |
| Total | 17,170.0 g | 100.00% |

The solids fraction had the following composition:

| | | |
|---|---|---|
| AT-954 polymer | 8,925.0 g | 75.60% |
| Cymel 323 polymer | 2,880.0 g | 24.40% |
| Total | 11,805.0 g | 100.00% |

The solvent fraction had the following composition and relative evaporation rates (butyl acetate=100):

| Solvent | Grams | Wt. % | RER |
|---|---|---|---|
| MIBK | 1,545.0 g | 28.96% | 162 |
| isobutanol | 720.0 g | 13.50% | 74 |
| xylene | 30.0 g | 0.56% | 70 |

-continued

| Solvent | Grams | Wt. % | RER |
|---|---|---|---|
| methyl amyl ketone | 2,200.0 g | 41.23% | 40 |
| EEP | 840.0 g | 15.75% | 11 |
| Total | 5,335.0 g | 100.00% | |

The solvent fraction had the following distribution of solvent by relative evaporation rate:

| | |
|---|---|
| <50 | 57% |
| 50 to 100 | 14% |
| 101 to 250 | 29% |
| >250 | 0% |

The coating formulation had the following properties:

| | |
|---|---|
| Solvent content | 312 grams/liter |
| Relative evap. rate | 35 (butyl acetate = 100) |
| Viscosity | 940 centipoise (23 C) |
| Weight solids | 68.75 percent |
| Liquid density | 997 grams/liter |

A spray mixture was prepared and sprayed in the continuous mode by admixing the coating formulation with the desired proportion of compressed carbon dioxide, both pressurized to the desired spray pressure. The spray mixture had a compressed carbon dioxide content of 26.6% by weight.

The spray mixture was sprayed at the ambient temperature of 25.5 C and at a spray pressure of 950 psi using a Nordson™ A7A airless automatic spray gun with Binks tip #9-0940, which has a 9-mil orifice size, a 40-degree spray angle rating, and a 7-inch fan width rating, and with Spraying Systems tip insert #15153-NY. The distance from the spray tip to the panel was twelve inches. Panels were sprayed using a Spraymation automatic sprayer.

At the spray temperature of 25.5 C, compressed carbon dioxide has a vapor pressure of 940 psi and has equilibrium gas and liquid densities of 0.25 and 0.70 g/cc, respectively. Therefore, at the spray pressure of 950 psi, the spray mixture contained coating formulation admixed with compressed carbon dioxide that was on the liquid side of the equilibrium conditions. The spray mixture was a clear single-phase liquid solution. Therefore, all of the liquid compressed carbon dioxide was dissolved in the coating formulation.

The spray mixture produced a wide feathered flat spray fan that was parabolic in shape and that left the orifice at a very large angle. The fan width was about 12 inches. Panels were sprayed and the baked coatings had the following properties:

| Coating Thickness | 20-Degree Gloss | MDEC DOI | ATI DOI |
|---|---|---|---|
| 0.5 mil | 72% | 65% | 29% |
| 0.9 mil | 91% | 80% | 50% |
| 1.0 mil | 92% | 80% | 55% |
| 1.0 mil | 92% | 80% | 52% |
| 1.1 mil | 90% | 80% | 47% |
| 1.2 mil | 91% | 80% | 53% |
| 1.4 mil | 95% | 85% | 62% |

The polymeric coatings were clear, thin, smooth, free of haze and bubbles, and had good appearance and high gloss.

EXAMPLE 5

The coating formulation, spray mixture, and spray conditions used in Example 4 were used with a Graco™ AA3000 air-assist airless automatic spray gun with tip #309, which has a 9-mil orifice size and a 7-inch fan width rating. The spray produced a fan width of about 14 inches. Coatings were sprayed without and with air assist and they had the following properties:

| Coating Thickness | 20-Degree Gloss | MDEC DOI | ATI DOI | Air Pressure |
|---|---|---|---|---|
| 1.3 mil | 91% | 85% | 63% | 0 psi |
| 1.5 mil | 93% | 85% | 63% | 10 psi |
| 1.8 mil | 94% | 80% | 47% | 10 psi |
| 2.2 mil | 93% | 80% | 52% | 10 psi |
| 2.5 mil | 94% | 80% | 60% | 10 psi |

The polymeric coatings were clear, smooth, free of haze and bubbles, and had good appearance and high gloss.

EXAMPLE 6

A coating formulation that has a solids content of 76.50% and a viscosity of 1800 centipoise and that gives a clear acrylic coating was prepared from Acryloid™ AT-954 resin and Cymel™ 323 resin by mixing the resins with solvents ethyl 3-ethoxypropionate (EEP) and methyl amyl ketone and with 50% surfactant L7605 in xylene, in the following proportions:

| | | |
|---|---|---|
| Acryloid AT-954 | 10,500.0 g | 68.04% |
| Cymel 323 | 3,600.0 g | 23.33% |
| EEP | 840.0 g | 5.44% |
| methyl amyl ketone | 431.5 g | 2.80% |
| 50% L7605 in xylene | 60.0 g | 0.39% |
| Total | 15,431.5 g | 100.00% |

The acrylic polymer had the following molecular weight:

| | |
|---|---|
| Molecular weight | 6,070 weight average (Mw) |
| Molecular weight | 1,670 number average (Mn) |
| Mw/Mn | 3.63 |

The coating formulation contained 76.50% solids fraction and 23.50% solvent and surfactant fraction, with the following component composition:

| | | |
|---|---|---|
| AT-954 polymer | 8,925.0 g | 57.84% |
| Cymel 323 polymer | 2,880.0 g | 18.67% |
| methyl amyl ketone | 2,006.5 g | 13.00% |
| EEP | 840.0 g | 5.44% |
| isobutanol | 720.0 g | 4.67% |
| xylene | 30.0 g | 0.19% |
| L5310 | 30.0 g | 0.19% |
| Total | 15,431.5 g | 100.00% |

The solids fraction had the following composition:

| | | |
|---|---|---|
| AT-954 polymer | 8,925.0 g | 75.60% |
| Cymel 323 polymer | 2,880.0 g | 24.40% |
| Total | 11,805.0 g | 100.00% |

The solvent fraction had the following composition and relative evaporation rates (butyl acetate=100):

| Solvent | Grams | Wt. % | RER |
|---|---|---|---|
| isobutanol | 720.0 g | 20.02% | 74 |
| xylene | 30.0 g | 0.83% | 70 |
| methyl amyl ketone | 2,006.5 g | 55.79% | 40 |
| EEP | 840.0 g | 23.36% | 11 |
| Total | 3,596.5 g | 100.00% | |

The solvent fraction had the following distribution of solvent by relative evaporation rate:

| | |
|---|---|
| <50 | 79% |
| 50 to 100 | 21% |
| 101 to 250 | 0% |
| >250 | 0% |

The coating formulation had the following properties:

| | |
|---|---|
| Solvent content | 241 grams/liter |
| Relative evap. rate | 26 (butyl acetate = 100) |
| Viscosity | 1800 centipoise |
| Weight solids | 76.50 percent |
| Liquid density | 1025 grams/liter |

Spray mixtures were prepared and sprayed in the continuous mode by admixing the coating formulation with the desired proportion of compressed carbon dioxide, both pressurized to the desired spray pressure. Spray mixtures were used with compressed carbon dioxide contents of 31%, 30%, and 29% by weight.

Spraying was done under identical conditions to compare airless spraying 1) with no air assist, using the Nordson™ A7A automatic gun with Binks tip #9-0940, and 2) with air assist, using the Graco™ AA3000 automatic gun with tip #309. Both tips have a 9-mil orifice size and a 7-inch fan width rating. Panels were sprayed in an identical manner using the Spraymation automatic sprayer.

With a compressed carbon dioxide concentration of 31%, at the ambient temperature of 24 C and a spray pressure of 900 psi, the sprays were in transition between a fishtail spray and a feathered spray. Increasing the spray temperature to 27 C produced feathered parabolic-shaped sprays with fan widths of 12–14 inches. At this temperature, compressed carbon dioxide has a vapor pressure of 973 psi and has equilibrium gas and liquid densities of 0.27 and 0.67 g/cc, respectively. Therefore, at the spray pressure of 900 psi, the spray mixture contained coating formulation admixed with compressed carbon dioxide gas. The concentration of carbon dioxide in the spray mixture was at the solubility limit for these conditions. Coatings were sprayed first using the Nordson™ gun (no air assist) and then the Graco™ gun (air assist). The coatings had the following properties:

| Gun | Coating Thickness | 20-Degree Gloss | MDEC DOI | ATI DOI | Air Pressure |
|---|---|---|---|---|---|
| 1 | 1.8 mil | 88% | 80% | 50% | 0 psi |
| 2 | 1.8 mil | 90% | 85% | 64% | 5 psi |
| 2 | 1.9 mil | 91% | 90% | 66% | 15 psi |

The coatings sprayed with air assist had noticeably better appearance.

Increasing the spray temperature to 28 C at a spray pressure of 900 psi produced a two-phase spray mixture. At this temperature, compressed carbon dioxide has a vapor pressure of 995 psi and has equilibrium gas and liquid densities of 0.28 and 0.65 g/cc, respectively. Therefore, the spray mixture contained coating formulation admixed with compressed carbon dioxide gas in excess of the solubility limit, so that gas bubbles were finely dispersed in the liquid spray mixture. The coatings had the following properties:

| Gun | Coating Thickness | 20-Degree Gloss | MDEC DOI | ATI DOI | Air Pressure |
|---|---|---|---|---|---|
| 1 | 1.8 mil | 90% | 80% | 49% | 0 psi |
| 2 | 2.0 mil | 89% | 85% | 55% | 5 psi |
| 2 | 2.0 mil | 90% | 85% | 63% | 15 psi |

The coatings sprayed with air assist had noticeably better appearance.

Decreasing the carbon dioxide concentration to 30% at the spray temperature of 28 C and spray pressure of 900 psi brought the spray mixture back to the carbon dioxide solubility limit, as seen by just a trace of fine gas bubbles. The coatings had the following properties:

| Gun | Coating Thickness | 20-Degree Gloss | MDEC DOI | ATI DOI | Air Pressure |
|---|---|---|---|---|---|
| 1 | 1.8 mil | 90% | 80% | 52% | 0 psi |
| 2 | 1.8 mil | 90% | 85% | 55% | 5 psi |
| 2 | 1.8 mil | 91% | 85% | 63% | 15 psi |

The coatings sprayed with air assist had noticeably better appearance.

Decreasing the carbon dioxide concentration to 30% and increasing the spray temperature to 29 C at the spray pressure of 900 psi produced a clear single-phase spray mixture. At this temperature, compressed carbon dioxide has a gas pressure of 1017 psi and has equilibrium gas and liquid densities of 0.30 and 0.63 g/cc, respectively. Therefore, the spray mixture contained coating formulation admixed with compressed carbon dioxide gas in an amount below the solubility limit at these conditions. The coatings had the following properties:

| Gun | Coating Thickness | 20-Degree Gloss | MDEC DOI | ATI DOI | Air Pressure |
|---|---|---|---|---|---|
| 1 | 1.7 mil | 89% | 80% | 51% | 0 psi |
| 2 | 1.9 mil | 92% | 85% | 59% | 5 psi |
| 2 | 1.9 mil | 90% | 85% | 62% | 15 psi |

The coatings sprayed with air assist had noticeably better appearance.

EXAMPLE 7

A coating formulation that has a high solids content of 78.70% and a high viscosity of 3000 centipoise and that gives a clear acrylic coating was prepared by mixing Acryloid™ AT-954 resin and Cymel™ 323 resin with ethyl 3-ethoxypropionate (EEP) solvent and with 50% surfactant L7605 in xylene, in the following proportions:

| | | |
|---|---|---|
| Acryloid AT-954 | 10,500.0 g | 70.00% |
| Cymel 323 | 3,600.0 g | 24.00% |
| EEP | 840.0 g | 5.60% |
| 50% L7605 in xylene | 60.0 g | 0.40% |
| Total | 15,000.0 g | 100.00% |

The acrylic polymer had the following molecular weight:

| | |
|---|---|
| Molecular weight | 6,070 weight average (Mw) |
| Molecular weight | 1,670 number average (Mn) |
| Mw/Mn | 3.63 |

The coating formulation contained 78.70% solids fraction and 21.30% solvent and surfactant fraction, with the following component composition:

| | | |
|---|---|---|
| AT-954 polymer | 8,925.0 g | 59.50% |
| Cymel 323 polymer | 2,880.0 g | 19.20% |
| methyl amyl ketone | 1,575.0 g | 10.50% |
| EEP | 840.0 g | 5.60% |
| isobutanol | 720.0 g | 4.80% |
| xylene | 30.0 g | 0.20% |
| L5310 | 30.0 g | 0.20% |
| Total | 15,000.0 g | 100.00% |

The solids fraction had the following composition:

| | | |
|---|---|---|
| AT-954 polymer | 8,925.0 g | 75.60% |
| Cymel 323 polymer | 2,880.0 g | 24.40% |
| Total | 11,805.0 g | 100.00% |

The solvent fraction had the following composition and relative evaporation rates (butyl acetate=100):

| Solvent | Grams | Wt. % | RER |
|---|---|---|---|
| isobutanol | 720.0 g | 22.75% | 74 |
| xylene | 30.0 g | 0.95% | 70 |
| methyl amyl ketone | 1,575.0 g | 49.76% | 40 |
| EEP | 840.0 g | 26.54% | 11 |
| Total | 3,165.0 g | 100.00% | |

The solvent fraction had the following distribution of solvent by relative evaporation rate:

| | |
|---|---|
| <50 | 76% |
| 50 to 100 | 24% |

-continued

| | |
|---|---|
| 101 to 250 | 0% |
| >250 | 0% |

The coating formulation had the following properties:

| | |
|---|---|
| Solvent content | 219 grams/liter |
| Relative evap. rate | 25 (butyl acetate = 100) |
| Viscosity | 3000 centipoise |
| Weight solids | 78.70 percent |
| Liquid density | 1030 grams/liter |

Spray mixtures were prepared and sprayed in the continuous mode by admixing the coating formulation with the desired proportion of compressed carbon dioxide, both pressurized to the desired spray pressure. Spraying was done using either 1) the Nordson™ A7A airless spray gun with Binks tip #9-0940 or 2) the Graco™ AA3000 air-assist airless spray gun with tip #309. Both tips have a 9-mil orifice size and a 7-inch fan width rating. Panels were sprayed using the Spraymation automatic sprayer.

With a carbon dioxide concentration of 28% by weight, at the ambient temperature of 23.5 C and a spray pressure of 1700 psi, both spray guns produced a fishtail spray pattern with atomization occurring from a visible liquid-film that extended from the spray orifice. The spray fan was angular in shape and had a fan width of 7 inches for the Nordson™ gun and 9 inches for the Graco™ gun, with and without air assist. Spraying panels produced coatings that were thick layers of foam, which persisted through flashing and baking. Decreasing the spray pressure to 1500 psi produced the same results. Decreasing the spray pressure to 1300 psi produced the same result for the Graco™ gun but the spray from the Nordson™ gun entered into transition from a fishtail to a feathered spray and became a three-pronged jet with a width of 7 inches and no visible liquid film. Decreasing the spray pressure to 1100 psi narrowed the jetting from the Nordson™ gun to a width of 4 inches. The spray from the Graco™ gun entered transition and narrowed to a width of 3 inches with no air assist but maintained a width of 8 inches with an air-assist pressure of 20 psi. Decreasing the spray pressure to 900 psi produced a two-pronged jet with a width of 2 inches from the Nordson™ gun and produced a single jet with a width of 1 inch from the Graco™ gun, both with and without air assist. The narrow jets were transformed into wide feathered sprays at the spray pressure of 900 psi by either 1) increasing the spray temperature to 28 C at the same carbon dioxide concentration of 28% or 2) increasing the spray temperature to 25 C and increasing the carbon dioxide concentration to 30%.

At a carbon dioxide concentration of 28%, spray temperature of 28 C, and spray pressure of 900 psi, the Nordson™ gun produced a wide feathered flat spray fan that was parabolic in shape, that left the orifice at a very large angle, and that was uniform and had no jetting. The fan width was 12 inches. The spray mixture contained two phases. At this temperature, compressed carbon dioxide has a vapor pressure of 995 psi and has equilibrium gas and liquid densities of 0.28 and 0.65 g/cc, respectively. Therefore, the spray mixture contained coating formulation admixed with compressed carbon dioxide gas in excess of the solubility limit, so that gas bubbles were finely dispersed in the liquid spray mixture. A coating was sprayed that had the following properties:

| Coating Thickness | 20-Degree Gloss | MDEC DOI | ATI DOI |
|---|---|---|---|
| 2.3 mil | 87% | 80% | 52% |

The coating was smooth, glossy, and free of haze and bubbles. Increasing the spray pressure to 1000 psi, which equals the vapor pressure of carbon dioxide at this temperature, produced a clear single-phase spray solution. Therefore, the spray solution contained coating formulation admixed with compressed carbon dioxide that was at the equilibrium condition where gas and liquid exist together. All of the compressed carbon dioxide mixture of gas and liquid was dissolved in the coating formulation. Coatings were sprayed that had the following properties:

| Coating Thickness | 20-Degree Gloss | MDEC DOI | ATI DOI |
|---|---|---|---|
| 2.3 mil | 92% | 85% | 64% |
| 2.0 mil | 92% | 90% | 71% |

The coatings were smooth, glossy, and free of haze and bubbles. Increasing the spray pressure to 1100 psi, to 1200 psi, to 1300 psi, and then to 1500 psi continued to produce a feathered spray, but jetting appeared in the center of the spray that extended farther from the orifice as the pressure was increased before it dissipated. These pressures exceed the vapor pressure of carbon dioxide at this temperature, so the spray solution contained coating formulation admixed with liquid carbon dioxide. At a pressure of 1500 psi a coating was sprayed with the following properties:

| Coating Thickness | 20-Degree Gloss | MDEC DOI | ATI DOI |
|---|---|---|---|
| 3.0 mil | 88% | 90% | 68% |

The coating was sprayed in the same manner as at the lower pressures and therefore the increased coating thickness was due to the greater spray rate at higher pressure. The coating was smooth, glossy, and free of haze and bubbles. The Graco™ gun was not used at these conditions.

At a carbon dioxide concentration of 30%, spray temperature of 25° C., and spray pressure of 900 psi, both spray guns produced wide feathered flat spray fans that were parabolic in shape, that left the orifice at very large angles, and that were uniform and had no jetting. The fan width was about 10 inches for the Nordson™ gun and about 14 inches for the Graco™ gun. The spray mixture was a clear single-phase solution. At this temperature, compressed carbon dioxide has a vapor pressure of 930 psi and has equilibrium gas and liquid densities of 0.24 and 0.70 g/cc, respectively. Therefore, the spray mixture contained coating formulation admixed with compressed carbon dioxide gas that was completely dissolved. Coatings were sprayed that had the following properties:

| Gun | Coating Thickness | 20-Degree Gloss | MDEC DOI | ATI DOI | Air Pressure |
|---|---|---|---|---|---|
| 1 | 1.3 mil | 86% | 75% | 43% | 0 psi |
| 2 | 1.9 mil | 86% | 75% | 42% | 0 psi |
| 2 | 2.1 mil | 88% | 80% | 47% | 10 psi |
| 2 | 1.9 mil | 89% | 80% | 47% | 30 psi |

The coatings were smooth, glossy, and free of haze and bubbles.

A pigmented coating formulation that has a very high solids content of 81.44% and a viscosity of 540 centipoise (23 C) and that gives a white acrylic coating was prepared from Acryloid™ AT-954 resin and Cymel™ 323 resin by mixing the resins with Dupont Ti-pure™ 960 titanium dioxide pigment, with solvents methyl amyl ketone and acetone, and with Union Carbide silicone surfactant L7602, in the following proportions:

| | | |
|---|---|---|
| Acryloid AT-954 | 6,000.0 g | 38.39% |
| Cymel 323 | 2,036.5 g | 13.03% |
| pigment | 6,000.0 g | 38.39% |
| methyl amyl ketone | 1,123.5 g | 7.19% |
| acetone | 455.0 g | 2.91% |
| L7602 surfactant | 14.0 g | 0.09% |
| Total | 15,629.0 g | 100.00% |

The acrylic polymer had the following molecular weight:

| | |
|---|---|
| Molecular weight | 6,070 weight average (Mw) |
| Molecular weight | 1,670 number average (Mn) |
| Mw/Mn | 3.63 |

The coating formulation contained 81.44% solids fraction and 18.56% solvent and surfactant fraction, with the following component composition:

| | | |
|---|---|---|
| AT-954 polymer | 5,100.0 g | 32.63% |
| Cymel 323 polymer | 1,629.2 g | 10.42% |
| pigment | 6,000.0 g | 38.39% |
| methyl amyl ketone | 2,023.5 g | 12.95% |
| acetone | 455.0 g | 2.91% |
| isobutanol | 407.3 g | 2.61% |
| L7602 | 14.0 g | 0.09% |
| Total | 15,629.0 g | 100.00% |

The solids fraction had the following composition:

| | | |
|---|---|---|
| AT-954 polymer | 5,100.0 g | 40.06% |
| Cymel 323 polymer | 1,629.2 g | 12.80% |
| pigment | 6,000.0 g | 47.14% |
| Total | 12,729.2 g | 100.00% |

The solvent fraction had the following composition and relative evaporation rates (butyl acetate=100):

| Solvent | Grams | Wt. % | RER |
|---|---|---|---|
| acetone | 455.0 g | 15.77% | 1440 |
| isobutanol | 407.3 g | 14.11% | 74 |
| methyl amyl ketone | 2,023.5 g | 70.12% | 40 |
| Total | 2,885.8 g | 100.00% | |

The solvent fraction had the following distribution of solvent by relative evaporation rate:

| | |
|---|---|
| <50 | 70% |
| 50 to 100 | 14% |
| 101 to 250 | 0% |
| >250 | 16% |

The coating formulation had the following properties:

| | |
|---|---|
| Solvent content | 259 grams/liter |
| Relative evap. rate | 51 (butyl acetate = 100) |
| Viscosity | 540 centipoise (23 C) |
| Weight solids | 81.44 percent |
| Liquid density | 1395 grams/liter |

The spray mixture was prepared and sprayed in the continuous mode by admixing the coating formulation with the desired proportion of compressed carbon dioxide, both pressurized to the desired spray pressure. The spray mixture had a high compressed carbon dioxide content of 39% by weight and had the following composition:

| | |
|---|---|
| Solids | 50% |
| Carbon dioxide | 39% |
| Organic Solvents | 11% |
| Total | 100% |

Therefore, the spray mixture contained 3.5 times more compressed carbon dioxide than organic solvent.

The spray mixture was sprayed at an ambient temperature of 23 C with a spray pressure of 900 psi using a Nordson™ A7A automatic spray gun with Spraying Systems tip #400011, which has a 9-mil orifice size, a 40-degree spray angle rating, and a 7-inch fan width rating, with tip insert #15153-NY. At this temperature, compressed carbon dioxide has a vapor pressure of 888 psi and has equilibrium gas and liquid densities of 0.22 and 0.73 g/cc, respectively. Therefore, the spray mixture contained coating formulation admixed with compressed carbon dioxide that was on the liquid side of equilibrium conditions.

The spray was a feathered flat spray fan that was parabolic in shape and that left the orifice at a very large angle. The fan width was about 14 inches. Coatings were sprayed that had the following properties:

| Coating Thickness | 20-Degree Gloss | MDEC DOI | ATI DOI |
|---|---|---|---|
| 1.0 mil | 70% | 75% | 44% |
| 1.6 mil | 74% | 90% | 72% |
| 2.0 mil | 73% | 85% | 63% |
| 2.5 mil | 78% | 95% | 82% |
| 2.8 mil | 75% | 95% | 83% |
| 3.9 mil | 71% | 80% | 50% |

The pigmented coatings were uniformly white and had very good appearance. They were very smooth with high gloss and high distinctness of image. They were free of haze and bubbles and even the very thick coatings did not run or sag or have solvent popping.

Coatings were also sprayed at an ambient temperature of 24 C with a spray pressure of 900 psi. At this temperature, the compressed carbon dioxide has a vapor pressure of 908 psi and has equilibrium gas and liquid densities of 0.23 and 0.72 g/cc, respectively. Therefore, the spray mixture contained coating formulation admixed with compressed carbon dioxide that was near the equilibrium condition at which gas and liquid exist together. The coatings had the following properties:

| Coating Thickness | 20-Degree Gloss | MDEC DOI | ATI DOI |
|---|---|---|---|
| 1.1 mil | 73% | 75% | 48% |
| 1.5 mil | 75% | 85% | 61% |
| 1.6 mil | 80% | 90% | 71% |
| 1.7 mil | 78% | 85% | 65% |
| 1.8 mil | 79% | 90% | 72% |
| 1.9 mil | 79% | 90% | 79% |
| 1.9 mil | 79% | 95% | 81% |
| 2.2 mil | 78% | 85% | 63% |
| 2.2 mil | 79% | 90% | 73% |
| 2.3 mil | 78% | 85% | 65% |
| 2.3 mil | 78% | 90% | 73% |
| 2.4 mil | 79% | 90% | 80% |
| 2.4 mil | 78% | 90% | 78% |
| 2.5 mil | 80% | 95% | 82% |
| 2.6 mil | 79% | 90% | 77% |
| 2.6 mil | 79% | 90% | 74% |

The pigmented coatings were uniformly white and had very good appearance. They were very smooth with high gloss and high distinctness of image. They were free of haze and bubbles and did not run or sag or have solvent popping.

Coatings were also sprayed at an ambient temperature of 26 C with a spray pressure of 900 psi. At this temperature, the compressed carbon dioxide has a vapor pressure of 950 psi and has equilibrium gas and liquid densities of 0.25 and 0.69 g/cc, respectively. Therefore, the spray mixture contained coating formulation admixed with compressed carbon dioxide gas. The coatings had the following properties:

| Coating Thickness | 20-Degree Gloss | MDEC DOI | ATI DOI |
|---|---|---|---|
| 0.9 mil | 70% | 70% | 39% |
| 1.4 mil | 77% | 85% | 63% |
| 1.7 mil | 77% | 85% | 69% |
| 2.4 mil | 80% | 90% | 72% |

The pigmented coatings were uniformly white and had very good appearance. They were very smooth with high gloss and high distinctness of image. They were free of haze and bubbles and did not run or sag or have solvent popping.

EXAMPLE 9

To see the effect of higher solids content and higher viscosity on the spray, a sample of the pigmented coating of Example 8 that did not contain the acetone dilution was sprayed. The coating formulation had a very high solids content of 83.89% and a viscosity of 1060 centipoise (23 C). The solids fraction was unchanged and the solvent fraction had the following composition and relative evaporation rates (butyl acetate=100):

| Solvent | Grams | Wt. % | RER |
|---|---|---|---|
| isobutanol | 407.3 g | 16.76% | 74 |
| methyl amyl ketone | 2,023.5 g | 83.24% | 40 |
| Total | 2,430.8 g | 100.00% | |

The spray mixture was sprayed at an ambient temperature of 26 C and a spray pressure of 900 psi. At this temperature, the compressed carbon dioxide has a vapor pressure of 950 psi and has equilibrium gas and liquid densities of 0.25 and 0.69 g/cc, respectively. Therefore, the spray mixture contained coating formulation admixed with compressed carbon dioxide gas. The carbon dioxide content was increased from 28% up to 39%, and a feathered spray was produced over the entire range. The spray was fingered at the 28% concentration but became uniform at 39% concentration, with the spray mixture having the following composition:

| | |
|---|---|
| Solids | 51% |
| Carbon dioxide | 39% |
| Solvents | 10% |
| Total | 100% |

Therefore, the spray mixture contained four times more compressed carbon dioxide than organic solvent. No panels were sprayed.

EXAMPLE 10

A coating formulation that has a solids content of 66.73% and a viscosity of 670 centipoise and that gives a clear acrylic coating was prepared from Rohm & Haas Acryloid™ AT-400 resin, which contains 75% nonvolatile acrylic polymer dissolved in 25% methyl amyl ketone solvent; Acryloid™ AT-954 resin; and Cymel™ 323 resin, by mixing the resins with solvents ethyl 3-ethoxypropionate (EEP), n-butanol, and methyl amyl ketone, and with 50% surfactant L7605 in xylene, in the following proportions:

| | | |
|---|---|---|
| Acryloid AT-400 | 8,150.6 g | 50.04% |
| Acryloid AT-954 | 2,397.2 g | 14.72% |
| Cymel 323 | 3,397.5 g | 20.86% |
| EEP | 1,111.3 g | 6.82% |
| n-butanol | 782.5 g | 4.80% |
| methyl amyl ketone | 400.0 g | 2.46% |
| 50% L5310 in xylene | 48.8 g | 0.30% |
| Total | 16,287.9 g | 100.00% |

The acrylic polymers had the following molecular weights:

| | |
|---|---|
| Acryloid AT-400 | |
| Molecular weight | 9,280 weight average (Mw) |
| Molecular weight | 3,270 number average (Mn) |
| Mw/Mn | 2.84 |
| Acryloid AT-954 | |
| Molecular weight | 6,070 weight average (Mw) |
| Molecular weight | 1,670 number average (Mn) |
| Mw/Mn | 3.63 |

The coating formulation contained 66.73% solids fraction and 33.27% solvent and surfactant fraction, with the following component composition:

| | | |
|---|---|---|
| AT-400 polymer | 6,113.0 g | 37.53% |
| AT-954 polymer | 2,037.6 g | 12.51% |
| Cymel 323 polymer | 2,718.0 g | 16.69% |
| methyl amyl ketone | 2,797.2 g | 17.18% |
| EEP | 1,111.3 g | 6.82% |
| n-butanol | 782.5 g | 4.80% |
| isobutanol | 679.5 g | 4.17% |
| xylene | 24.4 g | 0.15% |
| L5310 | 24.4 g | 0.15% |
| Total | 16,287.9 g | 100.00% |

The solids fraction had the following composition:

| | | |
|---|---|---|
| AT-400 polymer | 6,113.0 g | 56.24% |
| AT-954 polymer | 2,037.6 g | 18.75% |
| Cymel 323 polymer | 2,718.0 g | 25.01% |
| Total | 10,868.6 g | 100.00% |

The solvent fraction had the following composition and relative evaporation rates (butyl acetate=100):

| Solvent | Grams | Wt. % | RER |
|---|---|---|---|
| isobutanol | 679.5 g | 12.60% | 74 |
| xylene | 24.4 g | 0.45% | 70 |
| n-butanol | 782.5 g | 14.50% | 44 |
| methyl amyl ketone | 2,797.2 g | 51.85% | 40 |
| EEP | 1,111.3 g | 20.60% | 11 |
| Total | 5,394.9 g | 100.00% | |

The coating formulation had the following properties:

| | |
|---|---|
| Solvent content | 336 grams/liter |
| Relative evap. rate | 27 (butyl acetate = 100) |
| Viscosity | 670 centipoise |
| Weight solids | 66.73 percent |
| Liquid density | 1013 grams/liter |

The solvent fraction had the following distribution of solvent by relative evaporation rate:

| | |
|---|---|
| <50 | 87% |
| 50 to 100 | 13% |
| 101 to 250 | 0% |
| >250 | 0% |

Spray mixtures were prepared and sprayed in the continuous mode by admixing the coating formulation with the desired proportion of compressed carbon dioxide, both pressurized to the desired spray pressure. The spray mixtures were sprayed using a Nordson™ A7A automatic spray gun with Binks tip #9-0940, which has a 9-mil orifice size and a 7-inch fan width rating, using Spraying Systems tip insert #15153-NY. The distance from the spray tip to the panel was eleven inches. Panels were sprayed using a Spraymation automatic sprayer.

A spray mixture with a compressed carbon dioxide content of 27.8% by weight at a temperature of 26 C and pressure of 1600 psi produced a fishtail spray pattern with atomization occurring from a visible liquid-film that extended from the spray orifice. The spray fan was angular in shape and had a fan width of 7 inches. Spraying panels produced liquid coatings that consisted of foam and baked coatings that were covered with bubbles. The spray viscosity was 23 centipoise as measured using a Cambridge high-pressure viscometer.

Increasing the carbon dioxide concentration to 28.5% and the temperature to 28 C and decreasing the pressure to 1500 psi produced a wide feathered flat spray fan that was parabolic in shape and that left the orifice at a very large angle. The fan width was about 11–12 inches. The spray had jetting in the center of the fan that dissipated with distance from the orifice. At this temperature, compressed carbon dioxide has a vapor pressure of 995 psi and has equilibrium gas and liquid densities of 0.28 and 0.65 g/cc, respectively. Therefore, the spray mixture contained coating formulation admixed with liquid carbon dioxide, which was completely dissolved. Coatings were sprayed that had the following properties:

| Coating Thickness | 20-Degree Gloss | MDEC DOI | ATI DOI |
|---|---|---|---|
| 1.2 mil | 79% | 65% | 30% |
| 1.9 mil | 88% | 80% | 50% |
| 2.0 mil | 90% | 80% | 49% |

The coatings were smooth and glossy and free of haze or bubbles.

Decreasing the pressure to 1200 psi gave a feathered spray with little if any jetting. Coatings were sprayed that had the following properties:

| Coating Thickness | 20-Degree Gloss | MDEC DOI | ATI DOI |
|---|---|---|---|
| 1.8 mil | 84% | 70% | 39% |
| 2.2 mil | 89% | 80% | 49% |

The coatings were smooth and glossy and free of haze or bubbles.

Increasing the carbon dioxide concentration to 29.6% and lowering the spray pressure to 1000 psi at the temperature of 28 C gave a single-phase spray mixture that was at or near the equilibrium condition where carbon dioxide liquid and gas exist together. The spray was feathered and uniform with no jetting. Coatings were sprayed that had the following properties:

| Coating Thickness | 20-Degree Gloss | MDEC DOI | ATI DOI |
|---|---|---|---|
| 1.5 mil | 73% | 65% | 28% |
| 1.7 mil | 83% | 75% | 42% |
| 2.0 mil | 86% | 75% | 45% |
| 2.3 mil | 88% | 80% | 52% |
| 2.5 mil | 90% | 85% | 59% |

The coatings were smooth and glossy and free of haze or bubbles.

Decreasing the pressure to 950 psi gave a single-phase spray mixture that contained coating formulation admixed with carbon dioxide gas, which was completely dissolved. The spray viscosity was 19 centipoise as measured using a Cambridge high-pressure viscometer. The spray was feathered and uniform. Coatings were sprayed that had the following properties:

| Coating Thickness | 20-Degree Gloss | MDEC DOI | ATI DOI |
|---|---|---|---|
| 1.0 mil | 40% | — | — |
| 1.1 mil | 48% | — | — |
| 1.7 mil | 74% | — | — |
| 1.9 mil | 78% | 70% | 33% |
| 2.1 mil | 82% | 70% | 36% |
| 2.2 mil | 85% | 75% | 42% |
| 2.7 mil | 86% | 80% | 47% |

The coatings were smooth and glossy and free of haze or bubbles.

Coatings were also sprayed at a temperature of 29 C and pressure of 900 psi, which was close to the carbon dioxide solubility limit. The coatings had the following properties:

| Coating Thickness | 20-Degree Gloss | MDEC DOI | ATI DOI |
|---|---|---|---|
| 0.8 mil | 83% | 70% | 36% |
| 1.1 mil | 92% | 80% | 51% |
| 1.4 mil | 91% | 80% | 53% |
| 1.8 mil | 92% | 85% | 59% |

The coatings were smooth and glossy and free of haze or bubbles.

For comparison, the coating formulation was sprayed without admixing it with compressed carbon dioxide. At a spray temperature of 28 C, from the lowest to the highest spray pressure used (1600 psi) the spray had a fishtail spray pattern with atomization occurring from a visible liquid-film that extended from the spray orifice. The spray fan was angular in shape and had side jets detached from the central portion of the spray. The spray deposition pattern was very nonuniform and the liquid coatings sprayed were foamy from air entrapment. The baked coatings were covered with air bubbles.

For comparison, the coating formulation was also sprayed without admixing it with compressed carbon dioxide but admixing it with methyl ethyl ketone solvent, which has a very high relative evaporation rate, to a concentration of 28% by weight in order to reduce the viscosity to a low level. Over all the ranges of spray temperature (23–60 C) and pressure (300–1600 psi) examined, the spray had a fishtail spray pattern with atomization occurring from a visible liquid-film that extended from the spray orifice. The spray fan was angular in shape and had side jets detached from the central portion of the spray. The spray deposition pattern was nonuniform and the coatings were poor.

EXAMPLE 11

The coating formulation used in Example 10 was sprayed using the same spray gun and tip but at an ambient temperature of 21 C. At this temperature, compressed carbon dioxide has a vapor pressure of 846 psi and has equilibrium gas and liquid densities of 0.20 and 0.76 g/cc, respectively. Therefore, the spray mixtures contained coating formulation admixed with liquid carbon dioxide.

With a carbon dioxide concentration of about 28.2%, at spray pressures of 1000 and 1600 psi, the spray mixture was a clear single-phase solution and produced a fishtail spray pattern with atomization occurring from a visible liquid-film that extended from the spray orifice. The spray fan was angular in shape and had a fan width of –inches. Spraying panels produced liquid coatings that were foam and baked coatings that were covered with clusters of foam bubbles. The spray viscosity was 23 centipoise as measured using a Cambridge high-pressure viscometer.

A carbon dioxide concentration of 31.5% gave a two-phase mixture at a spray pressure of 1600 psi, which indicates that liquid carbon dioxide in excess of the solubility limit was dispersed as fine droplets in the spray mixture. The spray was in transition between a fishtail and a feathered spray, being flared outward on both sides from the plane of the fan and therefore not being a flat fan. Coatings were sprayed that were clear, smooth, and glossy and that were free of haze and bubbles. They had the following properties:

| Coating Thickness | 2-Degree Gloss |
|---|---|
| 0.6 mil | 32% |
| 1.2 mil | 60% |
| 1.3 mil | 68% |
| 1.6 mil | 63% |

Lowering the pressure increased the width of the spray and decreased the amount of flaring.

Increasing the carbon dioxide concentration to 36.0% gave a spray mixture that had two phases even at a high pressure of 2000 psi, which indicates that a substantial excess of liquid carbon dioxide above the solubility limit was dispersed as fine droplets in the spray mixture at lower pressures. At 2000 psi, the spray mixture produced a feathered spray with a parabolic shape, but the high pressure produced jetting in the center, which dissipated with greater distance from the orifice. A coating was sprayed with a thickness of 1.3 mil and a gloss of 74%. It was clear, smooth, and glossy and was free of haze and bubbles.

Decreasing the pressure to 1550 psi decreased the amount of jetting in the spray. A coating was sprayed with a thickness of 1.0 mil and a gloss of 65% and that was free of haze and bubbles. Decreasing the pressure to 900 psi gave a feathered spray with no jetting and a wider fan. A coating was sprayed in the same manner as at the higher pressures and it had a thickness of 0.5 mil, which indicates a much lower spray rate.

EXAMPLE 12

A coating formulation that has a solids content of 64.32% and a viscosity of 540 centipoise (23 C) and that gives a clear acrylic coating was prepared from Acryloid™ AT-400 resin, Acryloid™ AT-954 resin, and Cymel™ 323 resin, by mixing the resins with solvents ethyl 3-ethoxypropionate (EEP), n-butanol, acetone, and methyl amyl ketone, and with 50% surfactant L7605 in xylene, in the following proportions:

| | | |
|---|---|---|
| Acryloid AT-400 | 8,150.6 g | 48.23% |
| Acryloid AT-954 | 2,397.2 g | 14.19% |
| Cymel 323 | 3,397.5 g | 20.10% |
| EEP | 1,111.3 g | 6.58% |
| n-butanol | 782.5 g | 4.63% |
| acetone | 612.1 g | 3.62% |
| methyl amyl ketone | 400.0 g | 2.37% |
| 50% L5310 in xylene | 48.8 g | 0.29% |
| Total | 16,900.0 g | 100.00% |

The acrylic polymers had the following molecular weights:

| | |
|---|---|
| Acryloid AT-400 | |
| Molecular weight | 9,280 weight average (Mw) |
| Molecular weight | 3,270 number average (Mn) |
| Mw/Mn | 2.84 |
| Acryloid AT-954 | |
| Molecular weight | 6,070 weight average (Mw) |
| Molecular weight | 1,670 number average (Mn) |
| Mw/Mn | 3.63 |

The coating formulation contained 64.32% solids fraction and 35.68% solvent and surfactant fraction, with the following component composition:

| | | |
|---|---|---|
| AT-400 polymer | 6,113.0 g | 36.17% |
| AT-954 polymer | 2,037.6 g | 12.06% |
| Cymel 323 polymer | 2,718.0 g | 16.09% |
| methyl amyl ketone | 2,797.2 g | 16.55% |
| EEP | 1,111.3 g | 6.58% |
| n-butanol | 782.5 g | 4.63% |
| isobutanol | 679.5 g | 4.02% |
| acetone | 612.1 g | 3.62% |
| xylene | 24.4 g | 0.14% |
| L5310 | 24.4 g | 0.14% |
| Total | 16,900.0 g | 100.00% |

The solids fraction had the following composition:

| | | |
|---|---|---|
| AT-400 polymer | 6,113.0 g | 56.24% |
| AT-954 polymer | 2,037.6 g | 18.75% |
| Cymel 323 polymer | 2,718.0 g | 25.01% |
| Total | 10,868.6 g | 100.00% |

The solvent fraction had the following composition and relative evaporation rates (butyl acetate=100):

| Solvent | Grams | Wt. % | RER |
|---|---|---|---|
| acetone | 612.1 g | 10.19% | 1440 |
| isobutanol | 679.5 g | 11.31% | 74 |
| xylene | 24.4 g | 0.40% | 70 |
| n-butanol | 782.5 g | 13.03% | 44 |
| methyl amyl ketone | 2,797.2 g | 46.57% | 40 |
| EEP | 1,111.3 g | 18.50% | 11 |
| Total | 6,007.0 g | 100.00% | |

The coating formulation had the following properties:

| | |
|---|---|
| Solvent content | 357 grams/liter |
| Relative evap. rate | 27 (butyl acetate = 100) |
| Viscosity | 540 centipoise |
| Weight solids | 64.32 percent |
| Liquid density | 1001 grams/liter |

The solvent fraction had the following distribution of solvent by relative evaporation rate:

| | |
|---|---|
| <50 | 78% |
| 50 to 100 | 12% |
| 101 to 250 | 0% |
| >250 | 10% |

Spray mixtures were prepared and sprayed in the continuous mode by admixing the coating formulation with the desired proportion of compressed carbon dioxide, both pressurized to the desired spray pressure. The spray mixtures were sprayed using a Nordson™ A7A automatic spray gun with Spraying Systems tip #400011, which has a 9-mil orifice size and a 7-inch fan width rating, using tip insert #15153-NY. The distance from the spray tip to the panel was twelve inches. Panels were sprayed using a Spraymation automatic sprayer.

The spray mixture had a compressed carbon dioxide content of 32.5% by weight and was sprayed at a temperature of 28 C and a pressure of 900 psi. At this temperature, compressed carbon dioxide has a vapor pressure of 995 psi and has equilibrium gas and liquid densities of 0.28 and 0.65 g/cc, respectively. Therefore, the spray mixture contained coating formulation admixed with compressed carbon dioxide gas. The spray mixture was close to the carbon dioxide solubility limit at these conditions. The spray was a feathered flat spray fan that was parabolic in shape and that left the orifice at a very large angle. The fan width was about 14 inches. Coatings were sprayed that had the following properties:

| Coating Thickness | 20-Degree Gloss | MDEC DOI | ATI DOI |
|---|---|---|---|
| 0.7 mil | 69% | 65% | 30% |
| 1.0 mil | 86% | 70% | 38% |
| 1.3 mil | 88% | 80% | 52% |

The coatings were smooth and glossy and free of haze or bubbles.

EXAMPLE 13

A pigmented coating formulation that has a solids content of 70.76% and a viscosity of 1200 centipoise (23 C) and that gives a white acrylic coating was prepared from Acryloid™ AT-400 resin and Cymel™ 323 resin by mixing the resins with Dupont Ti-pure™ 960 titanium dioxide pigment and with solvents n-butanol and methyl amyl ketone, in the following proportions:

| | | |
|---|---|---|
| Acryloid AT-400 | 6,000.0 g | 38.86% |
| Cymel 323 | 1,883.7 g | 12.20% |
| pigment | 4,917.6 g | 31.85% |
| n-butanol | 1,426.7 g | 9.24% |
| methyl amyl ketone | 1,212.0 g | 7.85% |
| Total | 15,440.0 g | 100.00% |

The acrylic polymer had the following molecular weight:

| | |
|---|---|
| Molecular weight | 9,280 weight average (Mw) |
| Molecular weight | 3,270 number average (Mn) |
| Mw/Mn | 2.84 |

The coating formulation contained 70.76% solids fraction and 29.24% solvent fraction, with the following component composition:

| | | |
|---|---|---|
| AT-400 polymer | 4,500.0 g | 29.15% |
| Cymel 323 polymer | 1,507.0 g | 9.76% |
| pigment | 4,917.6 g | 31.85% |
| methyl amyl ketone | 2,712.0 g | 17.56% |
| n-butanol | 1,426.7 g | 9.24% |
| isobutanol | 376.7 g | 2.44% |
| Total | 15,440.0 g | 100.00% |

The solids fraction had the following composition:

| | | |
|---|---|---|
| AT-400 polymer | 4,500.0 g | 41.19% |
| Cymel 323 polymer | 1,507.0 g | 13.80% |
| pigment | 4,917.6 g | 45.01% |
| Total | 10,924.6 g | 100.00% |

The solvent fraction had the following composition and relative evaporation rates (butyl acetate=100):

| Solvent | Grams | Wt. % | RER |
|---|---|---|---|
| isobutanol | 376.7 g | 8.34% | 74 |
| n-butanol | 1,426.7 g | 31.60% | 44 |
| methyl amyl ketone | 2,712.0 g | 60.06% | 40 |
| Total | 4,515.4 g | 100.00% | |

The solvent fraction had the following distribution of solvent by relative evaporation rate:

| | |
|---|---|
| <50 | 92% |
| 50 to 100 | 8% |
| 101 to 250 | 0% |
| >250 | 0% |

The coating formulation had the following properties:

| | |
|---|---|
| Solvent content | 376 grams/liter |
| Relative evap. rate | 43 (butyl acetate = 100) |
| Viscosity | 1,200 centipoise (23 C) |
| Weight solids | 70.76 percent |
| Liquid density | 1286 grams/liter |

The spray mixture was prepared and sprayed in the continuous mode by admixing the coating formulation with the desired proportion of compressed carbon dioxide, both pressurized to the desired spray pressure. The spray mixture had a compressed carbon dioxide content of 32% by weight and had the following composition:

| | |
|---|---|
| Solids | 48% |
| Carbon dioxide | 32% |
| Organic Solvents | 20% |
| Total | 100% |

Therefore, the spray mixture contained 60% more compressed carbon dioxide than organic solvent.

The spray mixture was sprayed at an ambient temperature of 23.4 C and a spray pressure of 900 psi using a Nordson™ A7A automatic spray gun with Spraying Systems tip #400011, which has a 9-mil orifice size and a 7-inch fan width rating, with tip insert #15153-NY. At this temperature, compressed carbon dioxide has a vapor pressure of 896 psi and has equilibrium gas and liquid densities of 0.22 and 0.73 g/cc, respectively. Therefore, the spray mixture contained coating formulation admixed with compressed carbon dioxide that was at or near the equilibrium condition where carbon dioxide gas and liquid exist together.

The spray mixture produced a feathered flat spray fan that was parabolic in shape and that left the orifice at a very large angle. The fan width was about 7–9 inches. Coatings were sprayed that had the following properties:

| Coating Thickness | 20-Degree Gloss | MDEC DOI | ATI DOI |
|---|---|---|---|
| 0.9 mil | 63% | 80% | 46% |
| 1.5 mil | 67% | 80% | 48% |

The pigmented coatings were smooth and white in appearance. They were free of bubbles and did not run or sag.

A Nordson™ flat spray tip #016-013, which has a 9-mil orifice size and a 6-inch fan width rating, was used with turbulence plate #029-012. This produced a narrower feathered spray fan with a width of about 6–7 inches. A coating was sprayed that had a thickness of 1.7 mil and a gloss of 64%.

The spray mixture was also sprayed at an ambient temperature of 26.7 C and a spray pressure of 900 psi using the same Nordson™ A7A spray gun and Spraying Systems tip #400011. At this temperature, compressed carbon dioxide has a gas pressure of 966 psi and has equilibrium gas and liquid densities of 0.26 and 0.68 g/cc, respectively. Therefore, the spray mixture contained coating formulation admixed with compressed carbon dioxide gas.

The spray mixture produced a feathered flat spray fan that was parabolic in shape and that left the orifice at a very large angle. The fan width was about 7–9 inches. Coatings were sprayed that had the following properties:

| Coating Thickness | 20-Degree Gloss | MDEC DOI | ATI DOI |
|---|---|---|---|
| 0.5 mil | 50% | — | — |
| 0.9 mil | 64% | 75% | 44% |
| 1.2 mil | 62% | 75% | 42% |
| 1.3 mil | 75% | 75% | 43% |
| 1.6 mil | 63% | 75% | 40% |

Increasing the spray pressure to 1200 psi produced a feathered spray that was narrower and the had some jetting in the center, which dissipated with distance. A coating was sprayed that had the following properties:

| Coating Thickness | 20-Degree Gloss | MDEC DOI | ATI DOI |
|---|---|---|---|
| 1.5 mil | 70% | 85% | 55% |

The pigmented coatings were smooth, glossy, and white in appearance. They were free of bubbles and did not run or sag.

Reducing the carbon dioxide concentration to below 28% by weight produced a fishtail spray that was angular in shape. This produced liquid coatings that were foamed and baked coatings that were covered with bubbles.

EXAMPLE 14

A coating formulation that has a solids content of 60.00% and a viscosity of 470 centipoise (23 C) and that gives a clear acrylic coating was prepared by mixing Acryloid™ AT-400 resin and Cymel™ 323 resin with solvents methyl amyl ketone and n-butanol in the following proportions:

| | | |
|---|---|---|
| Acryloid AT-400 | 8,694.0 g | 60.00% |
| Cymel 323 | 2,718.0 g | 18.75% |
| methyl amyl ketone | 2,453.0 g | 16.93% |
| n-butanol | 626.0 g | 4.32% |
| Total | 14,491.0 g | 100.00% |

The acrylic polymer had the following molecular weight:

| | |
|---|---|
| Molecular weight | 9,280 weight average (Mw) |
| Molecular weight | 3,270 number average (Mn) |
| Mw/Mn | 2.84 |

The coating formulation had the following component composition:

| | | |
|---|---|---|
| AT-400 polymer | 6,520.5 g | 45.00% |
| Cymel 323 polymer | 2,174.4 g | 15.00% |
| methyl amyl ketone | 4,626.5 g | 31.93% |
| n-butanol | 626.0 g | 4.32% |
| isobutanol | 543.6 g | 3.75% |
| Total | 14,491.0 g | 100.00% |

The coating formulation had a solvent content of 394 grams/liter.

The spray mixture was prepared and sprayed in the continuous mode by admixing the coating formulation with the desired proportion of compressed carbon dioxide, both pressurized to the desired spray pressure. It was sprayed using a Nordson™ A7A automatic spray gun with Binks tip #9-0940, which has a 9-mil orifice size and a 7-inch fan width rating, using Spraying Systems tip insert #15153-NY.

The spray mixture had a compressed carbon dioxide content of 28.2% by weight and was sprayed at a pressure of 950 psi at various temperatures to observe the change in the spray pattern. At a vapor pressure of 950 psi, compressed carbon dioxide has an equilibrium temperature of 26 C and has equilibrium gas and liquid densities of 0.25 and 0.69 g/cc, respectively. Therefore, the spray mixture contained coating formulation admixed with carbon dioxide liquid below this temperature and with gas above this temperature.

At the ambient temperature of 24 C, the spray was in transition between a fishtail and a feathered spray. It remained in transition up to a temperature of 36 C, which produced a wide uniform flat feathered spray with a parabolic shape. The fan width was about 12 inches.

EXAMPLE 15

A coating formulation that has a solids content of 55.00% and a low viscosity of 220 centipoise (23 C) and that gives a clear acrylic coating was prepared by mixing Acryloid™ AT-400 resin and Cymel™ 323 resin with solvents methyl amyl ketone and n-butanol in the following proportions:

| | | |
|---|---|---|
| Acryloid AT-400 | 8,694.0 g | 55.00% |
| Cymel 323 | 2,718.0 g | 17.19% |
| methyl amyl ketone | 3,771.0 g | 23.85% |
| n-butanol | 626.0 g | 3.96% |
| Total | 15,809.0 g | 100.00% |

The acrylic polymer had the following molecular weight:

| | |
|---|---|
| Molecular weight | 9,280 weight average (Mw) |
| Molecular weight | 3,270 number average (Mn) |
| Mw/Mn | 2.84 |

The coating formulation had the following component composition:

| | | |
|---|---|---|
| AT-400 polymer | 6,520.5 g | 41.25% |
| Cymel 323 polymer | 2,174.4 g | 13.75% |

-continued

| | | |
|---|---|---|
| methyl amyl ketone | 5,944.5 g | 37.60% |
| n-butanol | 626.0 g | 3.96% |
| isobutanol | 543.6 g | 3.44% |
| Total | 15,809.0 g | 100.00% |

The coating formulation had a solvent content of 436 grams/liter.

The spray mixture was prepared and sprayed in the continuous mode by admixing the coating formulation with the desired proportion of compressed carbon dioxide, both pressurized to the desired spray pressure. It was sprayed using a Nordson™ A7A automatic spray gun with Binks tip #9-0940, which has a 9-mil orifice size and a 7-inch fan width rating, using Spraying Systems tip insert #15153-NY.

The spray mixture had a compressed carbon dioxide content of 28.2% by weight and was sprayed at a pressure of 950 psi at various temperatures to observe the change in the spray pattern. At a vapor pressure of 950 psi, compressed carbon dioxide has an equilibrium temperature of 26 C and has equilibrium gas and liquid densities of 0.25 and 0.69 g/cc, respectively. Therefore, the spray mixture contained coating formulation admixed with carbon dioxide liquid below this temperature and with gas above this temperature.

At the ambient temperature of 24 C, the spray was in transition between a fishtail and a feathered spray. It remained in transition up to a temperature of 36 C, which produced a wide uniform flat feathered spray with a parabolic shape. The fan width was about 12 inches.

To see the effect of lower pressure on the change in the spray with temperature, the spray mixture was sprayed at a pressure of 800 psi. The ambient temperature of 25.7 C produced a wide uniform flat feathered spray with a parabolic shape. At this temperature, compressed carbon dioxide has a vapor pressure of 945 psi and equilibrium gas and liquid densities of 0.25 and 0.69 g/cc, respectively. Therefore, the spray mixture contained coating formulation admixed with carbon dioxide gas, which was completely dissolved. The spray mixture was then sprayed using Nordson™ flat spray tip #016-013, which has a 9-mil orifice size and a 6-inch fan width rating, using turbulence plate #029-012. This produced a narrow feathered spray fan with a parabolic shape and a width of about 6–7 inches. The spray mixture was then sprayed using Graco™ fine finish tip #163-416, which has a large 16-mil orifice size and a 9-inch fan width rating. This produced a very wide feathered spray fan with a parabolic shape and a width of about 14–16 inches.

EXAMPLE 16

A coating formulation that has a solids content of 65.01% and a viscosity of 940 centipoise and that gives a clear acrylic coating was prepared from by mixing Acryloidtm AT-400 resin and Cymel™ 323 resin with solvents methyl amyl ketone and n-butanol in the following proportions:

| | | |
|---|---|---|
| Acryloid AT-400 | 8,694.0 g | 65.01% |
| Cymel 323 | 2,718.0 g | 20.32% |
| methyl amyl ketone | 1,336.0 g | 9.99% |
| n-butanol | 626.0 g | 4.68% |
| Total | 13,374.0 g | 100.00% |

The acrylic polymer had the following molecular weight:

| | |
|---|---|
| Molecular weight | 9,280 weight average (Mw) |
| Molecular weight | 3,270 number average (Mn) |
| Mw/Mn | 2.84 |

The coating formulation had the following component composition:

| | | |
|---|---|---|
| AT-400 polymer | 6,520.5 g | 48.75% |
| Cymel ™ 323 polymer | 2,174.4 g | 16.26% |
| isobutanol | 543.6 g | 4.07% |
| n-butanol | 626.0 g | 4.68% |
| methyl amyl ketone | 3,509.5 g | 26.24% |
| Total | 13,374.0 g | 100.00% |

The coating formulation had a solvent content of 394 grams/liter.

The coating formulation was admixed with subcritical compressed carbon dioxide at different concentrations and sprayed at different temperatures and pressures. All the subcritical spray conditions tried produced a fishtail liquid-film spray. A feathered decompressive spray could not be obtained at this high solids content.

EXAMPLE 17

A coating formulation that has a solids content of 69.43% and a viscosity of 1080 centipoise (23 C) and that gives a clear air-dry alkyd-urea catalyzed conversion coating was prepared from a special Reichhol™ alkyd resin, which contains 75% alkyd polymer in 25% methyl amyl ketone solvent, and American Cyanamid Beetle™ 80 resin, which is an acid catalyzed cross-linking agent that contains 96% butylated urea-formaldehyde polymer and 4% n-butanol, by mixing the resins with solvents n-butanol and Aromatic 100 and with Union Carbide surfactant SILWET™ L-7500, in the following proportions:

| | | |
|---|---|---|
| Reichhold ™ alkyd | 10,000.0 g | 66.20% |
| Beetle 80 | 3,111.8 g | 20.60% |
| n-butanol | 1,057.4 g | 7.00% |
| Aromatic 100 | 906.3 g | 6.00% |
| SILWET L-7500 | 30.2 g | 0.20% |
| Total | 15,105.7 g | 100.00% |

The alkyd polymer had the following molecular weight:

| | |
|---|---|
| Molecular weight | 15,830 weight average (Mw) |
| Molecular weight | 1,980 number average (Mn) |
| Mw/Mn | 8.00 |

The coating formulation contained 69.43% solids fraction and 30.57% solvent and surfactant fraction, with the following component composition:

| | | |
|---|---|---|
| Reichhold ™ alkyd | 7,500.0 g | 49.65% |
| Beetle 80 | 2,987.3 g | 19.78% |

-continued

| | | |
|---|---|---|
| methyl amyl ketone | 2,500.0 g | 16.55% |
| n-butanol | 1,181.9 g | 7.82% |
| Aromatic 100 | 906.3 g | 6.00% |
| SILWET L-7500 | 30.2 g | 0.20% |
| Total | 15,105.7 g | 100.00% |

The solids fraction had the following composition:

| | | |
|---|---|---|
| Reichhold ™ alkyd | 7,500.0 g | 71.52% |
| Beetle 80 | 2,987.3 g | 28.48% |
| Total | 10,487.3 g | 100.00% |

The solvent fraction had the following composition and relative evaporation rates (butyl acetate=100):

| Solvent | Grams | Wt. % | RER |
|---|---|---|---|
| n-butanol | 1,181.9 g | 25.76% | 44 |
| methyl amyl ketone | 2,500.0 g | 54.49% | 40 |
| Aromatic 100 | 906.3 g | 19.75% | 20 |
| Total | 4,588.2 g | 100.00% | |

The coating formulation had the following properties:

| | |
|---|---|
| Solvent content | 304 grams/liter<br>2.54 lb/gal] |
| Relative evap. rate | 34 (butyl acetate = 100) |
| Viscosity | 1080 centipoise |
| Weight solids | 69.43 percent |
| Liquid density | 996 grams/liter |

The solvent fraction had the following distribution of solvent by relative evaporation rate:

| | |
|---|---|
| <50 | 100% |
| 50 to 100 | 0% |
| 101 to 250 | 0% |
| >250 | 0% |

Prior to spraying, 0.4% of American Cyanamid Cycat™ 4040 catalyst was admixed with the coating formulation to initiate the crosslinking reaction. The spray mixture was prepared and sprayed in the continuous mode by admixing the coating formulation with the desired proportion of compressed carbon dioxide, both pressurized to the desired spray pressure. The spray mixture was sprayed using a Nordson™ A7A automatic spray gun with Binks tip #400011, which has a 9-mil orifice size and a 7-inch fan width rating, using tip insert #15153-NY. The distance from the spray tip to the panel was twelve inches. Panels were sprayed using a Spraymation automatic sprayer.

The spray mixture had a compressed carbon dioxide content of 30% by weight and was sprayed at the ambient temperature of 25.8 C and a pressure of 900 psi. At this temperature, compressed carbon dioxide has a vapor pressure of 947 psi and has equilibrium gas and liquid densities of 0.25 and 0.69 g/cc, respectively. Therefore, the spray mixture contained coating formulation admixed with compressed carbon dioxide gas, which was completely dissolved. The spray was a feathered flat spray fan that was parabolic in shape and that left the orifice at a very large angle. The fan width was about 11–12 inches. After waiting about two hours, coatings were sprayed over a period of one half hour that had the following properties:

| Coating Thickness | 20-Degree Gloss | MDEC DOI | ATI DOI |
|---|---|---|---|
| 0.7 mil | 71% | 65% | 28% |
| 1.0 mil | 85% | 70% | 37% |
| 1.2 mil | 83% | 70% | 34% |
| 1.5 mil | 91% | 80% | 46% |

The coatings were smooth, glossy, and had good appearance. They were free of haze or bubbles.

Not long after the coatings were sprayed, the viscosity of the coating formulation was measured and was found to have increased from 1080 centipoise, when the catalyst was added, to 1800 centipoise, due to the catalyzed cross-linking reaction increasing the molecular weight of the polymer system, which had caused the spray to begin to deteriorate. The coating formulation was then diluted with acetone to a viscosity of 500 centipoise and spraying was continued at a pressure of 850 psi. Coatings were sprayed that had the following properties:

| Coating Thickness | 20-Degree Gloss | MDEC DOI | ATI DOI |
|---|---|---|---|
| 0.6 mil | 60% | — | — |
| 1.0 mil | 80% | 70% | 36% |
| 1.0 mil | 87% | 70% | 37% |
| 1.5 mil | 90% | 80% | 45% |

The coatings were smooth, glossy, and had good appearance. They were free of haze or bubbles. Shortly thereafter, the continued increase in molecular weight of the coating formulation due to the catalyzed reaction caused to the feathered spray to deteriorate and eventually transition to an angular fishtail spray pattern with atomization occurring from a liquid-film that extended from the spray orifice.

EXAMPLE 18

A coating formulation that has a solids content of 100% and a viscosity of 375 centipoise (23 C) and that gives a clear liquid coating used for mold release applications such as in casting metal items was the liquid silicone polymer polydimethylsiloxane (Specialty Systems, Rochester Hills, Mich.). The polymer had an estimated weight-average molecular weight of between about 1000 and 2000.

A spray mixture was prepared by admixing the liquid polymer with compressed carbon dioxide at a concentration of about 30%. The spray mixture was sprayed at a temperature of 21 C and a pressure of 825 psi. This produced a uniform angular spray fan with liquid-film type atomization and a width of about 8 inches at a distance of 12 inches from the spray tip. Although angular in shape, the spray produced relatively uniform coating deposition and a liquid coating having a thickness of about 2 mil that was free of bubbles and holes in the coating film and were suitable for mold release applications.

The compressed carbon dioxide concentration in the spray mixture was then increased to about 40% at a temperature of 21 C and a pressure of 800 psi. This caused the spray to enter into transition between the angular spray pattern and a feathered parabolic spray pattern. The compressed carbon dioxide concentration was then increased to about 50%. This produced a wide uniform feathered decompressive spray pattern having a fan width of about 12–14 inches. The spray produced uniform thin liquid coatings having thicknesses from less than one mil to greater than two mil that were free of bubbles and holes in the coating film and were suitable for mold release applications.

EXAMPLE 19

A coating formulation that has a solids content of 55.00% and a viscosity of 1870 centipoise and that gives a clear air-dry alkyd-urea nitrocellulose lacquer coating was prepared from Hercules grade R5-18-25 nitrocellulose, which contains 70% solid nitrocellulose powder wetted with 30% isopropanol solvent, and Reichhold Beckosol™ alkyd resin solution CO9195-02, which contains 75% non-volatile short coconut oil alkyd in 25% methyl amyl ketone solvent, by mixing the solid polymer and resin solution with solvents methyl amyl ketone, n-butanol, and dioctyl phthalate and with surfactant SILWET™ L-7500, in the following proportions:

| | | |
|---|---|---|
| Nitrocellulose | 3,825.0 g | 25.50% |
| Reichhold ™ alkyd | 4,425.0 g | 29.50% |
| methyl amyl ketone | 4,785.0 g | 31.90% |
| n-butanol | 1,260.0 g | 8.40% |
| dioctyl phthalate | 690.0 g | 4.60% |
| SILWET L-7500 | 15.0 g | 0.10% |
| Total | 15,000.0 g | 100.00% |

The nitrocellulose and alkyd polymers had the following molecular weight:

| | |
|---|---|
| Nitrocellulose | |
| Molecular weight | 25,725 weight average (Mw) |
| Molecular weight | 9,760 number average (Mn) |
| Mw/Mn | 2.64 |
| Alkyd polymer | |
| Molecular weight | 19,040 weight average (Mw) |
| Molecular weight | 2,050 number average (Mn) |
| Mw/Mn | 9.29 |

The coating formulation contained 55.00% solids fraction and 45.00% solvent and surfactant fraction, with the following component composition:

| | | |
|---|---|---|
| Nitrocellulose | 2,677.5 g | 17.85% |
| Reichhold ™ alkyd | 3,318.8 g | 22.12% |
| methyl amyl ketone | 5,891.2 g | 39.28% |
| isopropanol | 1,147.5 g | 7.65% |
| n-butanol | 1,260.0 g | 8.40% |
| dioctyl phthalate | 690.0 g | 4.60% |
| SILWET L-7500 | 15.0 g | 0.10% |
| Total | 15,000.0 g | 100.00% |

The solids fraction had the following composition:

| | | |
|---|---|---|
| Nitrocellulose | 2,677.5 g | 44.65% |
| Reichhold ™ alkyd | 3,318.8 g | 55.35% |
| Total | 5,996.3 g | 100.00% |

The solvent fraction had the following composition and relative evaporation rates (butyl acetate=100):

| Solvent | Grams | Wt. % | RER |
|---|---|---|---|
| isopropanol | 1,147.5 g | 12.76% | 288 |
| n-butanol | 1,260.0 g | 14.02% | 44 |
| methyl amyl ketone | 5,891.2 g | 65.54% | 40 |
| dioctyl phthalate | 690.0 g | 7.68% | <1 |
| Total | 8,988.7 g | 100.00% | |

The coating formulation had the following properties:

| | | |
|---|---|---|
| Solvent content | 443 | grams/liter |
| Relative evap. rate | <10 | (butyl acetate = 100) |
| Viscosity | 1080 | centipoise |
| Weight solids | 55.00 | percent |
| Liquid density | 984 | grams/liter |

The solvent fraction had the following distribution of solvent by relative evaporation rate:

| | |
|---|---|
| <50 | 87% |
| 50 to 100 | 0% |
| 101 to 250 | 0% |
| >250 | 13% |

The spray mixture was prepared and sprayed in the continuous mode by admixing the coating formulation with the desired proportion of compressed carbon dioxide, both pressurized to the desired spray pressure. The spray mixture was sprayed using a Nordson™ Model SCF-M1 hand spray gun with tip #0410, which has a 9-mil orifice size and a 10–12 inch fan width rating.

The spray mixture had a compressed carbon dioxide content of about 28% by weight and was sprayed at the ambient temperature of about 25 C and a pressure of 950 psi. This produced a narrow fishtail spray with a lengthy liquid film, which produced coatings full of bubbles. The coating composition was then thinned with methyl amyl ketone solvent to a viscosity of 1000 centipoise, but a fishtail liquid-film spray was still produced, which increasing the carbon dioxide concentration did not change. The coating composition was further thinned with acetone to a viscosity of 500 centipoise and the carbon dioxide concentration was increased first to 36% and then to higher concentrations. This failed to achieve transition from the fishtail liquid-film spray to a feathered spray. The coatings continued to be full of bubbles because of the poor atomization. Heating the spray mixture, lowering the pressure, and using different spray nozzles, including a turbulence promoter, failed to bring about the transition or give coatings that were not full of bubbles. This demonstrated that the number-average molecular weight of the coating composition was too high for spraying with subcritical compressed carbon dioxide.

What is claimed is:

1. A process for spraying a liquid coating composition comprising polymeric compounds to form a coating on a substrate, which comprises the steps of:

(1) forming a liquid mixture in a closed pressurized system, said liquid mixture containing a coating composition and a subcritical compressed fluid wherein:

(a) the coating composition contains at least one polymeric compound having a number average molecular weight ($M_n$) of less than about 5,000; and (b) the subcritical compressed fluid is miscible with and forms a liquid mixture with said coating composition and is present in the liquid mixture in an amount which renders the viscosity of said liquid mixture suitable for spraying and being capable of forming a choked flow when sprayed, and wherein said subcritical compressed fluid is a gas at standard conditions of 0° C. temperature and one atmosphere pressure (STP);

(2) spraying said liquid mixture by passing the liquid mixture through an orifice at a temperature and pressure that produces choked flow of the liquid mixture being sprayed which forms the spray; and (3) applying said spray containing said coating composition to said substrate to form a liquid coating thereon, wherein the pressure of the environment outside said orifice into which said liquid mixture is sprayed onto said substrate is below the choke pressure of said choke flow of said liquid mixture.

2. The process of claim 1, wherein the choke pressure of the choked flow of the liquid mixture is greater than about 100 psi.

3. The process of claim 2, wherein the choke pressure of the choked flow of the liquid mixture is greater than about 200 psi.

4. The process of claim 1, wherein the spray is a feathered spray.

5. The process of claim 1, wherein the subcritical compressed fluid is carbon dioxide or ethane or a mixture thereof.

6. The process of claim 1, wherein the at least one polymeric compound has a number average molecular weight ($M_n$) less than about 3,500.

7. The process of claim 6, wherein the at least one polymeric compound has a number average molecular weight ($M_n$) less than about 2,500.

8. The process of claim 1, wherein the coating composition contains in addition at least one polymeric compound having a number average molecular weight ($M_n$) of greater than about 5,000 provided that at least 75 weight percent of the total weight of all polymeric compounds has a weight average molecular weight ($M_w$) less than about 20,000.

9. The process of claim 8, wherein the coating composition contains in addition at least one polymeric compound having a number average molecular weight ($M_n$) of greater than about 5,000 provided that at least 85 weight percent of the total weight of all polymeric compounds has a weight average molecular weight ($M_w$) less than about 10,000.

10. The process of claim 1, wherein the viscosity of the coating composition is greater than about 500 cps.

11. The process of claim 1, wherein the viscosity of the coating composition is less than about 4000 cps.

12. The process of claim 1, wherein the viscosity of the liquid mixture is less than about 150 cps.

13. The process of claim 1, wherein the coating composition contains at least one active solvent in which said at least one polymeric compound is at least partially soluble and which is miscible with the subcritical compressed fluid, said solvent being present in an amount such that the viscosity of the coating concentrate is greater than about 150 centipoise but less than about 4,000 centipoise.

14. The process of claim 13, wherein the at least one active solvent is selected from the group consisting of aliphatic or aromatic hydrocarbons, ketones, esters, ethers, alcohols, and mixtures thereof.

15. The process of claim 1, wherein the coating composition contains one or more polymeric compounds which are selected from the group consisting of acrylics, polyesters, melamines, alkyds, epoxies, urethanes, urea formaldehydes, vinyls, silicone polymers, and mixtures thereof.

16. The process of claim 1, wherein the coating composition contains at least one pigment.

17. The process of claim 1, wherein a pre-orifice is used.

18. The process of claim 1, wherein the spray pressure is greater than about 500 psi.

19. The process of claim 1, wherein the spray temperature and spray pressure are selected such that (1) the spray temperature is less than the subcritical reference temperature and the spray pressure is less than the subcritical reference pressure; (2) the spray temperature is greater than the subcritical reference temperature and the spray pressure is less than the subcritical reference pressure; or (3) the spray pressure is greater than the subcritical reference pressure and the spray temperature is less than the subcritical reference temperature; wherein the subcritical reference temperature is the temperature at which the ratio of gas density to liquid density of the subcritical compressed fluid at equilibrium is 0.6 and the subcritical reference pressure is the pressure equal to 95 percent of the absolute critical pressure of the subcritical compressed fluid.

20. The process of claim 19, wherein the spray temperature and spray pressure are selected such that (1) the spray temperature is less than about 20 degrees C above the critical temperature of the subcritical compressed fluid when the spray pressure is less than the subcritical reference pressure; or (2) the spray pressure is less than about 300 psi above the absolute critical pressure of the subcritical compressed fluid when the spray temperature is less than the subcritical reference temperature.

21. The process of claim 1 wherein the orifice is a spray orifice selected from a spray tip, spray nozzle, spray gun, or an open-ended tube, pipe or conduit.

* * * * *